US009410514B2

(12) United States Patent
Watanabe

(10) Patent No.: US 9,410,514 B2
(45) Date of Patent: Aug. 9, 2016

(54) VARIABLE DISPLACEMENT OIL PUMP

(71) Applicant: HITACHI AUTOMOTIVE SYSTEMS, LTD., Hitachinaka-shi, Ibaraki (JP)

(72) Inventor: Yasushi Watanabe, Kanagawa (JP)

(73) Assignee: HITACHI AUTOMOTIVE SYSTEMS, LTD., Hitachinaka-Shi (JP)

( * ) Notice: Subject to any disclaimer, the term of this patent is extended or adjusted under 35 U.S.C. 154(b) by 395 days.

(21) Appl. No.: 13/852,636

(22) Filed: Mar. 28, 2013

(65) Prior Publication Data

US 2014/0072458 A1 Mar. 13, 2014

(30) Foreign Application Priority Data

Sep. 7, 2012 (JP) ..... 2012-196712

(51) Int. Cl.
*F04B 49/08* (2006.01)
*F02M 39/02* (2006.01)
(Continued)

(52) U.S. Cl.
CPC ..... *F02M 39/02* (2013.01); *F01M 1/02* (2013.01); *F04B 27/1804* (2013.01); *F04B 49/08* (2013.01); *F04C 2/344* (2013.01); *F04C 14/226* (2013.01); *F01M 2001/0238* (2013.01); *F01M 2001/0246* (2013.01); *F04C 2270/185* (2013.01)

(58) Field of Classification Search
CPC ..... F04B 27/1804; F04B 49/08; F04C 2/344; F04C 2/3441; F04C 3/3442; F04C 13/226
USPC ..... 417/213, 220; 418/24, 25, 26, 27, 30
See application file for complete search history.

(56) References Cited

U.S. PATENT DOCUMENTS 5,518,380 A 5/1996 Fujii et al.
6,530,752 B2 3/2003 Oba et al.
(Continued)

FOREIGN PATENT DOCUMENTS

DE EP 2253847 A1 * 11/2010 ..... F04C 2/3442
JP 59-70891 A 4/1984
(Continued)

OTHER PUBLICATIONS

Saga, Non-Final Office Action dated Aug. 14, 2015 issued in corresponding U.S. Appl. No. 14/073,347.
(Continued)

*Primary Examiner* — Patrick Hamo
(74) *Attorney, Agent, or Firm* — Foley & Lardner LLP

(57) ABSTRACT

In a variable displacement oil pump employing a return spring for forcing a cam ring in a clockwise direction, and a control chamber configured to displace the cam ring in a counterclockwise direction with a discharge pressure introduced thereto, a pilot valve is provided to selectively switch between an oil-discharge from the control chamber and an oil-introduction to the control chamber by moving a spool in one direction by a biasing force of a valve spring or by moving the spool in the other direction against the biasing force by the discharge pressure and applied at an oil introduction port of the pilot valve. Also provided is an electromagnetic valve configured to variably control timing at which switching between the oil-discharge and the oil-introduction occurs, with respect to the discharge pressure applied at the oil introduction port, by appropriately changing the preload setting of the valve spring.

16 Claims, 18 Drawing Sheets

(51) Int. Cl.

| | |
|---|---|
| ***F04B 27/18*** | (2006.01) |
| ***F01M 1/02*** | (2006.01) |
| ***F04C 2/344*** | (2006.01) |
| ***F04C 14/22*** | (2006.01) |

(56) References Cited

U.S. PATENT DOCUMENTS

| | | | | |
|---|---|---|---|---|
| 6,672,844 | B2 * | 1/2004 | Fukanuma | F04B 27/1804 417/213 |
| 7,794,217 | B2 | 9/2010 | Williamson et al. | |
| 8,317,486 | B2 | 11/2012 | Williamson et al. | |
| 8,684,702 | B2 | 4/2014 | Watanabe et al. | |
| 9,109,596 | B2 | 8/2015 | Ohnishi et al. | |
| 2008/0308062 | A1 | 12/2008 | Morita et al. | |
| 2009/0022612 | A1 | 1/2009 | Williamson et al. | |
| 2010/0028171 | A1 | 2/2010 | Shulver et al. | |
| 2010/0205952 | A1 | 8/2010 | Yamamuro et al. | |
| 2010/0329912 | A1 | 12/2010 | Williamson et al. | |
| 2011/0085921 | A1 | 4/2011 | Kato et al. | |
| 2011/0123379 | A1 | 5/2011 | Saga et al. | |
| 2011/0194967 | A1 | 8/2011 | Watanabe et al. | |
| 2012/0213655 | A1 | 8/2012 | Ohnishi et al. | |
| 2013/0164163 | A1 | 6/2013 | Ohnishi et al. | |
| 2014/0072456 | A1 | 3/2014 | Watanabe et al. | |
| 2014/0072458 | A1 | 3/2014 | Watanabe et al. | |
| 2014/0147322 | A1 | 5/2014 | Saga | |
| 2014/0219847 | A1 | 8/2014 | Watanabe et al. | |
| 2015/0020759 | A1 | 1/2015 | Watanabe et al. | |
| 2015/0218983 | A1 | 8/2015 | Watanabe et al. | |

FOREIGN PATENT DOCUMENTS

| | | | | |
|---|---|---|---|---|
| JP | 2004-218529 | A | 8/2004 | |
| JP | 2008-524500 | A | 7/2008 | |
| JP | 2011080430 | A * | 4/2011 | F01L 1/34 |
| WO | WO 2006/066405 | A1 | 6/2006 | |

OTHER PUBLICATIONS

Watanabe et al., Non-Final Office Action dated Aug. 31, 2015 issued in corresponding U.S. Appl. No. 14/073,357.

Watanabe: US Office Action on U.S. Appl. No. 13/974,686 dated Mar. 24, 2016.

SAGA: US Office Action on U.S. Appl. No. 14/073,347 dated Apr. 8, 2016.

* cited by examiner

VARIABLE DISPLACEMENT OIL PUMP

TECHNICAL FIELD

The present invention relates to a variable displacement oil pump for automotive internal combustion engines.

BACKGROUND ART

In recent years, as for a variable displacement oil pump, a two-stage discharge pressure characteristic is often required for supplying different apparatus and parts, whose required discharge pressures differ from each other, for example, moving engine parts and a variable valve actuation device configured to control engine-valve operating characteristics, with oil discharged from an oil pump. According to such a two-stage discharge pressure characteristic, the pump discharge pressure can be maintained at a first discharge pressure in a first pump speed range and also maintained at a second discharge pressure in a second pump speed range. One such variable displacement oil pump has been disclosed in Japanese Patent Provisional Publication No. 2008-52450 (hereinafter referred to as "JP2008-524500"), corresponding to International Publication No. WO 2006/066405 (A1).

To satisfy such a two-stage discharge pressure characteristic, the variable displacement oil pump, as disclosed in JP2008-524500, has a cam ring, which is moveable or pivotable against the spring force of a return spring. The variable displacement oil pump is configured to achieve the two-stage discharge pressure characteristic by supplying the discharge pressure (the pressurized working fluid) to a selected one of two pressure-receiving chambers defined on the outer peripheral surface of the cam ring and by changing an eccentricity of a geometric center of the cylinder bore of the cam ring with respect to the axis of rotation of a rotor (exactly, a vane rotor)

SUMMARY OF THE INVENTION

However, in order to suitably adjust or change a relative pressure difference between two different discharge pressures (low and high hydraulic pressure levels) of a two-stage discharge pressure characteristic depending on the sort of apparatus to which the variable displacement oil pump can be applied, the prior-art variable displacement oil pump requires a change of pressure-receiving areas of the cam ring, on which hydraulic pressure of working oil introduced into one of the two pressure-receiving chambers and hydraulic pressure of working oil introduced into the other of the two pressure-receiving chambers respectively act. In other words, depending on the sort of applied apparatus, the sizes of the first and second control oil chambers have to be changed. This means that the basic pump-body structure has to be redesigned and thus the pump body itself has to be newly manufactured.

Accordingly, it is an object of the invention to provide a variable displacement oil pump capable of easily but accurately adjusting or changing a relative pressure difference between two different discharge pressures (first and second discharge pressure levels) of a two-stage discharge pressure characteristic without changing a basic pump-body structure.

In order to accomplish the aforementioned and other objects of the present invention, a variable displacement oil pump comprises a pump structural unit adapted to be driven by an internal combustion engine for varying a volume of each of a plurality of working chambers and for discharging oil, drawn into an inlet portion, from a discharge portion, a variable-volume mechanism configured to vary a variation of the volume of each of the working chambers, which chambers open into the discharge portion, by a displacement of a moveable member included in the pump structural unit, a first biasing member for forcing the movable member in a direction that the variation of the volume of each of the working chambers increases, a control chamber configured to displace the moveable member in a direction that the variation of the volume of each of the working chambers decreases, by introducing the oil, discharged from the discharge portion, into the control chamber, a directional control valve configured to selectively switch between an oil-discharge from the control chamber and an oil-introduction from the discharge portion to the control chamber by moving a valve member in one direction by a biasing force of a second biasing member or by moving the valve member in the other direction against the biasing force of the second biasing member by a discharge pressure discharged from the discharge portion and applied at a port of the directional control valve, and a control mechanism configured to variably control timing at which switching between the oil-discharge from the control chamber and the oil-introduction to the control chamber occurs, with respect to the discharge pressure applied at the port of the directional control valve.

According to another aspect of the invention, a variable displacement oil pump comprises a pump structural unit adapted to be driven by an internal combustion engine for varying a volume of each of a plurality of working chambers and for discharging oil, drawn into an inlet portion, from a discharge portion, a variable-volume mechanism configured to vary a variation of the volume of each of the working chambers, which chambers open into the discharge portion, by a displacement of a moveable member included in the pump structural unit, a first biasing member for forcing the movable member in a biased direction that the variation of the volume of each of the working chambers increases, a control chamber configured to change a displaced position of the moveable member by introducing the oil, discharged from the discharge portion, into the control chamber, a directional control valve including a spool having a pressure-receiving section for receiving the discharge pressure and slidably installed in a close-fitting bore into which a communication passage opens and which communicates with the control chamber, and a second biasing member for forcing the spool in one sliding direction opposite to the other sliding direction of the spool corresponding to a direction of action of the discharge pressure acting on the pressure-receiving section of the spool, the directional control valve being configured to selectively switch between an oil-discharge from the control chamber and an oil-introduction from the discharge portion to the control chamber by a sliding movement of the spool resulting from a relative pressure force between a biasing force created by the discharge pressure and a biasing force of the second biasing member, and a control mechanism configured to control the sliding movement of the spool with a setting change in the biasing force of the second biasing member, occurring by displacing a movable support, which is provided for supporting one end of the second biasing member, depending on a pressure level of the discharge pressure.

According to a further aspect of the invention, a variable displacement oil pump comprises a pump structural unit adapted to be driven by an internal combustion engine for varying a volume of each of a plurality of working chambers and for discharging oil, drawn into an inlet portion, from a discharge portion, a variable-volume mechanism configured to vary a variation of the volume of each of the working chambers, which chambers open into the discharge portion, by a displacement of a moveable member included in the pump structural unit, a first biasing member for forcing the movable member in a biased direction that the variation of the volume of each of the working chambers increases, a control chamber configured to change a displaced position of the moveable member by introducing the oil, discharged from the discharge portion, into the control chamber, a directional control valve including a spool having a pressure-receiving section for receiving the discharge pressure, a sliding sleeve configured to slidably accommodate therein the spool and also configured to have a sliding-contact surface in sliding-contact with an outer periphery of the spool and at least one communication port formed in the sliding-contact surface of the sliding sleeve, and a second biasing member for forcing the spool in one sliding direction, the directional control valve being configured to selectively switch between an oil-discharge from the control chamber and an oil-introduction from the discharge portion to the control chamber by switching an oil-discharge from the communication port and an oil-introduction from the discharge portion to the communication port by moving the spool in the other sliding direction against the biasing force of the second biasing member by a discharge pressure discharged from the discharge portion and acting on the pressure-receiving section of the spool, and a control mechanism configured to enable the sliding sleeve to be displaced in the other sliding direction of the spool against the biasing force of the second biasing member as well as an inertia of the spool.

The other objects and features of this invention will become understood from the following description with reference to the accompanying drawings.

DESCRIPTION OF THE PREFERRED EMBODIMENTS

Figure 1:
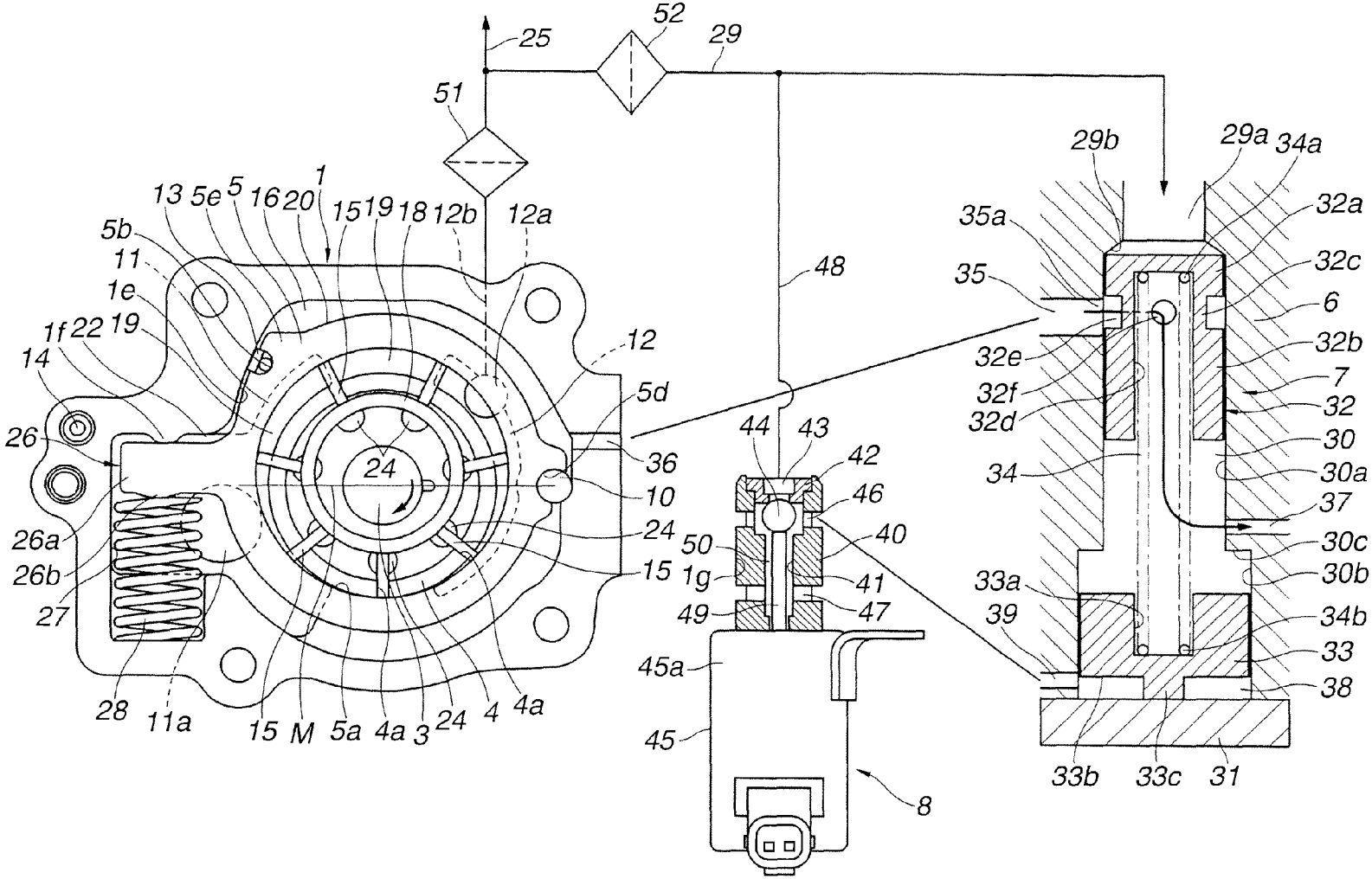
FIG. 1 is a schematic diagram illustrating a variable displacement oil pump system of the first embodiment.

Referring now to the drawings, particularly to FIGS. 1-6, the variable displacement oil pump of the embodiment is exemplified in an automotive internal combustion engine vane-type variable displacement oil pump for supplying working oil to a variable valve actuation device configured to valve timing of each individual engine valve of an automotive internal combustion engine and for supplying lubricating oil to moving engine parts, in particular, for providing lubrication between pistons and cylinder bores in the form of oil jets and for providing lubrication to crank journal bearings of an engine crankshaft.

[First Embodiment]

Figure 2:
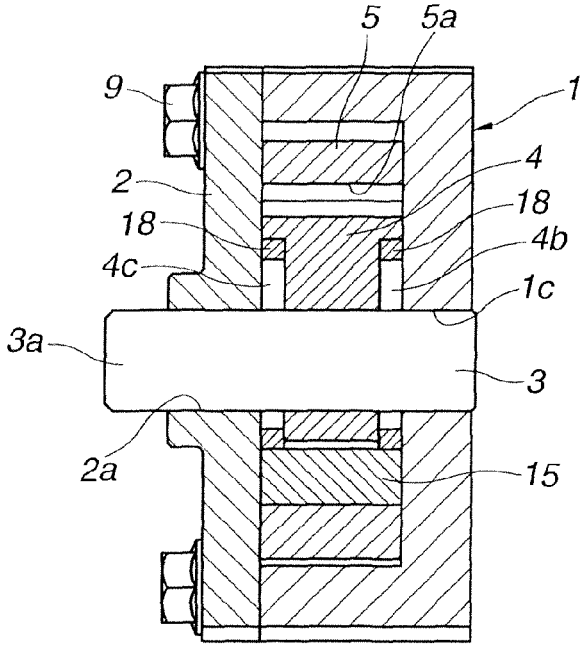
FIG. 2 is a longitudinal cross-sectional view illustrating component parts of the variable displacement oil pump of the first embodiment.

The pump body of the variable displacement oil pump of the embodiment is provided at the front end of a cylinder block (not shown) of the internal combustion engine. As shown in FIGS. 1-2, the pump body is mainly comprised of a pump housing 1, whose one end (an opening end) is hermetically closed by a pump cover 2, and which has a cylindrical bore closed at the other end, a drive shaft 3 adapted to be driven by an engine crankshaft (not shown) and configured to be rotatably fitted in a center bore (a bearing bore 1*c* described later) formed substantially in the center of pump housing 1, a rotor 4 fixedly connected at its central portion to the drive shaft 3 and rotatably accommodated in the pump housing 1, and a cam ring 5, which ring is a moveable member pivotably installed on an outer periphery of rotor 4.

Also provided are a pilot valve 7 installed in a control housing 6 made by aluminum alloy, and serving as a pilot-operated directional control valve for controlling pressure-supply/pressure-release of hydraulic pressure used to produce pivotal movement of cam ring 5, and an electromagnetic solenoid operated directional control valve 8 provided at the front end of the cylinder block and serving as a control mechanism.

As best seen in FIG. 2, when installing the pump cover 2 and the pump housing 1 on the cylinder block, they are fastened together with four bolts 9. Concretely, bolts 9 are inserted through respective bolt insertion holes (through holes) 1*a* formed in the pump cover 2 as well as the pump housing 1, and then the male screw-thread parts of bolts 9 are screwed into respective female screw-threaded portions formed in the cylinder block.

Pump housing 1 is integrally formed by aluminum alloy. As clearly shown in FIG. 3, pump housing 1 has a recessed pump accommodation chamber 1*b* (serving as a working chamber) whose bottom end face precisely machined to ensure a greatly-precise flatness/surface roughness, thus permitting smooth sliding motion of one axial sidewall surface of cam ring 5.

Also, pump housing 1 is formed with the bearing bore ic (the through hole) formed substantially in the center of the bottom face of pump accommodation chamber 1*b* for rotatably supporting one axial end of drive shaft 3 and a pivot-pin hole 1*d* bored in the pump housing at a predetermined position of the inner peripheral surface of pump accommodation chamber 1*b*. A pivot pin 10, serving as a pivot of cam ring 5, is inserted into the pivot-pin hole 1*d*. A circular-arc shaped sealing surface 1*e* is partly formed on the inner periphery of pump accommodation chamber 1*b* and arranged in the upper part of the inner periphery than a straight line "M" (hereinafter referred to as "cam-ring reference line"), extending from the axis of pivot pin 10 and passing through the center of pump housing 1 (that is, the axis of drive shaft 3), when viewed in an axial direction defined by the axis of drive shaft 3.

A seal member 13, fitted into a seal-retention groove 5*b* (described later) formed in the cam ring 5, is permanently in sliding-contact with the previously-noted sealing surface 1*e*, to provide a sealing action by which oil leakage from a control oil chamber 16 (described later) can be prevented. That is to say, a sealing mechanism (a sealing structure) is constructed by both the sealing surface 1*e* and the seal member 13.

Figure 3:
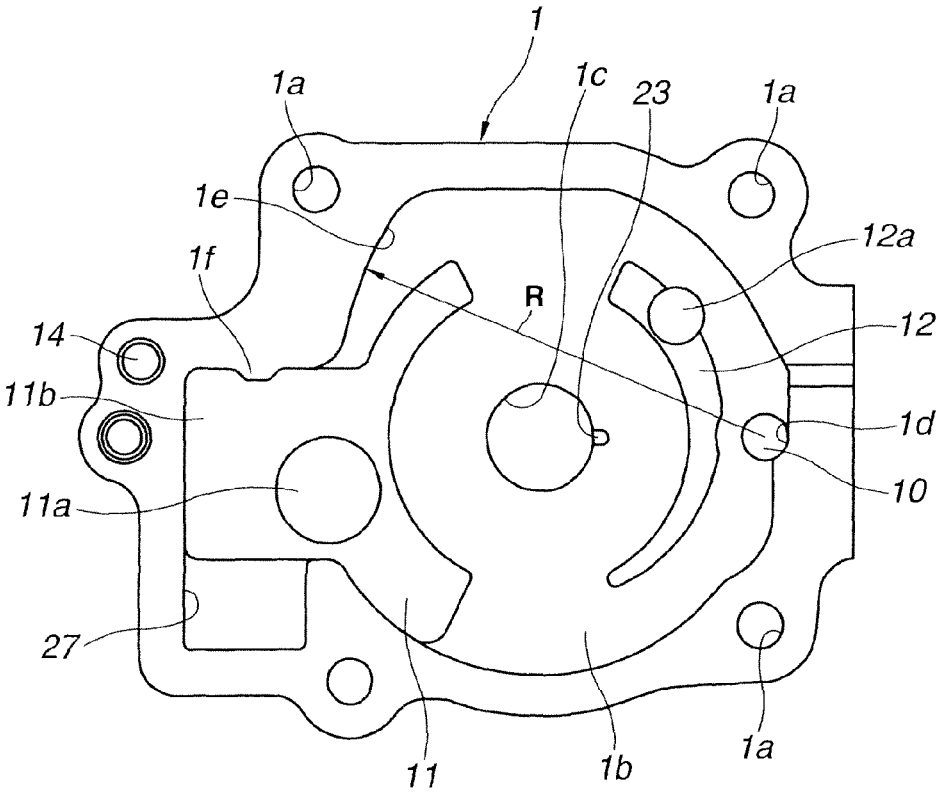
FIG. 3 is a front elevation view of a pump housing of the variable displacement oil pump of the first embodiment.

As seen from the front elevation view of FIG. 3, sealing surface 1*e* is formed into a circular-arc shape whose geometrical center is the pivot-pin hole 1*d* and whose distance from the center (the pivot-pin hole 1*d*) is equal to a specified radius "R" (i.e., a specified length). The specified radius "R" is set to a specified length dimension that permits permanent sliding-contact between the seal member 13 and the circular-arc shaped sealing surface 1*e* within a limited range of eccentric oscillating motion of cam ring 5.

A substantially crescent-shaped recessed inlet port 11 (a suction port or an inlet portion) is formed in the bottom face of pump housing 1 and placed on the left-hand side of drive shaft 3 (bearing bore 1*c*). A substantially crescent-shaped discharge port 12 (an outlet port or a discharge portion) is formed in the bottom face of pump housing 1 and arranged at a given position diametrically opposed to the inlet port 11, that is, on the right-hand side of drive shaft 3. Concrete configurations of inlet port 11 and discharge port 12, substantially diametrically opposed to each other, are described later.

Furthermore, a lubricating-oil groove 23 is formed in the inner peripheral surface of the bearing bore 1*c* of pump accommodation chamber 1*b*, configured to rotatably support the drive shaft 3, for supplying lubricating oil discharged from the discharge port 12. Lubricating-oil groove 23 is formed to extend in the axial direction of drive shaft 3 over a given range from the circumferential edge of one opening end of bearing bore 1*c* to a substantially midpoint of the entire axial length of bearing bore 1*c*. Lubricating oil, stored or kept in the lubricating-oil groove 23, interpose a film of oil between the drive shaft 3 and the bearing bore 1*c*, thus ensuring a lubrication performance for the rotating drive shaft 3 and also suppressing undesired wear/seizing, occurring due to sliding friction.

Returning to FIG. 2, pump cover 2 is made by aluminum alloy and formed as a substantially disc-shaped, front plate cover. Pump cover 2 has a bearing bore 2*a* (a through hole) formed substantially in the center of pump cover 2 for rotatably supporting the other axial end of drive shaft 3. Also, pump cover 2 is integrally formed with a plurality of radially-outward extending boss-like portions in which the bolt insertion holes (through holes) 1*a* for respective bolts 9 are formed. In the shown embodiment, the inside wall surface of pump cover 2 is formed as a simple flat surface. In lieu thereof, in a similar manner to the bottom face of pump accommodation chamber 1*b* of pump housing 1, the pump cover 2 may be configured to have diametrically-opposed inlet and discharge ports and oil-reservoir spaces, formed or defined in the inner peripheral wall surface of pump cover 2. Also, pump cover 2 is positioned circumferentially with respect to the pump housing 1 by means of a positioning pin 14 fixedly connected to the pump housing 1, such that coaxial alignment between the pump-housing side bearing bore 1*c* and the pump-cover side bearing bore 2*a*, rotatably supporting both axial ends of drive shaft 3, is ensured. As previously discussed, the pump cover 2 and the pump housing 1 are fastened together with four bolts 9. By the way, the previously-discussed control housing 6 of pilot valve 7 is integrally connected to the outside face of pump housing 1. The tip 3*a* (the outermost end) of drive shaft 3, protruded from the pump cover 2, is configured to be coupled with a motion-transmission mechanism, such as a gear mechanism, so as to rotate the rotor 4 in the direction of rotation (clockwise) indicated by the arrow in FIG. 1 by input torque, transmitted from the engine crankshaft via the tip 3*a* of drive shaft 3. As can be seen in FIG. 3, the left-hand half of pump accommodation chamber 1*b* of pump housing 1 serves as an inlet area (a suction area), whereas the right-hand half of pump accommodation chamber 1*b* of pump housing 1 serves as a discharge area (an outlet area).

As shown in FIGS. 1-2, rotor 4 has seven slits 4*a* formed to extend radially outward and has seven back-pressure chambers 24 formed at the respective basal portions of slits 4*a*. Seven vanes 15 are fitted into respective slits 4*a* of rotor 4, in a manner so as to be slidable (retractable and extendable) in the radial direction of rotor 4. Each of back-pressure chambers 24 has a circular cross-section for introducing discharge pressure, introduced from the discharge port 12, into the back-pressure chambers 24. By virtue of pressure in each of back-pressure chambers 24 and a centrifugal force created by rotation of rotor 4, each of vanes 15 can be pushed radially outward.

As best seen in FIG. 2, rotor 4 has a substantially I-shaped cross section. The I-shaped rotor 4 has a pair of vane-ring grooves 4*b* and 4*c* formed in respective sidewalls of the inner peripheral portion of rotor 4. A pair of vane rings 18, 18 are installed in the respective vane-ring grooves 4*b* and 4*c*. Vane rings 18, 18 are installed in the respective sidewalls of the inner peripheral portion of rotor 4, so that sliding motions of vane rings 18, 18 relative to the respective sidewalls of the inner peripheral portion of rotor 4 are permitted. Each of the radially-inward ends (the basal portions) of vanes 15 is kept in sliding-contact with the outer peripheral surfaces of vane rings 18, 18. During operation of the pump, each of the radially-outward ends (the tips) of vanes 15 is brought into sliding-contact with the inner peripheral surface 5*a* of cam ring 5. One pump working chamber is defined between two adjacent vanes 15. That is, seven variable-volume pump working chambers (simply, pump chambers) 19 are defined as seven internal spaces partitioned in a fluid-tight fashion and surrounded by vanes 15, the inner peripheral surface 5*a* of cam ring 5, the outer peripheral surface of rotor 4, and two axially opposed sidewalls (i.e., the bottom face of the recessed pump accommodation chamber 1*b* of pump housing 1 and the inside face of pump cover 2).

The vane-ring pair (18, 18) has a function that pushes or forces each of vanes 15 outwards in the radial direction of the rotor. Even during operation of the engine at low speeds, in which the centrifugal force, created by rotation of rotor 4, and the pressure in each of back-pressure chambers 24 are both low, each of the radially-outward ends (the tips) of vanes 15 can be brought into sliding-contact with the inner peripheral surface 5*a* of cam ring 5 by means of the vane-ring pair (18, 18) and hence the pump chambers 19 can be partitioned in a fluid-tight fashion.

Cam ring 5 is made of easily-machined sintered alloy materials and integrally formed into a substantially cylindrical shape. As shown in FIG. 1, cam ring 5 has a pivot recessed portion 5*d* formed in its outer peripheral surface and arranged at the rightmost end of the previously-discussed cam-ring reference line "M". Pivot pin 10, which is fitted and positioned into the pivot recessed portion 5*b*, serves as a fulcrum of oscillating motion of cam ring 5.

Cam ring 5 has a substantially triangular integrally-formed protruding portion 5*e* configured in the upper left part of the outer periphery of cam ring 5 than the cam-ring reference line "M". The previously-discussed seal-retention groove 5*b* is formed in the protruding portion 5*e* of cam ring 5 for retaining the seal member 13 therein.

As appreciated from the above, a pump structural unit is constructed by the drive shaft 3, the rotor 4, the cam ring 5, the vanes 15, and the vane rings 18, 18.

The previously-discussed control oil chamber 16 is defined between the inner periphery of pump housing 1 and the upper part of the outer periphery of cam ring 5 (including the protruding portion 5*e*) than the cam-ring reference line "M".

Control oil chamber 16 is configured such that, by way of hydraulic pressure introduced into the control oil chamber 6, the cam ring 5 is displaced or forced against the bias of a first biasing member, simply a biasing member (a coil spring 28 described later) in a direction that an eccentricity of the geometric center of cam ring 5 to the axis of rotation of drive shaft 3 decreases. Control oil chamber 16 is also configured such that fluid-communication between the control oil chamber 16 and the discharge port 12 is established or blocked by means of the pilot valve 7. Furthermore, control oil chamber 16 is sealed in a fluid-tight fashion such that oil leakage from the control oil chamber 16 can be prevented by the previously-discussed sealing mechanism, constructed by the sealing surface 1*e* of the inner periphery of pump housing 1 and the seal member 13 fitted into the seal groove 5*b* of cam ring 5 even during oscillating motion of cam ring 5.

The outer peripheral surface of cam ring 5, facing the control oil chamber 16, functions as a pressure-receiving surface 20.

The hydraulic pressure, introduced into the control oil chamber 16 and acting on the pressure-receiving surface 20, serves as a force that the eccentricity of the geometric center of cam ring 5 to the axis of rotation of drive shaft 3 decreases by counterclockwise oscillating motion (viewing FIG. 1) of the cam ring 5 about the pivot pin 10 serving as a fulcrum of oscillating motion of cam ring 5.

Seal member 13 is made of a low-friction synthetic resin material and formed as an axially-elongated oil seal extending along the axial direction of cam ring 5. Seal member 13 is retained and fitted into the seal-retention groove 5*b* formed in the outer peripheral surface of protruding portion 5*e* of cam ring 5. A rubber elastic member or an elastomeric member (not numbered) is attached onto the innermost end face of the seal-retention groove 5*b*. Thus, the seal member 13 of cam ring 5 is permanently forced toward the sealing surface 1*e* of pump housing 1 by the elastic force of the rubber elastic member. The sealing surface 1*e* of pump housing 1 and the seal member 13 of cam ring 5, abutted each other, provide a good leakproof seal, thus suppressing an internal oil leakage from the control oil chamber 16 to the low-pressure side to a minimum.

As shown in FIGS. 1-3, inlet port 11 is configured to open into pump chambers 19 whose volumes increase during rotation of the rotor in an eccentric state of the geometric center of cam ring 5 to the axis of rotation of rotor 4. Inlet port 11 is configured so that lubricating oil in an oil pan (not shown) is drawn through an inlet hole 11*a* into the inlet port 11 by a negative pressure produced by a pumping action of the pump structural unit. Inlet hole 11*a* is formed substantially at a midpoint of the crescent-shaped recessed inlet port 11. Additionally, a working-fluid introduction portion 11*b* is formed substantially at a midpoint of the outer peripheral side of inlet port 11 in a manner so as to extend toward a spring chamber 27 (described later). Introduction portion 11*b* communicates with the inlet hole 11*a*. The inlet hole 11*a*, together with the introduction portion 11*b*, communicates with a low-pressure chamber 22. Inlet hole 11*a* is configured to supply working fluid (oil), which is drawn up from the oil pan through a suction passage (not shown) by a negative pressure produced by a pumping action of the pump structural unit, into the inlet port 11 so as to introduce the working fluid to pump chambers 19 whose volumes increase during rotation of the rotor. As discussed above, the inlet port 11, the inlet hole 11*a*, the introduction portion 11*b*, the low-pressure chamber 22 constructs a low-pressure structural portion.

On the other hand, discharge port 12 is configured to open into pump chambers 19 whose volumes decrease during rotation of the rotor in an eccentric state of the geometric center of cam ring 5 to the axis of rotation of rotor 4. A discharge hole 12*a* is formed in an upper portion of the crescent-shaped discharge port 12. Discharge port 12 is configured so that oil is delivered from the inlet hole 12*a* through a discharge passage 12*b* and a main oil gallery 25 (described later) formed in a cylinder head into moving or sliding engine parts and a variable valve actuation device such as a variable valve timing control device.

Electromagnetic solenoid operated directional control valve 8 (detailed later) as well as pilot valve 7 (detailed later) is disposed in a branch passage 29, branched from the main oil gallery 25.

By the way, a first oil filter 51 is disposed in the main oil gallery 25 and placed in the vicinity of the discharge passage 12*b*. A second oil filter 52 is disposed in the branch passage 29 near the branch point of the upstream side of main oil gallery 25 and branch passage 29. Hence, oil, supplied to the directional control valve 8 as well as the pilot valve 7, can be filtered doubly by means of these oil filters.

As a filtering element of each of oil filters 51-52, a filter paper is used. To easily replace the filter clogged up, a replaceable cartridge-type oil filter or a replaceable filter-paper equipped oil filter is used.

As best seen in FIG. 1, cam ring 5 has an arm 26 integrally formed to extend radially outward from the outer peripheral surface of the cam-ring cylindrical main body and located on the opposite side to the pivot recessed portion 5*d*. Arm 26 is comprised of a radially-outward protruding main arm body 26*a* having a substantially rectangular cross section and a substantially semi-spherical contacting surface protrusion 26*b* integrally formed on the lower face of main arm body 26*a*. In more detail, a portion of the lower face of the arm main body 26*a* except the semi-spherical contacting surface protrusion 26*b* is formed as a flat surface. On the other hand, the outer peripheral surface of protrusion 26*b* is formed as a semi-spherical surface having a small radius of curvature.

Spring chamber 27 is arranged at the opposite position to the pivot-pin hole 1*d* of pump housing 1 and formed to face the underside of arm 26.

Spring chamber 27 is formed into a substantially rectangular shape having longer opposite sides in the axial direction of pump housing 1. Coil spring 28 (the biasing member) is installed in the spring chamber 27 for biasing such that the cam ring 5 is biased or forced through the arm 26 in the clockwise direction (viewing FIG. 1), that is, in the direction that the eccentricity of the geometric center of cam ring 5 to the axis of rotation of rotor 4 increases. By the way, spring chamber 27 communicates with the low-pressure chamber 22 through the introduction portion 11*b* and the inlet port 11.

When assembling, coil spring 28 is disposed between the semi-spherical protrusion 26*b* of arm 26 and the bottom face of spring chamber 27, under preload. The top face of coil spring 28 is always kept in abutted-engagement with the semi-spherical protrusion 26*b* over the entire range of oscillating motion of cam ring 5 during operation of the pump. More concretely, the top face of coil spring 28 is kept in elastic-contact with the semi-spherical protrusion 26*b* of arm 26, whereas the bottom face of coil spring 28 is kept in elastic-contact with the bottom face of spring chamber 27. Thus, the arm 26 of cam ring 5 is permanently forced or biased by a given spring load W, produced by coil spring 28, in the clockwise direction (viewing FIG. 1) that the eccentricity of the geometric center of cam ring 5 to the axis of rotation of rotor 4 increases.

Under preload, in other words, under a spring-loaded state where the spring load W is applied to the arm 26, coil spring 28 functions to permanently force or bias the arm 26 of cam ring 5 upward (viewing FIG. 1) in a direction that the eccentricity of the geometric center of cam ring 5 to the axis of rotation of rotor 4 increases, that is, in a direction that the volume difference between a volume of the largest working chamber of pump chambers 19 and a volume of the smallest working chamber of pump chambers 19 increases, in other words, in a direction that the rate of change of the volume of each of pump chambers 19 increases. As can be seen from the characteristic diagram of FIG. 6, the given spring load W, produced by coil spring 28 with cam ring 5 kept at its initial setting position (i.e., the maximum-eccentricity angular position) shown in FIG. 1, is set to a spring force that cam ring 5 begins to move (oscillate) counterclockwise from the initial setting position when the discharge pressure from the pump (that is, the hydraulic pressure in the control oil chamber 16) reaches a hydraulic pressure P1 required for the variable valve timing control (VTC) device.

A substantially semi-spherical motion-restriction protrusion if is integrally formed on the inner peripheral surface of pump housing 1 to be opposed to the spring chamber 27 in the axial direction of coil spring 28. With cam ring 5 kept at its initial setting position (i.e., the maximum-eccentricity angular position or the spring-loaded original position) shown in FIG. 1, the semi-spherical motion-restriction protrusion if is brought into abutted-engagement with the upside of arm 26, for restricting a maximum clockwise angular displacement of the arm 26 of cam ring 5.

As seen from the right-hand cross-section of FIG. 1, pilot valve 7 is mainly comprised of a stepped cylindrical close-fitting bore 30, a substantially cylindrical small-diameter valve spool (simply, a spool) 32 (a substantially cylindrical valve member), a substantially cylindrical large-diameter axially-movable spring-support slider 33, and a valve spring 34 (serving as a second biasing member). Stepped cylindrical close-fitting bore 30 is formed in the control housing 6 to extend vertically. Stepped cylindrical close-fitting bore 30 is comprised of an upper small-diameter bore 30*a*, a lower large-diameter bore 30*b*, and a stepped or shouldered portion 30*c*. The lowermost end of large-diameter bore 30*b* is hermetically closed by a lid member 31. Spool 32 is vertically slidably installed in the small-diameter bore 30*a*. Large-diameter spring-support slider 33 is vertically slidably installed in the large-diameter bore 30*b*. Valve spring 34 is disposed between the spool 32 and the large-diameter spring-support slider 33 under preload such that the spool 32 and the large-diameter spring-support slider 33 are biased to be spaced from each other in the opposite axial directions.

The upper end of small-diameter bore 30*a* of stepped cylindrical close-fitting bore 30 communicates with the branch passage 29 through an oil introduction port 29*a* (a pilot pressure port) formed in the control housing 6. One opening end 35*a* of a first communication passage 35 is configured to open into the upper portion of small-diameter bore 30*a* of stepped cylindrical close-fitting bore 30. The other end of the first communication passage 35 communicates with the control oil chamber 16 through a communication bore 36 formed in the right-hand end wall of pump housing 1.

The inside diameter of oil introduction port 29*a* is dimensioned to be less than that of small-diameter bore 30*a*, in a manner so as to form a frusto-conical tapered valve-spool-land bearing or seating surface 29*b* between them. With a first land 32*a* (described later) of spool 32 seated on the tapered bearing surface 29*b*, the oil introduction port 29*a* is closed.

One opening end of a drain passage 37, which passage communicates with the oil pan, is configured to open into the lower portion of small-diameter bore 30*a*.

Spool 32 is comprised of first and second lands 32*a*-32*b*, and a small-diameter shaft 32*c* between them. The first land 32*a* constructs a valve element. The outside diameter of the second land 32*b* is dimensioned to be identical to that of the first land 32*a*. Spool 32 has a cylindrical bore 32*d* closed at its upper end and extending along the axis of spool 32.

The axial length of the first land 32*a* is dimensioned to be shorter than that of the second land 32*b*. The opening end 35*a* of the first communication passage 35 is opened or closed depending on the axial position (axially sliding motion) of the first land 32*a* of spool 32. The upper end 34*a* of valve spring 34 is kept in elastic-contact with the upper end face of cylindrical bore 32*d*. By the way, the axial length of the first land 32*a* is dimensioned to be slightly greater than the inside diameter of the opening end 35*a* of the first communication passage 35.

The second land 32*b* has an axially long outer peripheral surface that ensures a stable sliding motion of spool 32 in the small-diameter bore 30*a*.

Small-diameter shaft 32*c* defines an annular groove 32*e* between first and second lands 32*a*-32*b*. At the spool position shown in FIG. 1, the annular groove 32*e* is configured to face the opening end 35*a* of the first communication passage 35. Also, small-diameter shaft 32*c* has a radial through hole 32*f* for communicating the annular groove 32*e* with the cylindrical bore 32*d* by way of the radial through hole 32*f*.

On the other hand, large-diameter spring-support slider 33 has a spring-support bore 33*a* closed at its lower end and configured to retain the lower end of valve spring 34 such that the lower end 34*b* of valve spring 34 is kept in elastic-contact with the bottom end face of spring-support bore 33*a*. A cylindrical small-diameter stopper protrusion 33*c* is integrally formed at the center of the underside 33*b* (serving as a large-diameter pressure-receiving surface) of large-diameter spring-support slider 33. The stopper protrusion 33*c* is provided for restricting a maximum downward movement (i.e., lowermost axial position) of the large-diameter spring-support slider 33. Also, the stopper protrusion 33*c* is configured to define a large-diameter pressure-receiving chamber 38 between the underside (large-diameter pressure-receiving surface 33*b*) of large-diameter spring-support slider 33 and the inside face of lid member 31. The underside 33*b* receives hydraulic pressure introduced through the directional control valve 8 into the pressure-receiving chamber 38, so as to cause an upward sliding motion of large-diameter spring-support slider 33.

A second communication passage 39 is provided to communicate a supply-and-exhaust port 46 (described later) of directional control valve 8 with the pressure-receiving chamber 38 of pilot valve 7. One opening end of the second communication passage 39 is configured to open into the lowermost end of large-diameter bore 30*b*.

As seen in FIG. 1, electromagnetic solenoid operated directional control valve 8 is mainly comprised of a valve body 40, a valve seat 42, a metal ball valve 44, and an electromagnetic solenoid 45. Valve body 40 is press-fitted into a valve accommodation bore 1*g* formed in the cylinder block at a given position. Valve body 40 has an axially-extending inside stepped working bore 41. Valve seat 42 is press-fitted into the upper end of valve body 40 (exactly, the upper large-diameter bore of working bore 41) and has a central solenoid control port 43. Ball valve 44 is configured to seat on or lift from the valve seat 42, for opening or closing the opening end of solenoid control port 43. Solenoid 45 is integrally connected to the lower end of valve body 40.

Valve body 40 has the supply-and-exhaust port 46 (a radial through hole) formed at the upper end and configured to communicate with the upper large-diameter bore of working bore 41. Also, valve body 40 has a drain port 47 (a radial through hole) formed at the lower end and configured to communicate with the lower small-diameter bore of working bore 41. Supply-and-exhaust port 46 always communicates with the pressure-receiving chamber 38 of pilot valve 7 through the second communication passage 39.

Solenoid control port 43 communicates with the branch passage 29 through an oil passage 48 formed in the cylinder block.

Solenoid 45 includes a solenoid casing 45*a*, an electromagnetic coil (not shown), a stationary iron core, and a movable iron core, all accommodated in the casing 45*a*. A pushrod 49 is fixedly connected to the tip of the movable iron core and configured to axially slide in the small-diameter bore of working bore 41 for producing or removing a push on the ball valve 44.

A cylindrical passage 50 is defined between the outer peripheral surface of pushrod 49 and the inner peripheral surface of the small-diameter bore of working bore 41, for appropriately communicating the supply-and-exhaust port 46 with the drain port 47 by way of the cylindrical passage 50.

When the electromagnetic coil of solenoid 45 is energized, the pushrod 49 extends such that the tip of pushrod 49 pushes the ball valve 44 upward. As a result, the ball valve 44 seats on the valve seat 42 so as to close the opening end of solenoid control port 43. At the same time, the supply-and-exhaust port 46 is communicated with the drain port 47 by way of the cylindrical passage 50.

Figure 5:
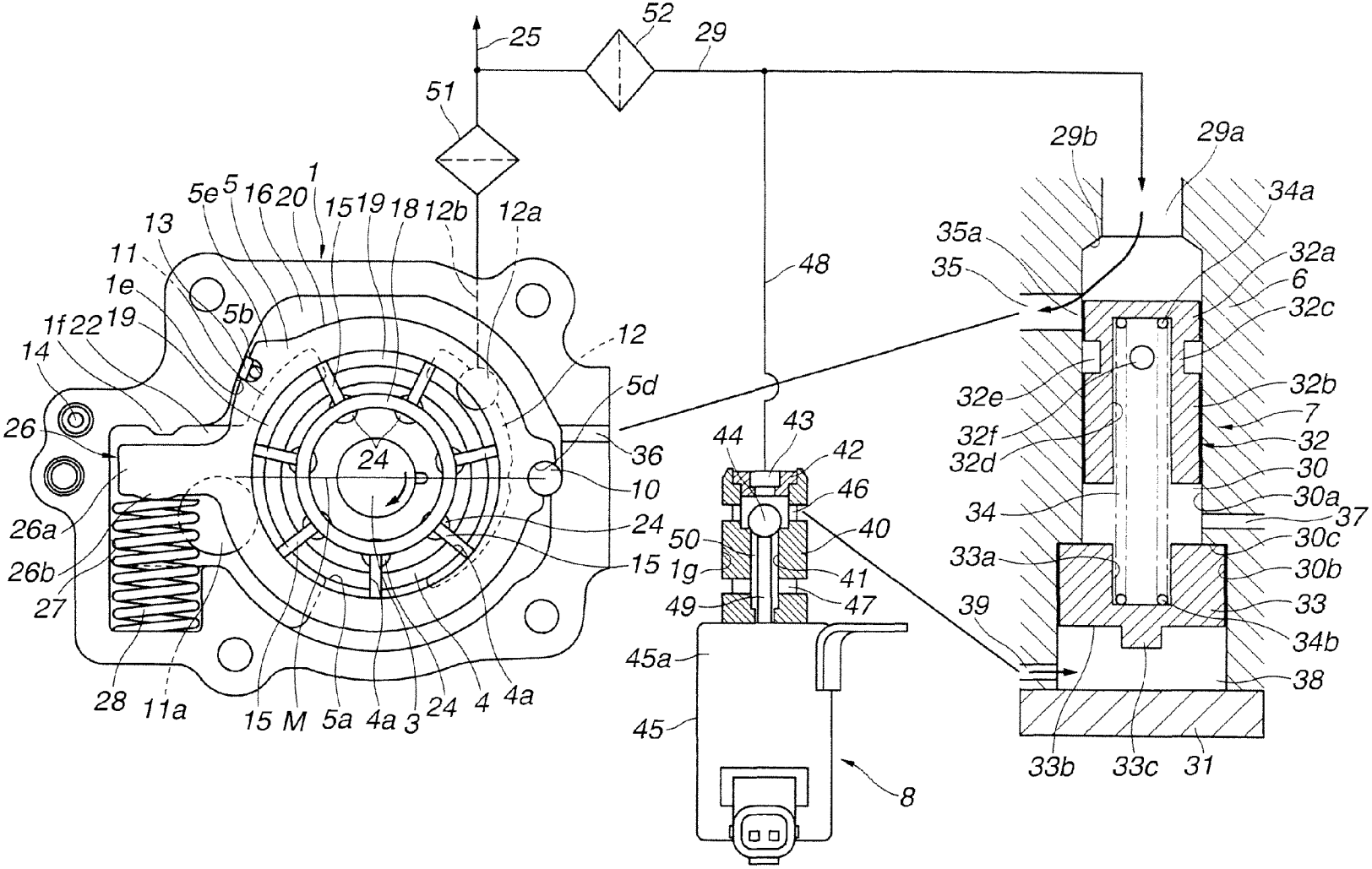
FIG. 5 is an explanatory view illustrating the operation of the variable displacement oil pump system of the first embodiment during high-load operation.

Conversely when the electromagnetic coil of solenoid 45 is de-energized, as clearly shown in FIG. 5, the pushrod 49 retracts such that a push on the ball valve 44 is removed. As a result, fluid-communication between the solenoid control port 43 and the supply-and-exhaust port 46 is established. At the same time, fluid-communication between the cylindrical passage 50 and the drain port 47 is blocked.

Energization/de-energization (ON/OFF) of the electromagnetic coil of solenoid 45 is controlled responsively to a control command from an electronic control unit (not shown).

Although it is not clearly shown in the drawings, the electronic control unit (ECU) generally comprises a microcomputer. The control unit includes an input/output interface (I/O), memories (RAM, ROM), and a microprocessor or a central processing unit (CPU). The input/output interface (I/O) of the control unit receives input information from various engine/vehicle sensors, namely an engine oil temperature sensor, an engine temperature sensor (e.g., an engine coolant temperature sensor), an engine speed sensor, an engine load sensor and the like. Within the control unit, the central processing unit (CPU) allows the access by the I/O interface of input informational data signals from the previously-discussed engine/vehicle sensors. The CPU of the control unit is configured to detect or determine an engine operating condition based on the input informational data and further configured to control, based on the determined engine operating condition (in particular, latest up-to-date information about engine speed), the operation of the electromagnetic coil of solenoid 45. Concretely, when latest up-to-date information about engine speed is less than or equal to a predetermined reference engine speed "N" (see the characteristic diagram shown in FIG. 6), the control unit generates a command (an ON signal) for energizing the electromagnetic coil of solenoid 45. Conversely when latest up-to-date information about engine speed is greater than the predetermined reference engine speed "N", the control unit generates a command (an OFF signal) for de-energizing the electromagnetic coil of solenoid 45. However, in the case that latest up-to-date information about engine speed is less than or equal to the predetermined reference engine speed "N" but latest up-to-date information about engine load is greater than a predetermined reference engine load, that is, during high load operation, the control unit generates a command (an OFF signal) for de-energizing the electromagnetic coil of solenoid 45.

[Operation of First Embodiment]

The operation of the variable displacement oil pump system of the first embodiment is hereunder described in detail.

When the engine is operating at low speeds, such as during an idling period following engine start-up, in other words, during the initial startup of the pump, cam ring 5 is spring-loaded or biased as shown in FIG. 1 by the spring force of coil spring 28, and thus arm 26 is brought into abutted-engagement with the motion-restriction protrusion if. Hence, cam ring 5 is kept at its maximum clockwise angular position (a cam-ring maximum-eccentricity angular position) at which the eccentricity of the geometric center of cam ring 5 to the axis of rotation of drive shaft 3 becomes a maximum value and thus the pump discharge flow rate also becomes a maximum value.

At this time, the electromagnetic coil of directional control valve 8 becomes energized responsively to an ON signal from the control unit, and thus the pushrod 49 extends to push the ball valve 44 upward. As a result, the opening end of solenoid control port 43 is closed by the ball valve 44 and hence fluid-communication between the solenoid control port 43 and the supply-and-exhaust port 46 is blocked and fluid-communication between the supply-and-exhaust port 46 and the drain port 47 is established. Therefore, pressure-receiving chamber 38 of pilot valve 7 becomes communicated with the oil pan through the second communication passage 39, the supply-and-exhaust port 46, the cylindrical passage 50, and the drain port 47 and thus there is no hydraulic pressure acting on the pressure-receiving surface 33*b* of large-diameter spring-support slider 33. Large-diameter spring-support slider 33 is forced or biased downward by the spring force of valve spring 34. At this time, a maximum downward displacement of large-diameter spring-support slider 33 is restricted by abutment of the stopper protrusion 33*c* with the inside face of lid member 31.

On the other hand, spool 32 is forced or biased upward by the spring force of valve spring 34 and thus the circular top of the first land 32*a* is seated on the tapered bearing surface 29*b* and thus held at the uppermost axial position of spool 32. Hence, fluid-communication between the oil introduction port 29*a* and the first communication passage 35 is blocked and fluid-communication between the first communication passage 35 and the drain passage 37 through the annular groove 32*e*, the radial through hole 32*f*, and the cylindrical bore 32*d* is established.

Therefore, control oil chamber 16 becomes communicated with the oil pan through the communication bore 36, the first communication passage 35, the annular groove 32*e*, the radial through hole 32*f*, the cylindrical bore 32*d*, and the drain passage 37, and thus there is no hydraulic pressure supplied or directed to the control oil chamber 16.

Any counterclockwise displacement of cam ring 5 against the spring force of coil spring 28 does not occur, and hence cam ring 5 is held at its maximum-eccentricity angular position. Under these conditions, the pump discharge pressure as well as the pump discharge flow rate increases proportionally, as the engine speed increases (see the engine-speed versus hydraulic-pressure characteristic in a low-speed range "a" shown in FIG. 6). By the way, the hydraulic pressure at this point of time becomes a hydraulic pressure level included within a required hydraulic pressure range for the VTC device.

When the risen hydraulic pressure is introduced or applied from the main oil gallery 25 through the branch passage 29 into the oil introduction port 29*a* of pilot valve 7, spool 32 begins to move downward against the spring force of valve spring 34. When the pump discharge pressure reaches the hydraulic pressure P1, spool 32 shifts to a slightly downward-displaced axial position. With the spool 32 slightly displaced downward from the uppermost spring-offset axial position, fluid-communication between the oil introduction port 29*a* and the opening end 35*a* of first communication passage 35 remains blocked by the first land 32*a*. Thus, there is no hydraulic pressure supply to the control oil chamber 16.

As previously described, the given spring load (the set spring force) of coil spring 28 (with cam ring 5 kept at its initial setting position) is set to a spring force that cam ring 5 begins to be displaced counterclockwise from the initial setting position by hydraulic pressure of the given hydraulic pressure level P1 supplied to the control oil chamber 16 without any pressure reduction and then the geometric center of cam ring 5 and the axis of rotation of drive shaft 3 become concentric to each other, in other words, the eccentricity of the geometric center of cam ring 5 to the axis of rotation of drive shaft 3 becomes zero. Hence, when spool 32 is further displaced downward and thus the first land 32*a* reaches a further downward position shown in FIG. 4, the oil introduction port 29*a* becomes communicated with the first communication passage 35 by way of a small aperture (also serving as a flow-constriction orifice) defined with the first land 32*a* further downwardly displaced. Thus, the reduced hydraulic pressure is supplied through the first communication passage 35 to the control oil chamber 16, and as a result the pump discharge flow rate can be adjusted by a counterclockwise displacement of cam ring 5 against the spring force of coil spring 28.

When hydraulic pressure, supplied from the first communication passage 35 to the control oil chamber 16, is excessively high, a counterclockwise displacement of cam ring 5 tends to become large, and thus the pump discharge flow rate decreases. As a result, a fall in hydraulic pressure, supplied to the main oil gallery 25, occurs, and thus spool 32 can be displaced upward by the spring force of valve spring 34. Hence, the flow passage area of the small aperture, defined by the first land 32*a* to communicate the oil introduction port 29*a* with the first communication passage 35, becomes smaller and whereby the hydraulic pressure supplied to the control oil chamber 16 falls.

Conversely when hydraulic pressure, supplied from the first communication passage 35 to the control oil chamber 16, is excessively low, a counterclockwise displacement of cam ring 5 tends to become small, and thus the eccentricity of the geometric center of cam ring 5 to the axis of rotation of drive shaft 3 becomes greater and the pump discharge flow rate excessively increases. As a result, a rise in hydraulic pressure, supplied to the main oil gallery 25, occurs, and thus a downward movement of spool 32 against the spring force of valve spring 34 occurs. Hence, the flow passage area of the small aperture, defined by the first land 32*a* to communicate the oil introduction port 29*a* with the first communication passage 35, becomes larger and whereby the hydraulic pressure supplied to the control oil chamber 16 rises.

In this manner, immediately when the pump discharge pressure reaches the given hydraulic pressure P1, fluid-communication between the oil introduction port 29*a* and the first communication passage 35 becomes established, and thereafter the hydraulic pressure in the control oil chamber 16 can be appropriately controlled or regulated by virtue of an appropriate change in the flow passage area of the small aperture, defined by the first land 32*a* to communicate the oil introduction port 29*a* with the first communication passage 35, such that the pump discharge pressure can be held at the given hydraulic pressure P1. Additionally, the hydraulic pressure in the control oil chamber 16 can be appropriately controlled or regulated by a comparatively small axial movement of spool 32 (in particular, the first land 32*a*) without being almost affected by a spring constant of valve spring 34.

That is to say, even when a slight fluctuation in hydraulic pressure (pump discharge pressure) occurs, it is possible to satisfactorily change the flow passage area of the small aperture defined by the first land 32*a*. Thus, even when the engine speed increases, there is a less rise in hydraulic pressure. Hence, as can be seen from the engine-speed versus hydraulic-pressure characteristic indicated by the horizontal solid line "b" in FIG. 6, the hydraulic pressure (the pump discharge pressure) can be controlled or regulated to the given constant pressure level P1.

Furthermore, suppose that a change in the distribution of hydraulic pressure applied to the inner peripheral surface 5*a* of cam ring 5 occurs due to an engine speed change, a working-oil temperature change (an oil viscosity change), mixing of air into working oil (lubricating oil), and/or the occurrence of cavitation, and thus a fluctuation in hydraulic pressure, by which cam ring 5 can be displaced about the pivot pin, occurs. In such a case, after the given hydraulic pressure P1 has been reached and thus fluid-communication between the oil introduction port 29*a* and the first communication passage 35 has been established, the hydraulic pressure in the control oil chamber 16 can be appropriately controlled or regulated by virtue of an appropriate change in the flow passage area of the small aperture defined by the first land 32*a*, without being affected by such a change in the hydraulic-pressure distribution.

Figure 6:
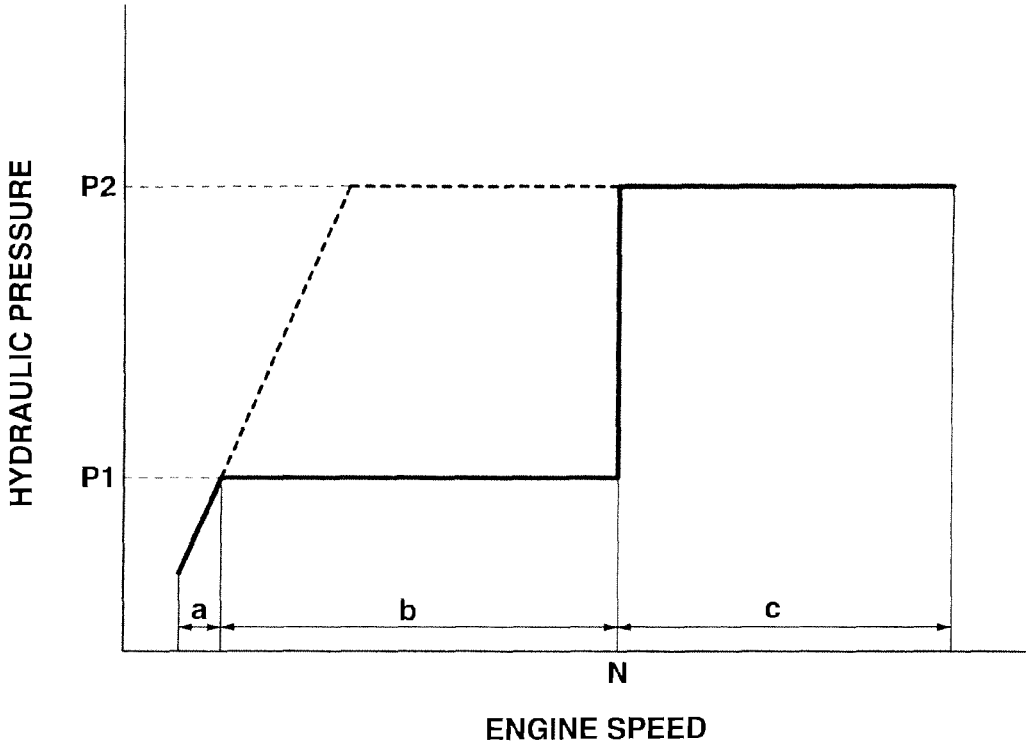
FIG. 6 is a characteristic diagram illustrating the relationship between discharge pressure of the variable displacement oil pump and engine speed in the embodiments.

When the engine speed reaches the predetermined reference engine speed "N" shown in FIG. 6, the necessity of oil-jet injection for cooling reciprocating pistons occurs. Also, with wide open throttle (WOT) or during maximum engine torque output, the necessity of supply of hydraulic pressure of a high-pressure level P2 to crank journal bearings of the engine crankshaft occurs.

By the way, when the engine is running at low speeds less than or equal to the predetermined reference engine speed "N" but the engine load is high, in other words, during high load operation, also, the necessity of oil-jet injection occurs. Therefore, even during the mid-speed but high-load operation as indicated by the broken line in FIG. 6, as well as in the high-speed range "c" as indicated by the solid line in FIG. 6, the hydraulic pressure (the pump discharge pressure) has to be risen to the given hydraulic pressure level P2. In this case, the control unit generates a command (an OFF signal) for de-energizing the electromagnetic coil of solenoid 45 of directional control valve 8.

That is, as clearly shown in FIG. 5, the electromagnetic coil of solenoid 45 of directional control valve 8 is de-energized, a push on the ball valve 44 toward the solenoid control port 43 by extension of pushrod 49 is removed. Hence, the ball valve 44 moves in the opposite axial direction (i.e., downward) by hydraulic pressure in the solenoid control port 43 to block or prevent working-fluid flow through the cylindrical passage 50. Thus, fluid-communication between the supply-and-exhaust port 46 and the drain port 47 through the cylindrical passage 50 is blocked and simultaneously fluid-communication between the solenoid control port 43 and the supply-and-exhaust port 46 is established. Therefore, hydraulic pressure in the main oil gallery 25 (the branch passage 29) is delivered into the pressure-receiving chamber 38, since the supply-and-exhaust port 46 always communicates with the second communication passage 39 of pilot valve 7.

The same hydraulic pressure in the branch passage 29 is delivered into both the pressure-receiving chamber 38 and the oil introduction port 29*a*. However, the pressure-receiving area of the pressure-receiving surface 33*b* of large-diameter spring-support slider 33 is dimensioned to be greater than that of the top face (serving as a pressure-receiving section) of the first land 32*a*, and hence three component parts, namely, spool 32, valve spring 34, and large-diameter spring-support slider 33 upwardly move together toward the oil introduction port 29*a*. At this time, a maximum upward displacement of large-diameter spring-support slider 33 is restricted by abutment of the upper face of large-diameter spring-support slider 33 with the shouldered portion 30*c* formed between small-diameter bore 30*a* and large-diameter bore 30*b* (see FIG. 5).

In accordance with the upward movement of spool 32, as a matter of course, the first land 32*a* moves upward and reaches the uppermost axial position shown in FIG. 1. Thus, the first communication passage 35 becomes communicated with the drain passage 37 through the radial through hole 32*f* of small-diameter shaft 32*c*. As a result of this, a fall in hydraulic pressure in the control oil chamber 16 occurs. Hence, by the spring force of coil spring 28, cam ring 5 returns in the direction that the eccentricity of the geometric center of can ring 5 to the axis of rotation of rotor 4 increases. Therefore, the pump discharge flow rate increases and thus the hydraulic pressure discharged from the pump rises up to given hydraulic pressure level P2 shown in FIG. 6. Owing to the increased pump discharge flow rate, hydraulic pressure in the main oil gallery 25 (the branch passage 29) also increases. Thus, spool 32 moves downward as shown in FIG. 5 against the spring force of valve spring 34.

Figure 4:
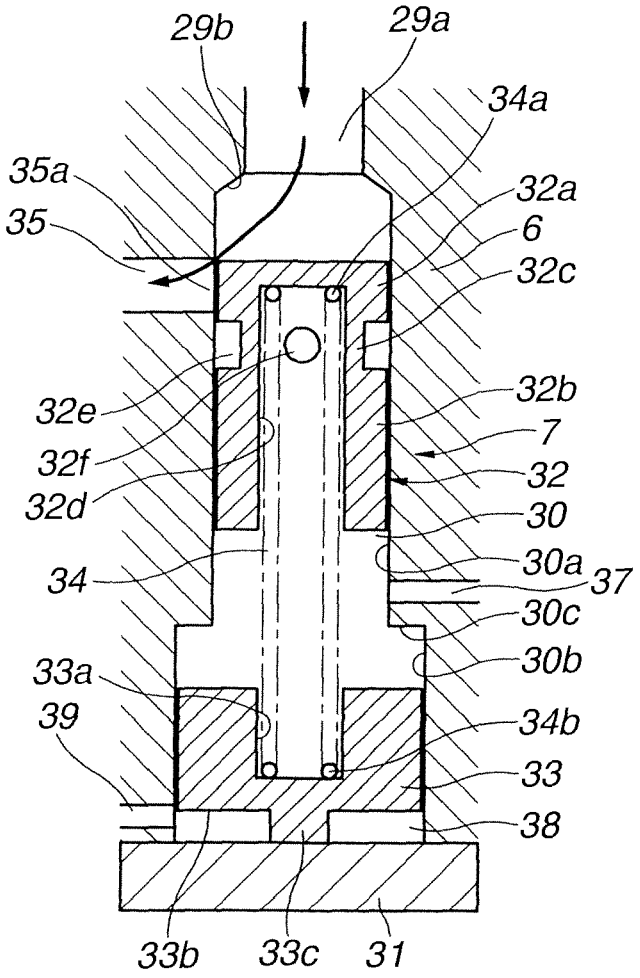
FIG. 4 is an explanatory view illustrating the operation of a pilot valve of the variable displacement oil pump system of the first embodiment during a steady-state engine operating mode.

In this manner, as soon as the pump discharge pressure reaches the given hydraulic pressure level P2, as discussed above, the first land 32*a* reaches the further downward position shown in FIG. 4. Hence, the oil introduction port 29*a* becomes communicated with the first communication passage 35 by way of a small aperture (also serving as a flow-constriction orifice) defined with the first land 32*a* of pilot valve 7 further downwardly displaced. As a result, the reduced hydraulic pressure is introduced through the first communication passage 35 to the control oil chamber 16.

The hydraulic pressure in the control oil chamber 16 is controlled by the pilot valve 7 such that the pump discharge pressure can be held at the given constant pressure level P2. The control method and operation for holding the pump discharge pressure at the given constant pressure level P2 are the same as those described previously for holding the pump discharge pressure at the given constant pressure level P1.

As discussed above, in the first embodiment, by energization/de-energization control (ON/OFF control) for the electromagnetic coil of solenoid 45 of directional control valve 8, the discharge pressure from the pump to the main oil gallery 25 can be controlled or switched between two kinds of hydraulic pressure levels, namely, low hydraulic pressure level P1 and high hydraulic pressure level P2.

Additionally, the controlled discharge pressure can be stably held at a given constant pressure level by virtue of an appropriate change in the flow passage area of the small aperture, defined by the first land 32*a* to communicate the oil introduction port 29*a* with the first communication passage 35, regardless of engine operating conditions, such as a change in engine speed, a change in engine oil temperature and the like.

The relationship (containing a relative pressure difference) between the two different pump discharge pressures (that is, settings of two kinds of hydraulic pressure levels P1 and P2) can be determined by a quantity of expansion and contraction of valve spring 34 and a spring constant of valve spring 34. The settings of two kinds of pump discharge pressures have to be varied depending on the type of internal combustion engine. In the shown embodiment, desired settings of two kinds of pump discharge pressures can be easily achieved by only a setting change (e.g., a spring-constant change) of valve spring 34, without any structure change or any design change in other component parts (e.g., the cam ring and/or the pump housing). Therefore, it is unnecessary to redesign or newly manufacture a basic structure of the pump body from a beginning, thus greatly reducing manufacturing costs. Also, even when the desired settings of two kinds of pump discharge pressures cannot be supported by only a setting change (e.g., only a spring-constant change) of valve spring 34, it is possible to satisfactorily support the desired settings by slightly modifying or changing the axial length of stopper protrusion 33*c* of large-diameter spring-support slider 33, the formation position of shouldered portion 30*c* between small-diameter bore 30*a* and large-diameter bore 30*b*, and/or the formation position of the stepped portion of tapered bearing surface 29*b* between oil introduction port 29*a* and small-diameter bore 30*a*.

When hydraulic pressure in the pressure-receiving chamber 38 becomes high, large-diameter spring-support slider 33 is brought into abutted-engagement (into wall-contact) with the shouldered portion 30*c* to ensure a good seal between pressure-receiving chamber 38 and small-diameter bore 30*a*. Therefore, it is unnecessary to strictly manage or control the accuracy or the quality concerning the clearance space between the inner peripheral wall surface of large-diameter bore 30*b* and the outer peripheral wall surface of large-diameter spring-support slider 33.

Additionally, spool 32 and large-diameter spring-support slider 33 are two separate component parts. Thus, it is unnecessary to strictly manage or control the accuracy or the quality concerning the concentricity of small-diameter bore 30*a* and large-diameter bore 30*b*. From the viewpoints discussed above, manufacturing or machining work becomes easy.

In the shown embodiment, the control unit is configured to perform ON/OFF control for the electromagnetic coil of solenoid 45 of directional control valve 8 based on the engine operating condition (in particular, latest up-to-date information about engine speed and/or engine load). Actually, the variable displacement oil pump system of the embodiment is configured to rise the pump discharge pressure up to the high-pressure level P2 with the electromagnetic coil de-energized (kept in its OFF state), fully taking into account a fail-safe in the presence of a pump discharge pressure control system failure, for example undesirable breaking of the electromagnetic coil (see the engine-speed versus hydraulic-pressure characteristic indicated by the horizontal solid line "c" in FIG. 6).

Furthermore, in the shown embodiment, first and second oil filters 51-52 are disposed near the branch point of the upstream side of main oil gallery 25 and branch passage 29. Thus, it is possible to adequately prevent contaminants and/or metal debris from entering the pilot valve 7 and/or the directional control valve 8 by virtue of double filtering-out action by means of these oil filters. Hence, there is a less risk of undesirably poor operation (e.g., a sticking valve) of the pilot valve 7 and/or the directional control valve 8, which may occur owing to contaminants and/or metal debris.

Assume that undesirable clogging of at least one of first and second oil filters 51-52 occurs. In such a case, due to the clogged oil filter, hydraulic pressure cannot be introduced to the control oil chamber 16, and thus cam ring 5 can be maintained at its initial setting position (i.e., the maximum-eccentricity angular position) shown in FIG. 1. Although it is not clearly shown in the drawings, a relief valve (not shown) begins to operate, when the pump discharge pressure becomes excessively high owing to the maximum-eccentricity angular position. As a result, an excessive rise in pump discharge pressure can be suppressed. As discussed above, even in the presence of a pump discharge pressure control hydraulic circuit failure, concretely undesirable clogging of the hydraulic circuit, a high pump discharge pressure can be ensured. Hence, even during high-speed and high-load operation, it is possible to adequately suppress the engine from being damaged owing to an insufficient hydraulic pressure.

[Second Embodiment]

Figure 7:
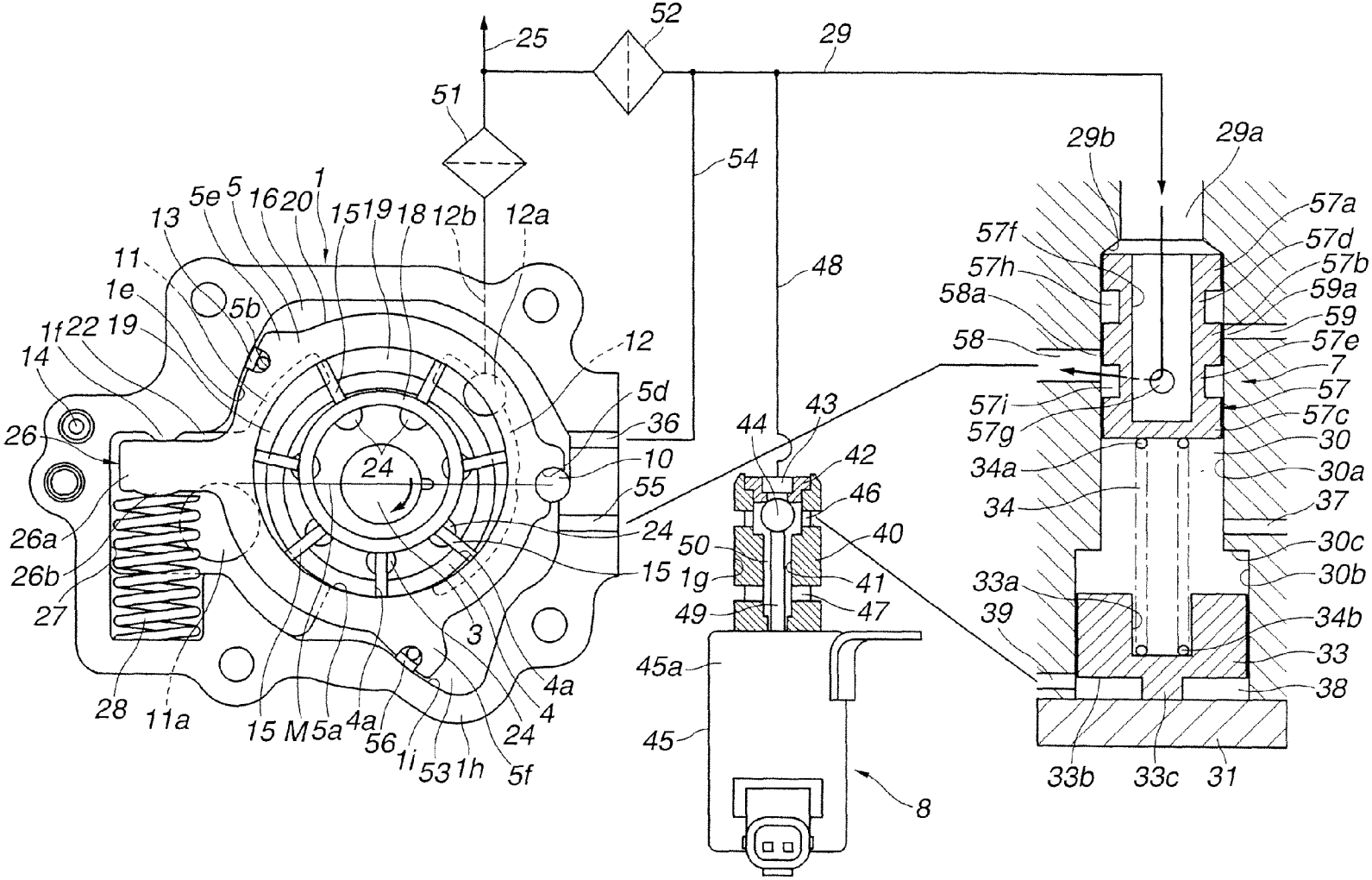
FIG. 7 is a schematic diagram illustrating a variable displacement oil pump system of the second embodiment.

Referring now to FIG. 7, there is shown the variable displacement oil pump system of the second embodiment. The fundamental configuration of the second embodiment is similar to that of the first embodiment. Thus, the same reference signs used to designate components (elements) in the pump system shown in FIGS. 1-5 will be applied to the corresponding reference signs used in the pump system shown in FIGS. 7-9, for the purpose of comparison of the two different pump systems. Detailed description of the same components (elements) will be omitted because the above description thereon seems to be self-explanatory.

Briefly speaking, in the second embodiment, a second control oil chamber 53 is further formed at the lower part of the outer periphery of cam ring 5 than the pivot pin 10, serving as a fulcrum of oscillating motion of cam ring 5. Additionally, the structure of spool 57 of pilot valve 7 of the second embodiment is changed from the structure of spool 32 of the first embodiment.

More concretely, the first control oil chamber 16 is defined between the inner periphery of pump housing 1 and the upper part of the outer periphery of cam ring 5 than the cam-ring reference line "M", whereas the second control oil chamber 53 is defined between the inner periphery of pump housing 1 and the lower part of the outer periphery of cam ring 5 than the cam-ring reference line "M". In FIG. 7, the lowermost end of the first control oil chamber 16 and the uppermost end of the second control oil chamber 53 are arranged near the pivot pin 10, in a manner so as to sandwich the cam-ring reference line "M" between first and second control oil chambers 16 and 53.

Regarding the first control oil chamber 16, hydraulic pressure in the branch passage 29 is always directly introduced from an introduction passage 54, branched from the branch passage 29, through the first communication bore 36 to the first control oil chamber 16. That is, the first control oil chamber 16 serves as an ordinarily-pressure-applied chamber. The hydraulic pressure, introduced to the first control oil chamber 16, creates a force that rotates or biases the cam ring 5 against the spring force of coil spring 28 in the counterclockwise direction that the eccentricity of the geometric center of cam ring 5 to the axis of rotation of rotor 4 decreases.

Regarding the second control oil chamber 53, hydraulic pressure in the branch passage 29 is introduced from the pilot valve 7 through a second communication bore 55, formed parallel to the first communication bore 36, to the second control oil passage 53. The hydraulic pressure, introduced to the second control oil chamber 53, creates a force that gives assistance to the spring force of coil spring 28 and rotates or biases the cam ring 5 in the clockwise direction that the eccentricity of the geometric center of cam ring 5 to the axis of rotation of rotor 4 increases.

Assume that the same hydraulic pressure is supplied to both the first control oil chamber 16 and the second control oil chamber 53. In such a case, the force created by the same hydraulic pressure supplied to the first control oil chamber 16 and acting to rotate the cam ring 5 in the counterclockwise direction and the force created by the same hydraulic pressure supplied to the second control oil chamber 53 and acting to rotate the cam ring 5 in the clockwise direction tends to cancel out each other. Hence, in the case of the same hydraulic pressure supply to first and second control oil chambers 16 and 53, there is a less hydraulic pressure that produces a counterclockwise displacement of cam ring 5 against the spring force of coil spring 28. That is, first and second control oil chambers 16 and 53 (i.e., the ratio between the pressure-receiving area of a portion of the outer peripheral surface of cam ring 5, associated with the first control oil chamber 16 and the pressure-receiving area of a portion of the outer peripheral surface of cam ring 5, associated with the second control oil chamber 53) are designed such that cam ring 5 cannot be rotated or displaced against the spring force of coil spring 28 in the direction that the eccentricity of the geometric center of cam ring 5 to the axis of rotation of rotor 4 decreases, in the case of the same hydraulic pressure supply to first and second control oil chambers 16 and 53.

Figure 9:
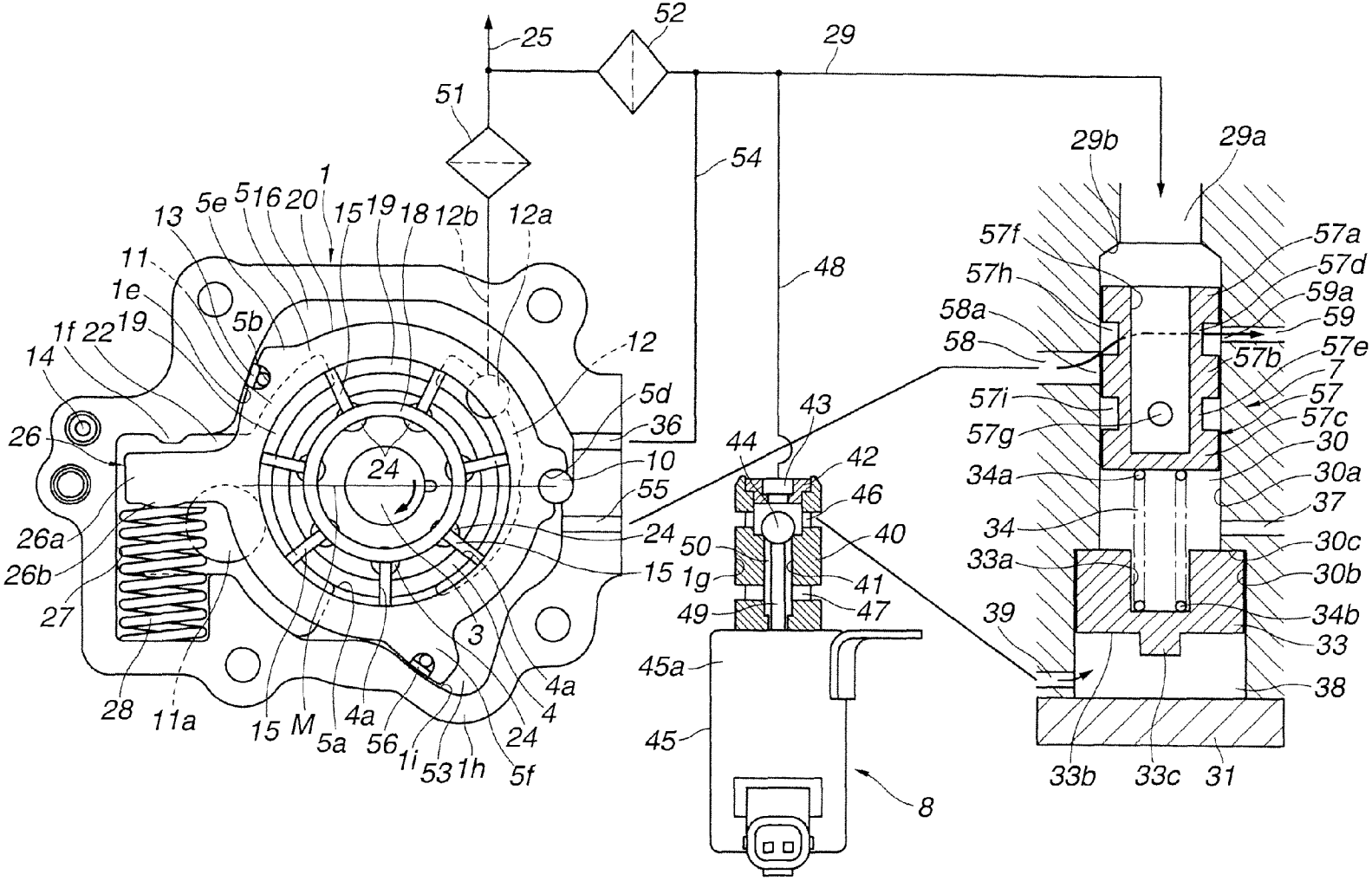
FIG. 9 is an explanatory view illustrating the operation of the variable displacement oil pump system of the second embodiment during high-load operation.

When a decrease in the force that gives assistance to the spring force of coil spring 28 occurs owing to a fall in hydraulic pressure in the second control oil chamber 53, as shown in FIG. 9 cam ring 5 can be rotated or displaced against the spring force of coil spring 28 in the counterclockwise direction that the eccentricity of the geometric center of cam ring 5 to the axis of rotation of rotor 4 decreases. Additionally, for safety (for a fail-safe function), (i) the spring load W of coil spring 28 applied to the arm 26 and (ii) the ratio between the pressure-receiving area of a portion of the outer peripheral surface of cam ring 5, associated with the first control oil chamber 16 and the pressure-receiving area of a portion of the outer peripheral surface of cam ring 5, associated with the second control oil chamber 53 are set such that a rotary motion or a counterclockwise displacement of cam ring 5 against the spring force of col spring 28 can occur by the application of hydraulic pressure of approximately 1 MPa to both of the first control oil chamber 16 and the second control oil chamber 53.

In order to form first and second control oil chambers 16 and 53, in addition to the first sealing surface 1*e*, a circular-arc shaped second sealing surface 1*i* is further configured or formed on the inner peripheral surface of an expanding portion 1*h* integrally formed to expand a part of the pump housing 1. The second sealing surface 1*i* is configured to be almost point-symmetrical to the first sealing surface 1*e* with respect to the rotation axis of drive shaft 3. In addition to the first protruding portion 5*e*, cam ring has a second protruding portion 5*f* at a given angular position substantially corresponding to the expanding portion 1*h* of pump housing 1. In a similar manner to the first seal-retention groove 5*b* formed in the first protruding portion 5*e* for retaining the first seal member 13, a seal-retention groove is formed in the outer peripheral surface of the second protruding portion 5*f* for retaining a second seal member 56 so as to permit permanent sliding-contact between the second seal member 56 and the second sealing surface 1*i*.

Other component parts are the same as the pump structural unit of the variable displacement oil pump system of the first embodiment, and also these operations are the same.

In a similar manner to the first embodiment, in the second embodiment, pilot valve 7 is formed with three cylindrical bores (that is, oil introduction port 29*a*, small-diameter bore 30*a*, and large-diameter bore 30*b*) having respective inside diameters differing from each other. A spool 57 of pilot valve 7, involved in the variable displacement oil pump system of the second embodiment has axially-spaced three lands (that is, first, second, and third lands 57*a*, 57*b*, and 57*c*), and a first small-diameter shaft 57*d* between first and second lands 57*a*-57*b*, and a second small-diameter shaft 57*e* between second and third lands 57*b*-57*c*. A first annular groove 57*h* between first and second lands 57*a*-57*b* is defined on the outer periphery of first small-diameter shaft 57*d*, whereas a second annular groove 57*i* between second and third lands 57*b*-57*c* is defined on the outer periphery of second small-diameter shaft 57*e*.

Spool 57 has a cylindrical bore 57*f* closed at its lower end and extending along the axis of spool 57. Cylindrical bore 57*f* always communicates with the oil introduction port 29*a*. The second small-diameter shaft 57*e* has a radial through hole 57*g* for communicating the second annular groove 57*i* with the cylindrical bore 57*f* by way of the radial through hole 57*g*.

One opening end 58*a* of a third communication passage 58 is configured to open into the axially intermediate portion of small-diameter bore 30*a* of stepped cylindrical close-fitting bore 30. The other end of the third communication passage 58 communicates with the second control oil chamber 53 through a second communication bore 55 formed in the right-hand end wall of pump housing 1. One opening end 59*a* of a drain passage 59, which passage communicates with the oil pan, is configured to open into the upper portion of small-diameter bore 30*a* than the opening end 58*a* of the third communication passage 58.

The opening end 58*a* of the third communication passage 58 and the opening end 59*a* of the drain passage 59 are opened or closed relatively depending on the axial position of the sliding spool 57 (in particular, the axial position of the second land 57*b*), so as to establish or block fluid-communication between the oil introduction port 29*a* and the third communication passage 58 or fluid-communication between the third communication passage 58 and the drain passage 59.

The other configuration of pilot valve 7 of the second embodiment is the same as the first embodiment. That is, valve spring 34 is disposed between the spool 57 and the large-diameter spring-support slider 33 under preload such that the spool 57 and the large-diameter spring-support slider 33 are biased to be spaced from each other in the opposite directions (see FIG. 7).

As clearly shown in FIG. 7, spool 57 is upwardly forced or biased by the spring force of valve spring 34 and thus the annular top of the first land 57*a* of spool 57 is seated on the tapered bearing surface 29*b* formed between oil introduction port 29*a* and small-diameter bore 30*a*. On the other hand, regarding large-diameter spring-support slider 33, its stopper protrusion 33*c* is brought into abutted-engagement with the inside face of lid member 31 by the spring force of valve spring 34, to define the large-diameter pressure-receiving chamber 38 between the underside (large-diameter pressure-receiving surface 33*b*) of large-diameter spring-support slider 33 and the inside face of lid member 31, which lid member is provided for hermetically closing the lowermost end of large-diameter bore 30*b*. At this time, valve spring 34 is disposed between the spool 57 and the large-diameter spring-support slider 33 under preload (i.e., under a specified set spring load).

The valve configuration of electromagnetic solenoid operated directional control valve 8 incorporated in the pump system of the second embodiment is identical to that of the first embodiment. The supply-and-exhaust port 46 of directional control valve 8 is configured to always communicate with the pressure-receiving chamber 38 of pilot valve 7 via the second communication passage 39.

[Operation of Second Embodiment]

The operation of the variable displacement oil pump system of the second embodiment is hereunder described in detail in reference to the engine-speed versus hydraulic-pressure characteristic diagram of FIG. 6.

Referring now to FIG. 7, there is shown the initial working state of the pump system of the second embodiment during operation of the engine at low speeds, in other words, during the initial pump startup state where the pump discharge pressure is still low. At this time, the electromagnetic coil of directional control valve 8 becomes energized responsively to an ON signal from the control unit, and thus the pushrod 49 extends to push the ball valve 44 upward. As a result, the opening end of solenoid control port 43 is closed by the ball valve 44 and hence fluid-communication between the solenoid control port 43 and the supply-and-exhaust port 46 is blocked and fluid-communication between the supply-and-exhaust port 46 and the drain port 47 is established. Supply-and-exhaust port 46 is configured to always communicate with the second communication passage 39 of pilot valve 7. Therefore, pressure-receiving chamber 38 of pilot valve 7 becomes communicated with the oil pan through the second communication passage 39, the supply-and-exhaust port 46, the cylindrical passage 50, and the drain port 47. There is no hydraulic pressure acting on the pressure-receiving surface 33*b* of large-diameter spring-support slider 33. That is, the pressure-receiving chamber 38 becomes a low-pressure state. Stopper protrusion 33*c* of large-diameter spring-support slider 33 is kept in abutted-engagement with the inside face of lid member 31 by the spring force of valve spring 34.

On the other hand, the annular top of the first land 57*a* of spool 57 is abutted or seated on the tapered bearing surface 29*b* by the spring force of valve spring 34. With the spool 57 positioned at the uppermost axial position, the second annular groove 57*i* of second small-diameter shaft 57*e* becomes communicated with the third communication passage 58, and thus fluid-communication between the third communication passage 58 and the oil introduction port 29*a* through the radial through hole 57*g* of second small-diameter shaft 57*e* is established.

The third communication passage 58 is configured to always communicate with the second communication bore 55. Therefore, the second control oil chamber 53 is communicated with the oil introduction port 29*a*, and thus kept in a state that hydraulic pressure in the main oil gallery 25 is delivered into the second control oil chamber 53.

On the other hand, the first control oil chamber 16 is configured to always communicate with the main oil gallery through the first communication bore 36, the introduction passage 54, and the branch passage 29. Thus, hydraulic pressure of the same pressure level is supplied from the main oil gallery 25 to both the first control oil chamber 16 and the second control oil chamber 53. Any counterclockwise displacement of cam ring 5 against the spring force of coil spring 28 does not occur, and hence cam ring 5 is kept at its initial setting position (i.e., the maximum-eccentricity angular position) shown in FIG. 7. Under these conditions, the pump discharge pressure as well as the pump discharge flow rate increases proportionally, as the engine speed increases (see the engine-speed versus hydraulic-pressure characteristic in a low-speed range "a" shown in FIG. 6).

When the risen hydraulic pressure is introduced from the main oil gallery 25 through the branch passage 29 into the oil introduction port 29*a* of pilot valve 7, spool 57 begins to move downward against the spring force of valve spring 34. When the pump discharge pressure reaches the hydraulic pressure P1, spool 57 shifts to a slightly downward-displaced axial position (see the axial position of spool 57 shown in FIG. 8). With the spool 57 slightly displaced downward from the uppermost spring-offset axial position, fluid-communication between the third communication passage 58 and the oil introduction port 29*a* through the radial through hole 57*g* of second small-diameter shaft 57*e* becomes blocked by the inner peripheral wall surface of small-diameter bore 30*a*. In contrast, fluid-communication between the third communication passage 58 and the drain passage 59 through the first annular groove 57*h* becomes established. As a result, hydraulic pressure in the second control oil chamber 53 is drained through the third communication passage 58 and the drain passage 59 into the oil pan and thus the second control oil chamber 53 becomes a low-pressure state.

The given spring load (the set spring force) of coil spring 28 (with cam ring 5 kept at its initial setting position) is set to a spring force that cam ring 5 is prevented from being displaced counterclockwise from the initial setting position with hydraulic pressure of the given hydraulic pressure level P1 supplied to the second control oil chamber 53 without any pressure reduction. However, as the hydraulic pressure in the second control oil chamber 53 reduces, cam ring 5 begins to rotate counterclockwise against the spring force of coil spring 28 such that the pump discharge flow rate can be adjusted.

When hydraulic pressure in the second control oil chamber 53 is excessively low, a counterclockwise displacement of cam ring 5 tends to become large, and thus the pump discharge flow rate decreases. As a result, a fall in hydraulic pressure in the main oil gallery 25 (the branch passage 29) occurs, and thus spool 57 can be slightly displaced upward by the spring force of valve spring 34. Hence, the flow passage area of the small aperture, defined by the second land 57*b* to communicate the first annular groove 57*h* with the opening end 58*a* of the third communication passage 58, becomes smaller and whereby the amount of working fluid directed from the small aperture through the first annular groove 57*h* to the drain passage 59 decreases. As a result, hydraulic pressure in the second control oil chamber 53 rises.

Conversely when hydraulic pressure in the second control oil chamber 53 is excessively high, a counterclockwise displacement of cam ring 5 tends to become small, and thus the pump discharge flow rate increases. As a result, a rise in hydraulic pressure, supplied to the main oil gallery 25 (the branch passage 29), occurs, and thus a downward movement of spool 57 against the spring force of valve spring 34 occurs. Hence, the flow passage area of the small aperture, defined by the second land 57*b* to communicate the first annular groove 57*h* with the opening end 58*a* of the third communication passage 58, becomes larger and whereby the amount of working fluid directed from the small aperture through the first annular groove 57*h* to the drain passage 59 increases. As a result, hydraulic pressure in the second control oil chamber 53 falls.

In this manner, immediately when the pump discharge pressure reaches the given hydraulic pressure P1, fluid-communication between the oil introduction port 29*a* and the second control oil chamber 53 through the third communication passage 58 becomes blocked and fluid-communication between the drain passage 59 and the third communication passage 58 becomes established, and thereafter the hydraulic pressure in the second control oil chamber 53 can be appropriately controlled or regulated by virtue of an appropriate change in the flow passage area of the small aperture, defined by the second land 57*b* to communicate the first annular groove 57*h* with the opening end 58*a* of the third communication passage 58.

Additionally, the hydraulic pressure in the second control oil chamber 53 can be appropriately controlled or regulated by a comparatively small axial movement of spool 57 (in particular, the second land 57*b*) without being almost affected by a spring constant of valve spring 34.

That is to say, even when a slight fluctuation in hydraulic pressure (pump discharge pressure) occurs, it is possible to satisfactorily change the flow passage area of the small aperture defined by the second land 57*b*. Thus, even when the engine speed increases, there is a less rise in hydraulic pressure. Hence, in the second embodiment as well as the first embodiment, as can be seen from the engine-speed versus hydraulic-pressure characteristic indicated by the horizontal solid line "b" in FIG. 6, the hydraulic pressure (the pump discharge pressure) can be controlled or regulated to the given constant pressure level P1.

Also, in the same manner as the first embodiment, when the hydraulic pressure (the pump discharge pressure) has to be risen to the given hydraulic pressure level P2, the electromagnetic coil of solenoid 45 of directional control valve 8 becomes de-energized responsively to an OFF signal from the control unit, thereby permitting the pushrod 49 to retract so as to establish fluid-communication between the solenoid control port 43 and the supply-and-exhaust port 46 and simultaneously to block fluid-communication between the supply-and-exhaust port 46 and the drain port 47 through the cylindrical passage 50. Hence, hydraulic pressure in the main oil gallery 25 (the branch passage 29) is delivered into the pressure-receiving chamber 38.

Hydraulic pressure of the same pressure level is delivered from the main oil gallery 25 (the branch passage 29) into both the pressure-receiving chamber 38 and the oil introduction port 29*a*. However, the pressure-receiving area of the pressure-receiving surface 33*b* of large-diameter spring-support slider 33 is dimensioned to be greater than that of the upper face (serving as a pressure-receiving section) of spool 57, and hence three component parts, namely, spool 57, valve spring 34, and large-diameter spring-support slider 33 upwardly move together toward the oil introduction port 29*a*. At this time, a maximum upward displacement of large-diameter spring-support slider 33 is restricted by abutment of the upper face of large-diameter spring-support slider 33 with the shouldered portion 30*c* between small-diameter bore 30*a* and large-diameter bore 30*b* (see FIG. 9).

In accordance with the upward movement of spool 57, as a matter of course, the second land 57*b* moves upward, and then the spool 57 reaches the uppermost axial position shown in FIG. 7. Thus, the third communication passage 58 becomes communicated with the oil introduction port 29*a* through the radial through hole 57*g* of the second small-diameter shaft 57*e*. As a result of this, a rise in hydraulic pressure in the second control oil chamber 53 occurs. Hence, owing to the risen hydraulic pressure in the second control oil chamber 53 as well as the spring force of coil spring 28, cam ring 5 returns in the direction that the eccentricity of the geometric center of cam ring 5 to the axis of rotation of rotor 4 increases. Therefore, the pump discharge flow rate increases and thus the hydraulic pressure discharged from the pump to the main oil gallery 25 also increases. Thus, spool 57 moves downward against the spring force of valve spring 34.

In this manner, as soon as the pump discharge pressure reaches the given hydraulic pressure level P2, the second land 57*b* reaches the axial position, corresponding to the opening end 58*a* of the third communication passage 58, as shown in FIG. 9. The first annular groove 57*h* becomes communicated with the third communication passage 58 by way of the small aperture, defined by the second land 57*b* to communicate the first annular groove 57*h* with the opening end 58*a* of the third communication passage 58. Hence, fluid-communication between the drain passage 59 and the second control oil chamber 53 becomes established. As a result, hydraulic pressure in the second control oil chamber 53 falls.

The hydraulic pressure in the second control oil chamber 53 is controlled by the pilot valve 7 such that the pump discharge pressure can be held at the given constant pressure level P2. The control method and operation for holding the pump discharge pressure at the given constant pressure level P2 are the same as those described previously for holding the pump discharge pressure at the given constant pressure level P1.

As discussed above, the engine-speed versus hydraulic-pressure characteristic and effects, achieved by the variable displacement oil pump system of the second embodiment, are the same as the first embodiment. Additionally, the second embodiment can provide the following further operation and effect. That is, even in the presence of a variable displacement oil pump system failure, more concretely, even in an abnormal situation where a mechanical problem, such as a locked pilot valve 7 and/or a locked directional control valve 8 (concretely, a sticking ball valve of the pilot valve 7 and/or a sticking spool of the directional control valve 8) occurs owing to contaminants, impurities and the like and thus hydraulic pressure supply from the main oil gallery 25 to both the first control oil chamber 16 and the second control oil chamber 53 is maintained, immediately when the supplied hydraulic pressure becomes a fail-safe pressure level (approximately 1 MPa), the pump system shifts to a fail-safe operating mode at which cam ring 5 begins to rotate in the counterclockwise direction that the eccentricity of the geometric center of cam ring 5 to the axis of rotation of rotor 4 decreases.

[Third Embodiment]

Figure 10:
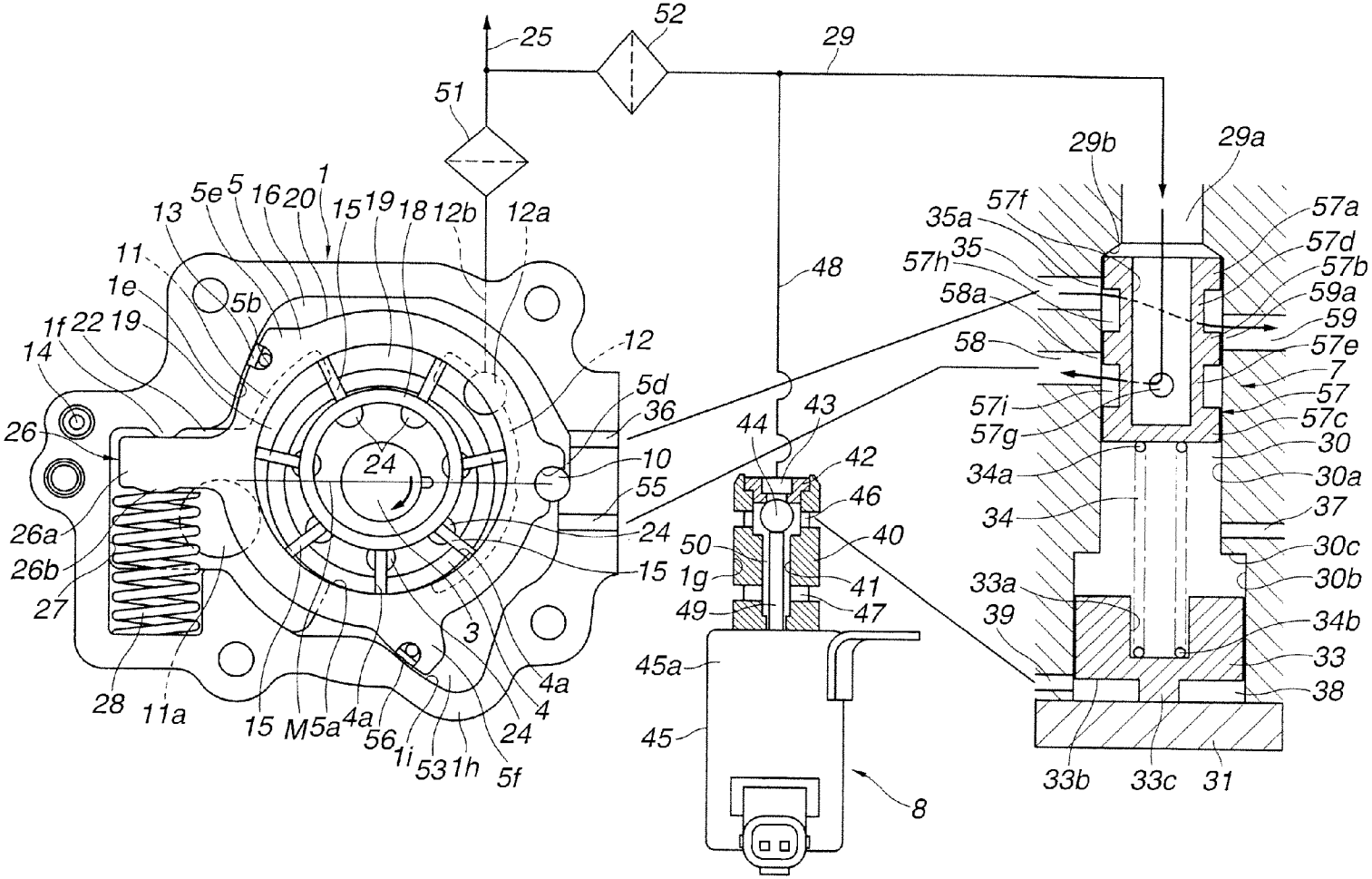
FIG. 10 is a schematic diagram illustrating a variable displacement oil pump system of the third embodiment.

Referring now to FIG. 10, there is shown the variable displacement oil pump system of the third embodiment. The fundamental configuration of the third embodiment, such as the pump structural unit of the variable displacement oil pump, is similar to that of the second embodiment. However, the third embodiment somewhat differs from the second embodiment in that, in the third embodiment, the working-fluid flow passage for the first control oil chamber 16 is configured such that hydraulic pressure can be supplied or exhausted to or from the first control oil chamber 16 by way of the pilot valve 7. Additionally, in the third embodiment, the given spring load W, produced by coil spring 28 with cam ring 5 kept at its initial setting position (i.e., the maximum-eccentricity angular position) shown in FIG. 10, is set to a spring force that the eccentricity of the geometric center of cam ring 5 to the axis of rotation of drive shaft 3 can be held at its maximum value when the engine is put in a stop state where the pump drive shaft 3 has stopped rotating.

Figure 11:
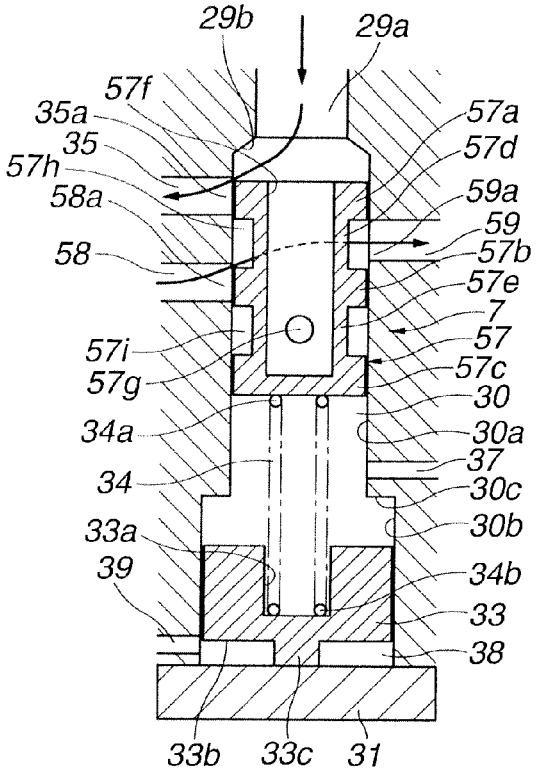
FIG. 11 is an explanatory view illustrating the operation of a pilot valve of the variable displacement oil pump system of the third embodiment during a steady-state engine operating mode.
Figure 12:
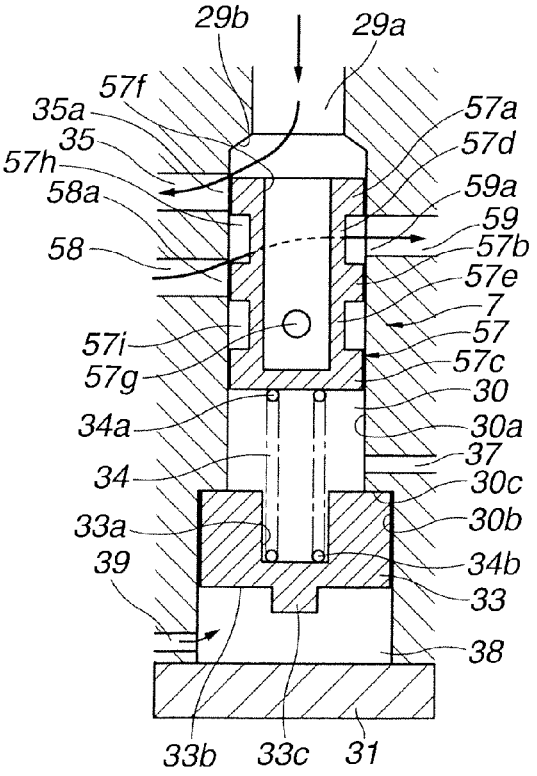
FIG. 12 is an explanatory view illustrating the operation of the pilot valve of the third embodiment during high-load operation.

In a similar manner to the first embodiment shown in FIGS. 1-5, in the pump system configuration of the third embodiment shown in FIGS. 10-12, one opening end 35*a* of the first communication passage 35 is formed near the oil introduction port 29*a* and configured to open into the upper portion of small-diameter bore 30*a* than the opening end 58*a* of the third communication passage 58. The other end of the first communication passage 35 is configured to communicate with the first control oil chamber 16 through the first communication bore 36 formed in the right-hand end wall of pump housing 1.

Figure 8:
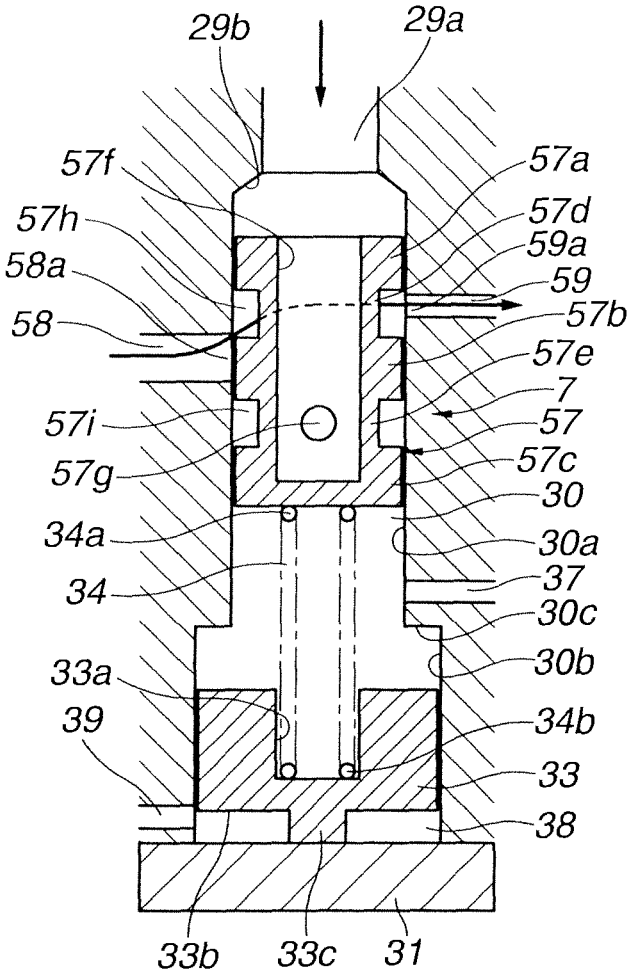
FIG. 8 is an explanatory view illustrating the operation of a pilot valve of the variable displacement oil pump system of the second embodiment during a steady-state engine operating mode.

In a similar manner to the second embodiment shown in FIGS. 7-9, in the pump system configuration of the third embodiment shown in FIGS. 10-12, spool 57 of pilot valve 7 has axially-spaced three lands (that is, first, second, and third lands 57*a*, 57*b*, and 57*c*), and the first small-diameter shaft 57*d* (i.e., the first annular groove 57*h*) between first and second lands 57*a*-57*b*, and the second small-diameter shaft 57*e* (i.e., the second annular groove 57*i*) between second and third lands 57*b*-57*c*.

The width (i.e., the axial length) of the first annular groove 57*h* is dimensioned to be approximately equal to the inside diameter (i.e., the opening width) of the opening end 35*a* of the first communication passage 35. The width (i.e., the axial length) of the second annular groove 57*i* is dimensioned to be approximately equal to the inside diameter (i.e., the opening width) of the opening end 58*a* of the third communication passage 58. The inside diameter (i.e., the opening width) of the opening end 59*a* of the drain passage 59 is dimensioned to be approximately equal to the width (i.e., the axial length) of the first annular groove 57*h*. Also, the second small-diameter shaft 57*e* has the radial through hole 57*g* for communicating the second annular groove 57*i* with the cylindrical bore 57*f* by way of the radial through hole 57*g*. Depending on the axial position of spool 57 (in particular, the second annular groove 57*i*), the radial through hole 57*g* can be appropriately communicated with the third communication passage 58.

The valve configuration of electromagnetic solenoid operated directional control valve 8 incorporated in the pump system of the third embodiment is identical to that of the second embodiment.

Oil, discharged from the pump discharge passage 12*b*, passes through the oil filter 51 or an oil cooler (not shown). The discharged oil flow enters the main oil gallery 25. Then, the oil flow is directed or supplied through the main oil gallery 25 to moving or sliding engine parts and hydraulically-operated devices (i.e., a VTC device).

As clearly shown in FIG. 10, solenoid control port 43 of directional control valve 8 and oil introduction port 29*a* of pilot valve 7 are both connected to the main oil gallery 25 (the branch passage 29). In lieu thereof, these ports 43 and 29*a* may be connected to the discharge port 12 or the discharge passage 12*b*.

Supply-and-exhaust port 46 of directional control valve 8 is connected to the second communication passage 39 of pilot valve 7.

The first annular groove 57*h* of spool 57 of pilot valve 7 is configured to open into the drain passage 59. The second annular groove 57*i* is configured to communicate with the cylindrical bore 57*f* through the radial through hole 57*g*, and further communicate with the oil introduction port 29*a*. In the same manner as the previously-described first and second embodiments, also in the third embodiment, first and second drain passages 37 and 59 of pilot valve 7 and drain port 47 of directional control valve 8 are all configured to communicate with the oil pan.

[Operation of Third Embodiment]

The operation of the variable displacement oil pump system of the third embodiment is hereunder described in detail in reference to the engine-speed versus hydraulic-pressure characteristic diagram of FIG. 6.

Referring now to FIG. 10, there is shown the initial working state of the pump system of the third embodiment during operation of the engine at low speeds, in other words, during the initial pump startup state where the pump discharge pressure is still low.

At this time, the electromagnetic coil of directional control valve 8 becomes energized responsively to an ON signal from the control unit, and thus the pushrod 49 extends to push the ball valve 44 upward. As a result, the opening end of solenoid control port 43 is closed by the ball valve 44 and hence fluid-communication between the solenoid control port 43 and the supply-and-exhaust port 46 is blocked and fluid-communication between the supply-and-exhaust port 46 and the drain port 47 is established. Supply-and-exhaust port 46 is configured to always communicate with the second communication passage 39 of pilot valve 7. Therefore, pressure-receiving chamber 38 of pilot valve 7 becomes communicated with the oil pan through the second communication passage 39, the supply-and-exhaust port 46, the cylindrical passage 50, and the drain port 47. There is no hydraulic pressure acting on the pressure-receiving surface 33*b* of large-diameter spring-support slider 33. That is, the pressure-receiving chamber 38 becomes a low-pressure state.

Stopper protrusion 33*c* of large-diameter spring-support slider 33 is kept in abutted-engagement with the inside face of lid member 31 by the spring force of valve spring 34.

On the other hand, the annular top of the first land 57*a* of spool 57 of pilot valve 7 is abutted or seated on the tapered bearing surface 29*b* of small-diameter bore 30*a* by the spring force of valve spring 34. With the spool 57 positioned at the uppermost axial position, fluid-communication between the first communication passage 35 and the first drain passage 59 becomes established, since the first annular groove 57*h* of the first small-diameter shaft 57*d* becomes communicated with both the first communication passage 35 and the first drain passage 59.

The third communication passage 58 becomes communicated with the oil introduction port 29*a* through the radial through hole 57*g* of second small-diameter shaft 57*e*. The first communication passage 35 is configured to always communicate with the first communication bore 36 of pump housing 1. Fluid-communication between the first control oil chamber 16 and the drain passage 59 becomes established and thus there is no hydraulic pressure supply to the first control oil chamber 16. The third communication passage 58 is configured to always communicate with the second communication bore 55. Fluid-communication between the second control oil chamber 53 and the oil introduction port 29*a* through the second annular groove 57*i* and the radial through hole 57*g* becomes established, and thus hydraulic pressure in the main oil gallery 25 is supplied to the second control oil chamber 53.

As discussed above, hydraulic pressure is supplied from the main oil gallery 25 through the branch passage 29 to only the second control oil chamber 53. Hence, cam ring 5 cannot rotate counterclockwise against the spring force of coil spring 28 and thus cam ring 5 remains kept at its initial setting position (i.e., the maximum-eccentricity angular position) shown in FIG. 10. Under these conditions, the pump discharge pressure as well as the pump discharge flow rate increases proportionally, as the engine speed increases (see the engine-speed versus hydraulic-pressure characteristic in a low-speed range "a" shown in FIG. 6).

When the risen hydraulic pressure is introduced from the main oil gallery 25 through the branch passage 29 into the oil introduction port 29*a* of pilot valve 7, spool 57 begins to move downward against the spring force of valve spring 34.

When the pump discharge pressure reaches the hydraulic pressure P1, spool 57 shifts to a slightly downward-displaced axial position (see the axial position of spool 57 shown in FIG. 11).

The inside diameter (i.e., the opening width) of the opening end 35*a* of the first communication passage 35 and the width (i.e., the axial length) of the first land 57*a* are dimensioned to be approximately equal to each other. At the unique axial position of spool 57 shown in FIG. 11, a unique flow path configuration for the first communication passage 35 can be selectively switched between (i) a flow path from the first communication passage 35 via the first annular groove 57*h* to the drain passage 59 and (ii) a flow path from the oil introduction port 29*a* to the first communication passage 35. Additionally, a unique flow path configuration for the third communication passage 58 can be selectively switched between (i) a flow path from the third communication passage 58 via the first annular groove 57*h* to the drain passage 59 and (ii) a flow path from the oil introduction port 29*a* via the second annular groove 57*i* and the radial through hole 57*g* to the third communication passage 58. Switching of the flow path configuration for the first communication passage 35 between the two different flow paths and switching of the flow path configuration for the third communication passage 58 between the two different flow paths can be carried out substantially at the same time.

As previously discussed, the first control oil chamber 16 always communicates with the first communication passage 35 through the first communication bore 36, whereas the second oil chamber 53 always communicates with the third communication passage 58 through the second communication bore 55. Hence, at the unique axial position of spool 57 shown in FIG. 11, switching of the flow path configuration for the first control oil chamber 16 (i.e., the first communication passage 35) between (i) the flow path from the first control oil chamber 16 via the first annular groove 57*h* to the drain passage 59 and (ii) the flow path from the oil introduction port 29*a* to the first control oil chamber 16, and switching of the flow path configuration for the second control oil chamber 53 (i.e., the third communication passage 58) between (i) the flow path from the oil introduction port 29*a* via the second annular groove 57*i* and the radial through hole 57*g* to the second control oil chamber 53 and (ii) the flow path from the second control oil chamber 53 via the first annular groove 57*h* to the drain passage 59 can be carried out in concurrence with each other. By virtue of the two different flow-path switching actions, which can be carried out in concurrence with each other, a counterclockwise displacement of cam ring 5 against the spring force of coil spring 28 occurs, thereby adjusting the pump discharge flow rate.

When hydraulic pressure in the first control oil chamber 16 is excessively high or hydraulic pressure in the second control oil chamber 53 is excessively low, a counterclockwise displacement of cam ring 5 tends to become large, and thus the pump discharge flow rate decreases. As a result, a fall in hydraulic pressure in the main oil gallery 25 (the branch passage 29) occurs, and thus spool 57 can be slightly displaced upward by the spring force of valve spring 34. Owing to the slight upward movement of the first land 57*a*, the flow passage area of the small aperture, defined by the first land 57*a* to communicate the oil introduction port 29*a* with the opening end 35*a* of the first communication passage 35, becomes smaller. As a result, a fall in hydraulic pressure in the first control oil chamber 16 occurs. At the same time, owing to the slight upward movement of the second land 57*b*, the flow passage area of the small aperture, defined by the second land 57*b* to communicate the first annular groove 57*h* with the opening end 58*a* of the third communication passage 58, becomes smaller and thus the amount of working fluid directed from the small aperture through the first annular groove 57*h* to the drain passage 59 decreases. As a result, a rise in hydraulic pressure in the second control oil chamber 53 occurs.

Conversely when hydraulic pressure in the first control oil chamber 16 is excessively low or hydraulic pressure in the second control oil chamber 53 is excessively high, a counterclockwise displacement of cam ring 5 tends to become small, and thus the pump discharge flow rate increases. As a result, a rise in hydraulic pressure in the main oil gallery 25 (the branch passage 29) occurs, and thus spool 57 can be slightly displaced downward against the spring force of valve spring 34. Owing to the slight downward movement of the first land 57*a*, the flow passage area of the small aperture, defined by the first land 57*a* to communicate the oil introduction port 29*a* with the opening end 35*a* of the first communication passage 35, becomes larger. As a result, a rise in hydraulic pressure in the first control oil chamber 16 occurs. At the same time, owing to the slight downward movement of the second land 57*b*, the flow passage area of the small aperture, defined by the second land 57*b* to communicate the first annular groove 57*h* with the opening end 58*a* of the third communication passage 58, becomes larger and thus the amount of working fluid directed from the small aperture through the first annular groove 57*h* to the drain passage 59 increases. As a result, a fall in hydraulic pressure in the second control oil chamber 53 occurs.

In this manner, immediately when the pump discharge pressure reaches the given hydraulic pressure P1, fluid-communication between the oil introduction port 29*a* and the first communication passage 35 (the first control oil chamber 53) becomes established and simultaneously fluid-communication between the drain passage 59 and the third communication passage 58 (the second control oil chamber 53) becomes established. Thereafter, the hydraulic pressure in the first control oil chamber 16 can be appropriately controlled or regulated by virtue of an appropriate change in the flow passage area of the small aperture, defined by the first land 57*a* to communicate the oil introduction port 29*a* with the first communication passage 35, and simultaneously the hydraulic pressure in the second control oil chamber 53 can be appropriately controlled or regulated by virtue of an appropriate change in the flow passage area of the small aperture, defined by the second land 57*b* to communicate the drain passage 59 with the third communication passage 58.

Also, in the third embodiment, hydraulic-pressure control for the first control oil chamber 16 and hydraulic-pressure control for the second control oil chamber 53 can be carried out simultaneously by means of first and second lands 57*a*-57*b*. Hence, as compared to the first embodiment (FIGS. 1-5)

and the second embodiment (FIGS. 7-9), in the third embodiment (FIGS. 10-12), hydraulic pressures in first and second control oil chambers 16 and 53 can be more precisely appropriately controlled or regulated by a further smaller axial movement of spool 57 (in particular, the first and second lands 57*a*-57*b*) without being entirely affected by a spring constant of valve spring 34.

Also, in the same manner as the first and second embodiments, in the presence of a requirement of hydraulic-pressure rise to the given hydraulic pressure level P2, the electromagnetic coil of solenoid 45 of directional control valve 8 becomes de-energized responsively to an OFF signal from the control unit. The control method and operation for holding the pump discharge pressure at the given constant pressure level P2 are the same as described previously for the first and second embodiments.

FIG. 12 shows the specific state of pilot valve 7 where the pump discharge pressure is controlled or regulated to the given constant pressure level P2. In this case, as can be seen from the cross section of FIG. 12, hydraulic pressure in the main oil gallery 25 (the branch passage 29) is delivered via the second communication passage 39 into the pressure-receiving chamber 38. By means of large-diameter spring-support slider 33, spool 57, valve spring 34, and large-diameter spring-support slider 33 upwardly move together toward the oil introduction port 29*a*. Hence, large-diameter spring-support slider 33 is brought into abutted-engagement (into wall-contact) with the shouldered portion 30*c* between small-diameter bore 30*a* and large-diameter bore 30*b*, such that a maximum upward displacement of large-diameter spring-support slider 33 is restricted by abutted-engagement with the shouldered portion 30*c*. In accordance with the upward movement of spool 57, as a matter of course, first and second lands 57*a*-57*b* move upward, and then the spool 57 reaches the uppermost axial position shown in FIG. 10. Thus, the third communication passage 58 becomes communicated with the oil introduction port 29*a* through the radial through hole 57*g* and simultaneously the first communication passage 35 becomes communicated with the drain passage 59 through the first annular groove 57*h*. As a result of this, a rise in hydraulic pressure in the second control oil chamber 53 and a fall in hydraulic pressure in the first control oil chamber 16 simultaneously occur. Hence, owing to the risen hydraulic pressure in the second control oil chamber 53 as well as the fallen hydraulic pressure in the first control oil chamber 16, cam ring 5 returns in the direction that the eccentricity of the geometric center of cam ring 5 to the axis of rotation of rotor 4 increases. Therefore, the pump discharge flow rate increases and thus the hydraulic pressure discharged from the pump to the main oil gallery 25 also increases. Thus, spool 57 moves downward against the spring force of valve spring 34. In this manner, as soon as the pump discharge pressure reaches the given hydraulic pressure level P2, the first land 57*a* reaches the axial position, corresponding to the opening end 35*a* of the first communication passage 35, and simultaneously the second land 57*b* reaches the axial position, corresponding to the opening end 58*a* of the third communication passage 58, as shown in FIG. 12. As a result, a fall in hydraulic pressure in the second control oil chamber 53 and a rise in hydraulic pressure in the first control oil chamber 16 simultaneously occur. As discussed above, the pump discharge pressure can be kept at the given constant pressure level P2.

[Fourth Embodiment]

Figure 13C:
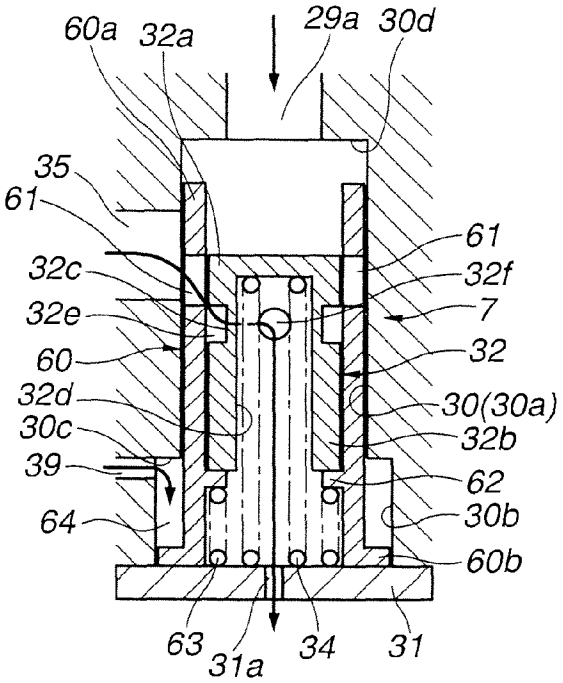
FIG. 13C is an explanatory view illustrating the operation of the pilot valve during high-load operation.
Figure 13B:
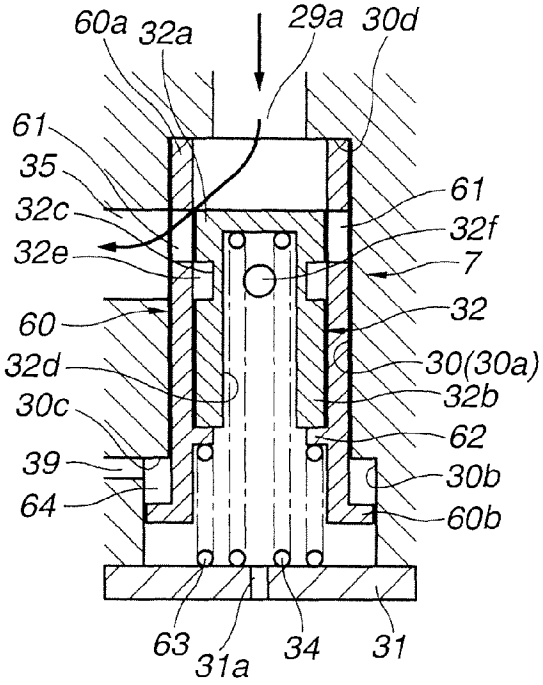
FIG. 13B is an explanatory view illustrating the operation of the pilot valve during a steady-state engine operating mode.
Figure 13A:
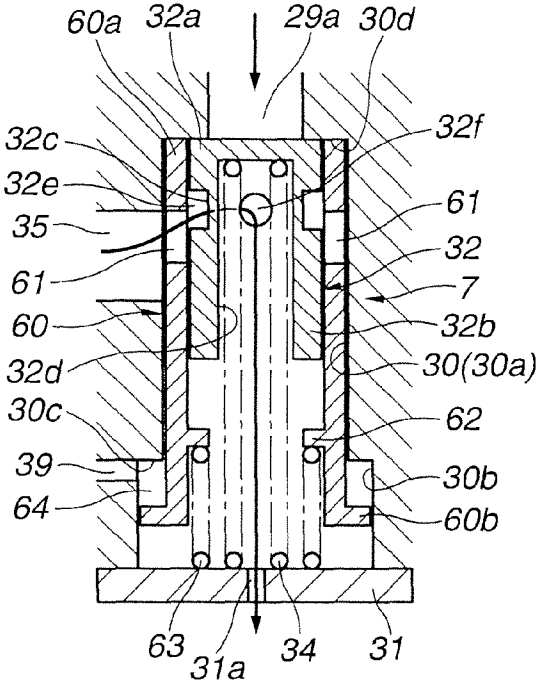
FIG. 13A is an explanatory view, in longitudinal cross section, illustrating the operation of a pilot valve of the variable displacement oil pump system of the fourth embodiment during the early stage of engine start-up.

Referring now to FIGS. 13A-13C, there is shown a modified pilot valve structure (a sleeve-equipped pilot valve structure, described later) incorporated in the variable displacement oil pump system of the fourth embodiment, and modified from the pilot valve 7 (the large-diameter spring-support slider-equipped pilot valve) of the first embodiment shown in FIGS. 1-5. The pump-body structure of the variable displacement oil pump of the fourth embodiment is identical to that of the first embodiment. Also, the structure of electromagnetic solenoid operated directional control valve 8 of the fourth embodiment is identical to that of the first to third embodiments.

In the first embodiment, pilot valve 7 is configured to change a switching pressure when switching the flow path configuration for the first communication passage 35 (i.e., the control oil chamber 16) between (i) the pressure-release flow path (i.e., the oil-discharge flow path) connected to the drain passage 37 and (ii) the pressure-supply flow path (i.e., the oil-introduction flow path) connected to the oil introduction port 29*a*, by shifting the axial position of large-diameter spring-support slider 33 and by changing the entire axial length of valve spring 34 (in other words, the spring load of valve spring 34).

In the second embodiment, pilot valve 7 is configured to change a switching pressure when switching the flow path configuration for the third communication passage 58 (i.e., the second control oil chamber 53) between (i) the pressure-supply flow path connected to the oil introduction port 29*a* and (ii) the pressure-release flow path connected to the drain passage 59, by shifting the axial position of large-diameter spring-support slider 33 and by changing the entire axial length of valve spring 34 (in other words, the spring load of valve spring 34).

In the third embodiment, pilot valve 7 is configured to change a switching pressure when switching the flow path configuration for the first communication passage 35 (i.e., the first control oil chamber 16) between (i) the pressure-release flow path connected to the drain passage 59 and (ii) the pressure-supply flow path connected to the oil introduction port 29*a*, and simultaneously switching the flow path configuration for the third communication passage 58 (i.e., the second control oil chamber 53) between (i) the pressure-supply flow path connected to the oil introduction port 29*a* and (ii) the pressure-release flow path connected to the drain passage 59, by shifting the axial position of large-diameter spring-support slider 33 and by changing the entire axial length of valve spring 34 (in other words, the spring load of valve spring 34).

In contrast to the above, in the fourth embodiment, the modified pilot valve 7 is configured to change a switching pressure by changing or shifting a port position of the pilot valve.

As clearly seen in FIGS. 13A-13C, in the fourth embodiment, a sleeve 60, which has a plurality of communication ports 61 (described later), is disposed between the stepped cylindrical close-fitting bore 30 of the modified pilot valve 7 (simply, pilot valve 7) and the spool 32. An axial displacement of sleeve 60 is produced by energization/de-energization control (ON/OFF control) for the electromagnetic coil of solenoid 45 of directional control valve 8, thereby enabling the entire axial length (i.e., the spring load) of valve spring 34 to be changed. This ensures switching of the pump discharge pressure between two-stage pressure levels P1 and P2.

More concretely, sleeve 60 is comprised of a cylindrical small-diameter portion 60*a*, and a radially-extending flanged large-diameter portion 60*b* formed integral with the lowermost end of small-diameter portion 60*a*. The outer periphery of small-diameter portion 60*a* is machined to axially slide in the small-diameter bore 30*a* with a very small radial clearance between the inner peripheral surface of small-diameter bore 30*a* and the outer peripheral surface of small-diameter portion 60*a*. In a similar manner, the outer periphery of flanged large-diameter portion 60*b* is machined to axially slide in the large-diameter bore 30*b* with a very small radial clearance between the inner peripheral surface of large-diameter bore 30*b* and the outer peripheral surface of flanged large-diameter portion 60*b*. Additionally, two lands 32*a*-32*b* of spool 32 are machined to axially slide in the close-fitting cylindrical bore of small-diameter portion 60*a* with a very small radial clearance.

Small-diameter portion 60*a* of sleeve 60 has a plurality of communication ports 61 (circumferentially equidistant-spaced radial through holes) at a given axial position substantially corresponding to the first communication passage 35. The opening width (i.e., the axial length) of the opening end 35*a* of the first communication passage 35 is dimensioned such that the first communication passage 35 always communicates with the communication ports 61 over the entire range of axial displacement of ports 61.

FIG. 13A shows an initial state of pilot valve 7 of the pump system of the fourth embodiment under a particular state where there is no pump discharge pressure application through the oil introduction port 29*a* to the top face of spool 32, for example, with the engine put in a stop state, or during the early stage of engine start-up (i.e., during the initial start-up of the pump). An annular spring seat 62 is integrally formed on the inner periphery of the lower portion of sleeve 60. Under preload (i.e., under a specified set spring load), a sleeve spring 63 (serving as a third biasing member) is disposed between the spring seat 62 and the inside face of lid member 31, which lid member is configured to hermetically close the lowermost end of large-diameter bore 30*b*. A given spring load (a set spring force) of sleeve spring 63 (with sleeve 60 kept at its initial setting position or a spring-loaded original position) is set to a spring force that a downward displacement of sleeve 60 does not occur by the application of hydraulic pressure through the oil introduction port 29*a*. Hence, in the initial state of pilot valve 7, sleeve spring 63 forces the sleeve 60 into abutted-engagement with a shouldered bearing surface 30*d* formed the uppermost end of small-diameter bore 30*a*.

Lid member 31 has a center drain port 31*a* (an axial through hole) bored in the axial direction of spool 32. The structure of spool 32 of pilot valve 7 of the fourth embodiment, is the same as the first embodiment. That is, spool 32 has first and second lands 32*a*-32*b* and small-diameter shaft 32*c* between them. Spool 32 has the cylindrical bore 32*d* closed at its upper end and extending along the axis of spool 32. Small-diameter shaft 32*c* defines the annular groove 32*e* between first and second lands 32*a*-32*b*. Also, small-diameter shaft 32*c* has the radial through hole 32*f* for communicating the annular groove 32*e* with the cylindrical bore 32*d* by way of the radial through hole 32*f*.

Valve spring 34 is disposed between the upper closed end face of cylindrical bore 32*d* of spool 32 and the inside face of lid member 31, for biasing or forcing the spool 32 in the direction for closing of the oil introduction port 29*a*.

An annular pressure-receiving chamber 64 is defined between the shouldered portion 30*c* of stepped cylindrical close-fitting bore 30 and the stepped portion of the small-diameter portion 60*a* and the flanged large-diameter portion 60*b* of sleeve 60. One opening end of the second communication passage 39 is configured to open into the annular pressure-receiving chamber 64. Supply-and-exhaust port 46 of directional control valve 8 communicates with the annular pressure-receiving chamber 64 of pilot valve 7 through the second communication passage 39.

Communication ports 61 (circumferentially equidistant-spaced radial through holes) of sleeve 60 are configured to always communicate with the large-diameter first communication passage 35.

In the initial state of pilot valve 7, as shown in FIG. 13A, the first communication passage 35 is communicated with the internal space of sleeve 60 (spool 32) through the communication ports 61, the annular groove 32*e*, and the radial through hole 32*f*, and also communicated with the drain port 31*a* of lid member 31.

As previously discussed, communication ports 61 are configured to be circumferentially equidistant-spaced from each other so as to always communicate with the first communication passage 35 regardless of the sense of sleeve 60 in the direction of rotation, in other words, even in the presence of a rotational displacement of sleeve 60 about the axis of spool 32.

A switching action of the flow path configuration for the first communication passage 35 (i.e., the control oil chamber 16), carried out within the pump system of the fourth embodiment, between (i) a pressure-release flow path connected to the oil pan and (ii) a pressure-supply flow path connected to the oil introduction port 29*a* is the same as the first embodiment. The fundamental operation of the variable displacement oil pump of the fourth embodiment employing the sleeve-equipped pilot valve is similar to that of the variable displacement oil pump of the first embodiment employing the large-diameter spring-support slider-equipped pilot valve. Thus, in the same manner as the first embodiment, the variable displacement oil pump system of the fourth embodiment employing the sleeve-equipped pilot valve can provide the two-stage pump discharge pressure characteristic shown in FIG. 6.

FIG. 13B shows the working state of pilot valve 7 of the pump system of the fourth embodiment during a steady-state engine operating mode, at which the pump discharge pressure rises up to the given hydraulic pressure level P1. As clearly shown in FIG. 13B, spool 32 is downwardly displaced toward the lid member 31 against the spring force of valve spring 34 with hydraulic pressure, applied through the oil introduction port 29*a* to the top face of spool 32. The width (i.e., the axial length) of the first land 32*a* is dimensioned to be approximately equal to the opening width of each of communication ports 61. Therefore, when the first land 32*a* downwardly moves to the axial position of the communication ports 61, fluid-communication between the communication ports 61 and the drain port 31*a* through the annular groove 32*e* and the radial through hole 32*f* becomes blocked and fluid-communication between the communication ports 61 and the oil introduction port 29*a* becomes established. That is, switching of the flow path configuration for the first communication passage 35 (i.e., the control oil chamber 16) from (i) the pressure-release flow path connected to the drain port 31*a* to (ii) the pressure-supply flow path connected to the oil introduction port 29*a* occurs. Hence, hydraulic pressure is introduced through the oil introduction port 29*a* and the first communication passage 35 to the control oil chamber 16 and as a result the pump discharge flow rate can be adjusted by a counterclockwise displacement of cam ring 5 against the spring force of coil spring 28.

When hydraulic pressure in the control oil chamber 16, is excessively high, a counterclockwise displacement of cam ring 5 tends to become large, and thus switching of the flow path configuration for the first communication passage 35 from the pressure-supply flow path connected to the oil introduction port 29*a* to the pressure-release flow path connected to the drain port 31*a* occurs.

Conversely when hydraulic pressure in the control oil chamber 16, is excessively low, a counterclockwise displacement of cam ring 5 tends to become small, and thus switching of the flow path configuration for the first communication passage 35 from the pressure-release flow path connected to the drain port 31*a* to the pressure-supply flow path connected to the oil introduction port 29*a* occurs.

In this manner, immediately when the pump discharge pressure reaches the given hydraulic pressure P1, fluid-communication between the oil introduction port 29*a* and the first communication passage 35 becomes established, and thereafter the hydraulic pressure in the control oil chamber 16 can be appropriately controlled or regulated by appropriate switching between (i) the pressure-release flow path connected to the drain port 31*a* and (ii) the pressure-supply flow path connected to the oil introduction port 29*a* by virtue of slight upward and downward axial displacements of the first land 32*a*, such that the pump discharge pressure can be held at the given hydraulic pressure P1.

At this time, the electromagnetic coil of directional control valve 8 becomes energized responsively to an ON signal from the control unit. Thus, the annular pressure-receiving chamber 64 of pilot valve 7 becomes communicated with the oil pan through the second communication passage 39, the supply-and-exhaust port 46, the cylindrical passage 50, and the drain port 47. There is no hydraulic pressure acting on the annular upper sidewall surface (serving as a pressure-receiving surface) of flanged large-diameter portion 60*b* of sleeve 60. That is, the annular pressure-receiving chamber 64 becomes a low-pressure state. Hence, sleeve 60 (communication ports 61) can be kept at the spring-loaded original position shown in FIG. 13B by the spring force of sleeve spring 63. At this time, a switching pressure when switching the flow path configuration for the first communication passage 35 (i.e., the control oil chamber 16) between (i) the pressure-release flow path connected to the drain port 31*a* and (ii) the pressure-supply flow path connected to the oil introduction port 29*a*, becomes the given hydraulic pressure level P1 shown in FIG. 6.

Also, when the hydraulic pressure (the pump discharge pressure) has to be risen to the given hydraulic pressure level P2, the electromagnetic coil of solenoid 45 of directional control valve 8 becomes de-energized responsively to an OFF signal from the control unit, thereby permitting the pushrod 49 to retract so as to establish fluid-communication between the solenoid control port 43 and the supply-and-exhaust port 46 and simultaneously to block fluid-communication between the supply-and-exhaust port 46 and the drain port 47 through the cylindrical passage 50. Thus, hydraulic pressure is supplied through the branch passage 29 into the annular pressure-receiving chamber 64. Hence, sleeve 60 begins to move downward from the spring-loaded original position of FIG. 13B against the spring force of sleeve spring 63 (exactly, against the biasing force of valve spring 34 and an inertia of the spool 32 as well as the biasing force of sleeve spring 63) and thus the annular lower sidewall surface of flanged large-diameter portion 60*b* of sleeve 60 is brought into abutted-engagement with the inside face of lid member 31 by the supplied hydraulic pressure, while compressing the sleeve spring 63 (see FIG. 13C). The annular lower sidewall surface of flanged large-diameter portion 60*b* and the inside face of lid member 31, abutted with each other, provide a good leakproof seal, and hence hydraulic pressure in the annular pressure-receiving chamber 64 becomes high.

By the way, to more certainly enhance a leakproof seal performance, it is preferable to machine or produce the radial clearance space between the inner peripheral surface of small-diameter bore 30*a* and the outer peripheral surface of small-diameter portion 60*a* as small as possible. Machining the radial clearance space between small-diameter bore 30*a* and small-diameter portion 60*a* as small as possible, permits the radial clearance space between large-diameter bore 30*b* and flanged large-diameter portion 60*b* to be machined somewhat looser. By virtue of such a somewhat looser radial clearance, it is unnecessary to strictly manage or control the accuracy or the quality concerning the concentricity of small-diameter portion 60*a* and flanged large-diameter portion 60*b*.

As can be seen from the cross section of FIG. 13C, in accordance with the downward movement of sleeve 60, as a matter of course, the communication ports 61 move downward. Thus, the first land 32*a* of spool 32, together with the communication ports 61, moves downward, while compressing the valve spring 34 by the circular top of the first land 32*a*. Hence, the spring load of valve spring 34 becomes a higher spring load. At this time, a switching pressure when switching the flow path configuration for the first communication passage 35 (i.e., the control oil chamber 16) between (i) the pressure-release flow path connected to the drain port 31*a* and (ii) the pressure-supply flow path connected to the oil introduction port 29*a*, becomes the given hydraulic pressure level P2 shown in FIG. 6.

The other operation and effects of the pump system of the fourth embodiment are the same as the first embodiment. However, in the fourth embodiment shown in FIGS. 13A-13C, it is possible to enhance a wear-and-abrasion resistance to the sliding-contact portion of sleeve 60 with the spool 32 by producing the sleeve 60 by iron-based materials. Additionally, the sliding-contact surface area of the outer periphery of sleeve 60 with the stepped cylindrical close-fitting bore 30 of control housing 6 made by aluminum alloy is greater than the sliding-contact surface area of the inner periphery (the sliding-contact surface) of sleeve 60 with the spool 32, thus enhancing a wear-and-abrasion resistance.

[Fifth Embodiment]

Figure 14A:
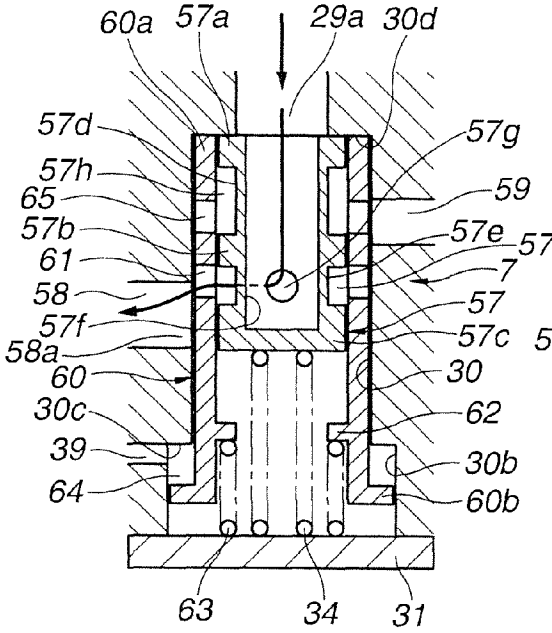
FIG. 14A is an explanatory view, in longitudinal cross section, illustrating the operation of a pilot valve of the variable displacement oil pump system of the fifth embodiment during the early stage of engine start-up.
Figure 14B:
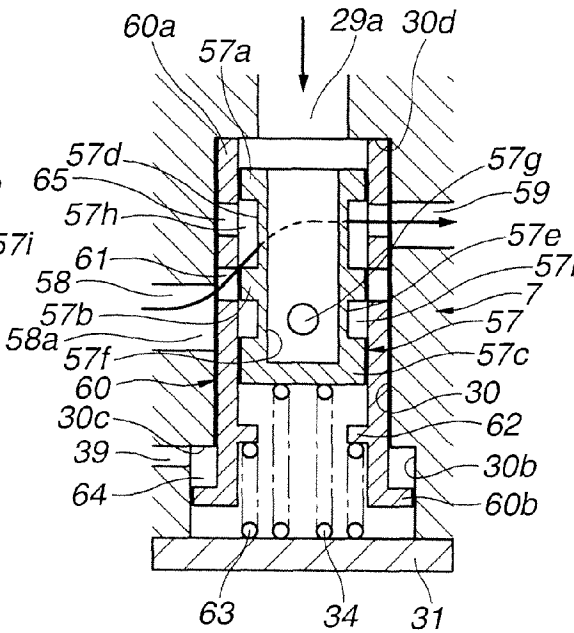
FIG. 14B is an explanatory view illustrating the operation of the pilot valve during a steady-state engine operating mode.
Figure 14C:
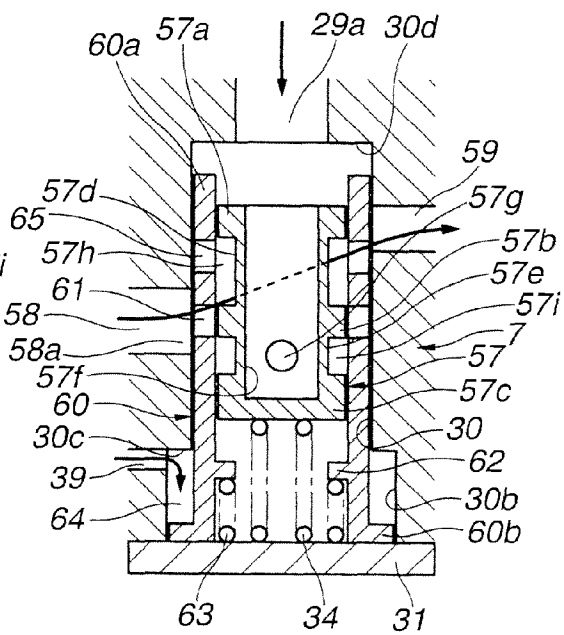
FIG. 14C is an explanatory view illustrating the operation of the pilot valve during high-load operation.

Referring now to FIGS. 14A-14C, there is shown another modified sleeve-equipped pilot valve structure incorporated in the variable displacement oil pump system of the fifth embodiment. The fifth embodiment is a modification that the sleeve-equipped pilot valve structure, somewhat similar to the fourth embodiment, is applied to the pump system of the second embodiment. The pump-body structure of the variable displacement oil pump of the fifth embodiment is identical to that of the first embodiment. Also, the structure of electromagnetic solenoid operated directional control valve 8 of the fifth embodiment is identical to that of the first to third embodiments.

As clearly seen in FIGS. 14A-14C, in the fifth embodiment, the sleeve 60 is vertically slidably disposed between the stepped cylindrical close-fitting bore 30 of pilot valve 7 and the spool 57. An axial displacement of sleeve 60 is produced by energization/de-energization control (ON/OFF control) for the electromagnetic coil of solenoid 45 of directional control valve 8, thereby enabling the entire axial length (i.e., the spring load) of valve spring 34 to be changed. This ensures switching of the pump discharge pressure between two-stage pressure levels P1 and P2.

Small-diameter portion 60*a* of sleeve 60 has a plurality of communication ports 61 (circumferentially equidistant-spaced radial through holes) at a given axial position substantially corresponding to the third communication passage 58. Also, the small-diameter portion 60*a* of sleeve 60 has a plurality of drain ports 65 (circumferentially equidistant-spaced radial through holes) at an upper axial position than the communication ports 61 and substantially corresponding to the drain passage 59. That is, the drain port 31*a* of lid member 31 of the pilot valve structure of the fourth embodiment (FIGS. 13A-13C) is replaced with the drain ports 65 of the pilot valve structure of the fifth embodiment.

Spool valve 57 is upwardly forced or biased by the spring force of valve spring 34 in the direction for closing the oil introduction port 29*a*. On the other hand, sleeve 60 is forced or biased by the spring force of sleeve spring 63 in the direction of abutted-engagement with the shouldered bearing surface 30*d* formed the uppermost end of small-diameter bore 30*a*.

In the initial state of pilot valve 7, as shown in FIG. 14A, the communication ports 61 are communicated with the oil introduction port 29*a* through the radial through hole 57*g* of second small-diameter shaft 57*e*, and also communicated with the third communication passage 58. Thus, hydraulic pressure in the main oil gallery 25 is delivered into the second control oil chamber 53.

FIG. 14B shows the working state of pilot valve 7 of the pump system of the fifth embodiment during a steady-state engine operating mode, at which the pump discharge pressure rises up to the given hydraulic pressure level P1. As clearly shown in FIG. 14B, spool 57 is downwardly displaced toward the lid member 31 against the spring force of valve spring 34 with hydraulic pressure, applied through the oil introduction port 29*a* to spool 57. The width (i.e., the axial length) of the second land 57*b* is dimensioned to be approximately equal to the opening width of each of communication ports 61. Therefore, when the second land 57*b* downwardly moves to the axial position of the communication ports 61, fluid-communication between the communication ports 61 and the oil introduction port 29*a* through the second annular groove 57*i* and the radial through hole 57*g* becomes blocked and fluid-communication between the communication ports 61 and the drain passage 59 through the first annular groove 57*h* and the drain ports 65 becomes established. That is, switching of the flow path configuration for the third communication passage 58 (i.e., the second control oil chamber 53) from (i) a pressure-supply flow path connected to the oil introduction port 29*a* to (ii) a pressure-release flow path connected to the drain ports 65 occurs. Hence, a fall in hydraulic pressure in the second control oil chamber 53 occurs and as a result the pump discharge flow rate can be adjusted by a counterclockwise displacement of cam ring 5 against the spring force of coil spring 28.

When hydraulic pressure in the second control oil chamber 53 is excessively low, a counterclockwise displacement of cam ring 5 tends to become large, and thus switching of the flow path configuration for the third communication passage 58 from the pressure-release flow path connected to the drain ports 65 to the pressure-supply flow path connected to the oil introduction port 29*a* occurs so as to rise hydraulic pressure in the second control oil chamber 53.

Conversely when hydraulic pressure in the second control oil chamber 53 is excessively high, a counterclockwise displacement of cam ring 5 tends to become small, and thus switching of the flow path configuration for the third communication passage 58 from the pressure-supply flow path connected to the oil introduction port 29*a* to the pressure-release flow path connected to the drain ports 65 occurs so as to fall hydraulic pressure in the second control oil chamber 53.

In this manner, immediately when the pump discharge pressure reaches the given hydraulic pressure P1, fluid-communication between the drain passage 59 and the third communication passage 58 becomes established, and thereafter the hydraulic pressure in the second control oil chamber 53 can be appropriately controlled or regulated by appropriate switching between (i) the pressure-supply flow path connected to the oil introduction port 29*a* and (ii) the pressure-release flow path connected to the drain passage 59 by virtue of slight upward and downward axial displacements of the second land 57*b*, such that the pump discharge pressure can be held at the given hydraulic pressure P1.

At this time, the electromagnetic coil of directional control valve 8 becomes energized responsively to an ON signal from the control unit. Thus, the annular pressure-receiving chamber 64 of pilot valve 7 becomes communicated with the oil pan through the second communication passage 39, the supply-and-exhaust port 46, the cylindrical passage 50, and the drain port 47. There is no hydraulic pressure acting on the annular upper sidewall surface of flanged large-diameter portion 60*b* of sleeve 60. That is, the annular pressure-receiving chamber 64 becomes a low-pressure state. Hence, sleeve 60 (communication ports 61 and drain ports 65) can be kept at the spring-loaded original position shown in FIG. 14B by the spring force of sleeve spring 63. At this time, a switching pressure when switching the flow path configuration for the third communication passage 58 (i.e., the second control oil chamber 53) between (i) the pressure-supply flow path connected to the oil introduction port 29*a* and (ii) the pressure-release flow path connected to the drain passage 59, becomes the given hydraulic pressure level P1 shown in FIG. 6.

Also, when the hydraulic pressure (the pump discharge pressure) has to be risen to the given hydraulic pressure level P2, the electromagnetic coil of solenoid 45 of directional control valve 8 becomes de-energized responsively to an OFF signal from the control unit. Thus, hydraulic pressure is supplied through the branch passage 29 into the annular pressure-receiving chamber 64. Hence, sleeve 60 begins to move downward from the spring-loaded original position of FIG. 14B against the spring force of sleeve spring 63 and thus the annular lower sidewall surface of flanged large-diameter portion 60*b* of sleeve 60 is brought into abutted-engagement with the inside face of lid member 31 by the supplied hydraulic pressure, while compressing the sleeve spring 63 (see FIG. 14C).

As can be seen from the cross section of FIG. 14C, in accordance with the downward movement of sleeve 60, as a matter of course, the communication ports 61 move downward. Thus, the second land 57*b* of spool 57, together with the communication ports 61, moves downward, while compressing the valve spring 34 by the underside of the third land 57*c*. Hence, the spring load of valve spring 34 becomes a higher spring load. At this time, a switching pressure when switching the flow path configuration for the third communication passage 58 (i.e., the second control oil chamber 53) between (i) the pressure-supply flow path connected to the oil introduction port 29*a* and (ii) the pressure-release flow path connected to the drain passage 59, becomes the given hydraulic pressure level P2 shown in FIG. 6.

By the way, the opening width of the opening end 58*a* of the third communication passage 58 is set or dimensioned such that the third communication passage 58 always communicates with the communication ports 61 over the entire range of axial displacement of ports 61. Additionally, the opening width of the drain passage 59 is set or dimensioned such that the drain passage 59 always communicates with the drain ports 65 over the entire range of axial displacement of ports 65.

The other operation and effects of the pump system of the fifth embodiment are the same as the second embodiment. However, in the fifth embodiment shown in FIGS. 14A-14C, it is possible to enhance a wear-and-abrasion resistance to the sliding-contact portion of sleeve 60 with the spool 57 by producing the sleeve 60 by iron-based materials. Additionally, the sliding-contact surface area of the outer periphery of sleeve 60 with the stepped cylindrical close-fitting bore 30 of control housing 6 made by aluminum alloy is greater than the sliding-contact surface area of the inner periphery of sleeve 60 with the spool 57, thus enhancing a wear-and-abrasion resistance. As previously described, the oil pump of the fourth embodiment employing the sleeve-equipped pilot valve is superior to the oil pump of the first embodiment employing the large-diameter spring-support slider-equipped pilot valve, in enhanced wear-and-abrasion resistance. In a similar manner, the oil pump of the fifth embodiment employing the sleeve-equipped pilot valve is superior to the oil pump of the second embodiment employing the large-diameter spring-support slider-equipped pilot valve, in enhanced wear-and-abrasion resistance.

[Sixth Embodiment]

Figure 15A:
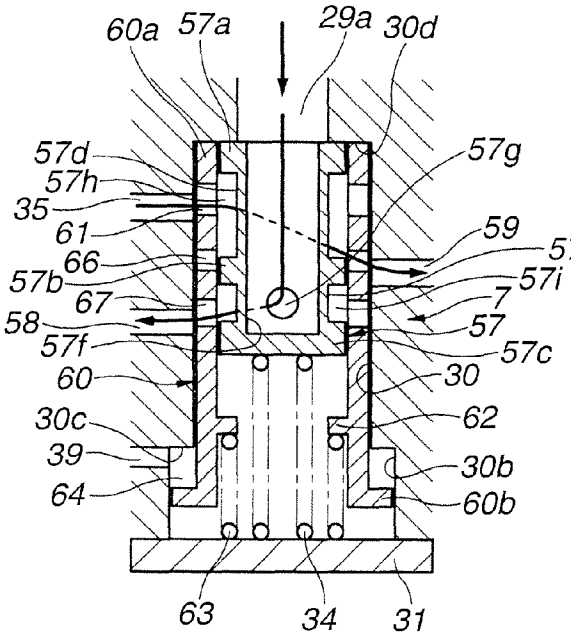
FIG. 15A is an explanatory view, in longitudinal cross section, illustrating the operation of a pilot valve of the variable displacement oil pump system of the sixth embodiment during the early stage of engine start-up.
Figure 15B:
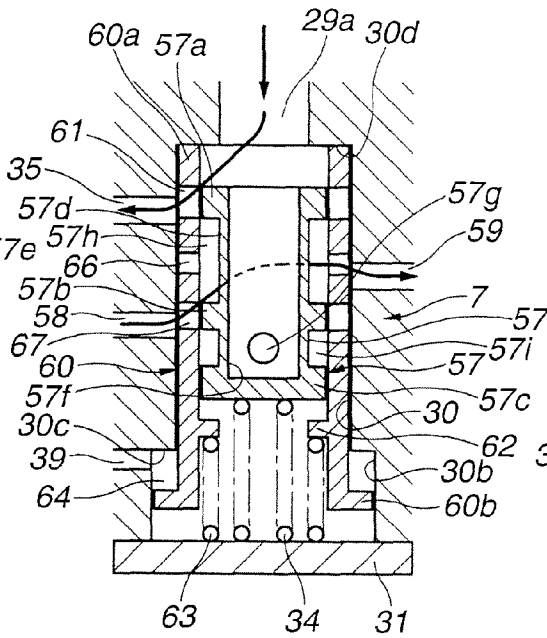
FIG. 15B is an explanatory view illustrating the operation of the pilot valve during a steady-state engine operating mode.
Figure 15C:
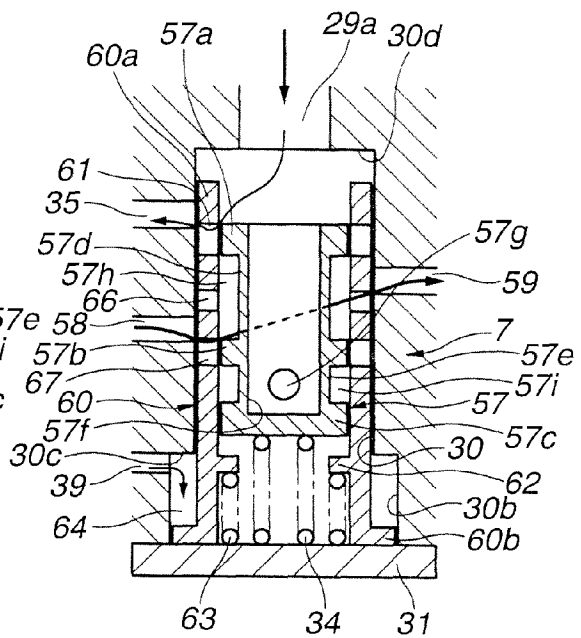
FIG. 15C is an explanatory view illustrating the operation of the pilot valve during high-load operation.

Referring now to FIGS. 15A-15C, there is shown a further modified sleeve-equipped pilot valve structure incorporated in the variable displacement oil pump system of the sixth embodiment. The sixth embodiment is a modification that the sleeve-equipped pilot valve structure, somewhat similar to the fourth and fifth embodiments, is applied to the pump system of the third embodiment. The pump-body structure of the variable displacement oil pump of the sixth embodiment is identical to that of the first embodiment. Also, the structure of electromagnetic solenoid operated directional control valve 8 of the sixth embodiment is identical to that of the first to third embodiments.

As clearly seen in FIGS. 15A-15C, in the sixth embodiment, the sleeve 60 is vertically slidably disposed between the stepped cylindrical close-fitting bore 30 of pilot valve 7 and the spool 57. The small-diameter portion 60*a* of sleeve 60 has a plurality of first communication ports 61 (circumferentially equidistant-spaced radial through holes) at a given axial position substantially corresponding to the first communication passage 35. The small-diameter portion 60*a* of sleeve 60 has a plurality of drain ports 66 (circumferentially equidistant-spaced radial through holes) at a lower axial position than the first communication ports 61 and substantially corresponding to the drain passage 59. Also, the small-diameter portion 60*a* of sleeve 60 has a plurality of second communication ports 67 (circumferentially equidistant-spaced radial through holes) at a lower axial position than the drain ports 66 and substantially corresponding to the third communication passage 58.

An axial displacement of sleeve 60 is produced by energization/de-energization control (ON/OFF control) for the electromagnetic coil of solenoid 45 of directional control valve 8, thereby enabling the entire axial length (i.e., the spring load) of valve spring 34 to be changed. This ensures switching of the pump discharge pressure between two-stage pressure levels P1 and P2.

In the initial state of pilot valve 7, as shown in FIG. 15A, spool 57 is forced into abutted-engagement with the shouldered bearing surface 30*d* by the spring force of valve spring 34. At the same time, sleeve 60 is forced into abutted-engagement with the shouldered bearing surface 30*d* by the spring force of sleeve spring 63.

In the initial state of pilot valve 7, as shown in FIG. 15A, the first communication passage 35 is communicated with the drain ports 66 through the first communication ports 61 and the first annular groove 57*h*, whereas the third communication passage 58 is communicated with the oil introduction port 29*a* through the second communication ports 67 and the radial through hole 57*g*. Thus, hydraulic pressure in the main oil gallery 25 is delivered into the second control oil chamber 53.

FIG. 15B shows the working state of pilot valve 7 of the pump system of the sixth embodiment during a steady-state engine operating mode, at which the pump discharge pressure rises up to the given hydraulic pressure level P1. As clearly shown in FIG. 15B, spool 57 is downwardly displaced toward the lid member 31 against the spring force of valve spring 34 with hydraulic pressure, applied through the oil introduction port 29*a* to spool 57. The width (i.e., the axial length) of the first land 57*a* dimensioned to be approximately equal to the opening width of each of first communication ports 61. Also, the width (i.e., the axial length) of the second land 57*b* dimensioned to be approximately equal to the opening width of each of second communication ports 67. Therefore, when the first land 57*a* downwardly moves to the axial position of the first communication ports 61 and simultaneously the second land 57*b* downwardly moves to the axial position of the second communication ports 67, a unique flow path configuration for the first communication ports 61 (i.e., the first communication passage 35, in other words, the first control oil chamber 16) is switched from (i) a pressure-release flow path connected to the drain ports 66 to (ii) a pressure-supply flow path connected to the oil introduction port 29*a* and simultaneously a unique flow path configuration for the second communication ports 67 (i.e., the third communication passage 58, in other words, the second control oil chamber 53) is switched from (i) a pressure-supply flow path connected to the oil introduction port 29*a* to (ii) a pressure-release flow path connected to the drain ports 66. Hence, a rise in hydraulic pressure in the first control oil chamber 16 and a fall in hydraulic pressure in the second control oil chamber 53 occur simultaneously and as a result the pump discharge flow rate can be adjusted by a counterclockwise displacement of cam ring 5 against the spring force of coil spring 28.

When hydraulic pressure in the first control oil chamber 16 is excessively high or hydraulic pressure in the second control oil chamber 53 is excessively low, a counterclockwise displacement of cam ring 5 tends to become large, and thus switching of the flow path configuration for the first control oil chamber 16 (i.e., the first communication passage 35) from the pressure-supply flow path connected to the oil introduction port 29*a* to the pressure-release flow path connected to the drain ports 66 and switching of the flow path configuration for the second control oil chamber 53 (i.e., the third communication passage 58) from the pressure-release flow path connected to the drain ports 66 to the pressure-supply flow path connected to the oil introduction port 29*a* occur simultaneously so as to fall the hydraulic pressure in the first control oil chamber 16 and simultaneously rise the hydraulic pressure in the second control oil chamber 53.

Conversely when hydraulic pressure in the first control oil chamber 16 is excessively low or hydraulic pressure in the second control oil chamber 53 is excessively high, a counterclockwise displacement of cam ring 5 tends to become small, and thus switching of the flow path configuration for the first control oil chamber 16 (i.e., the first communication passage 35) from the pressure-release flow path connected to the drain ports 66 to the pressure-supply flow path connected to the oil introduction port 29*a* and switching of the flow path configuration for the second control oil chamber 53 (i.e., the third communication passage 58) from the pressure-supply flow path connected to the oil introduction port 29*a* to the pressure-release flow path connected to the drain ports 66 occur simultaneously so as to rise the hydraulic pressure in the first control oil chamber 16 and simultaneously fall the hydraulic pressure in the second control oil chamber 53.

In this manner, immediately when the pump discharge pressure reaches the given hydraulic pressure P1, fluid-communication between the oil introduction port 29*a* and the first communication passage 35 and fluid-communication between the drain passage 59 and the third communication passage 58 become established, and thereafter the hydraulic pressure in the first control oil chamber 16 can be appropriately controlled or regulated by appropriate switching between (i) the pressure-release flow path connected to the drain passage 59 and (ii) the pressure-supply flow path connected to the oil introduction port 29*a* by virtue of slight upward and downward axial displacements of the first land 57*a*, and simultaneously the hydraulic pressure in the second control oil chamber 53 can be appropriately controlled or regulated by appropriate switching between (i) the pressure-supply flow path connected to the oil introduction port 29*a* and (ii) the pressure-release flow path connected to the drain passage 59 by virtue of slight upward and downward axial displacements of the second land 57*b*, such that the pump discharge pressure can be held at the given hydraulic pressure P1.

At this time, the electromagnetic coil of directional control valve 8 becomes energized responsively to an ON signal from the control unit. Thus, there is no hydraulic pressure acting on the annular upper sidewall surface of flanged large-diameter portion 60*b* of sleeve 60. That is, the annular pressure-receiving chamber 64 becomes a low-pressure state. Hence, sleeve 60 (first communication ports 61, drain ports 66 and second communication ports 67) can be kept at the spring-loaded original position shown in FIG. 15B by the spring force of sleeve spring 63. At this time, a switching pressure when switching the flow path configuration for the first communication passage 35 (i.e., the first control oil chamber 16) between (i) the pressure-release flow path connected to the drain passage 59 and (ii) the pressure-supply flow path connected to the oil introduction port 29*a*, and simultaneously switching the flow path configuration for the third communication passage 58 (i.e., the second control oil chamber 53) between (i) the pressure-supply flow path connected to the oil introduction port 29*a* and (ii) the pressure-release flow path connected to the drain passage 59, becomes the given hydraulic pressure level P1 shown in FIG. 6.

Also, when the hydraulic pressure (the pump discharge pressure) has to be risen to the given hydraulic pressure level P2, the electromagnetic coil of solenoid 45 of directional control valve 8 becomes de-energized responsively to an OFF signal from the control unit. Thus, hydraulic pressure is supplied through the branch passage 29 into the annular pressure-receiving chamber 64. Hence, sleeve 60 begins to move downward from the spring-loaded original position of FIG. 15B against the spring force of sleeve spring 63 and thus the annular lower sidewall surface of flanged large-diameter portion 60*b* of sleeve 60 is brought into abutted-engagement with the inside face of lid member 31 by the supplied hydraulic pressure, while compressing the sleeve spring 63 (see FIG. 15C).

As can be seen from the cross section of FIG. 15C, in accordance with the downward movement of sleeve 60, as a matter of course, first and second communication ports 61 and 67 move downward. Thus, the first land 57*a*, together with the first communication ports 61 and the second land 57*b*, together with the second communication ports 67, move downward, while compressing the valve spring 34 by the underside of the third land 57*c*. Hence, the spring load of valve spring 34 becomes a higher spring load. At this time, a switching pressure when switching the flow path configuration for the first communication passage 35 (i.e., the first control oil chamber 16) between (i) the pressure-release flow path connected to the drain ports 66 and (ii) the pressure-supply flow path connected to the oil introduction port 29*a* and simultaneously switching the flow path configuration for the third communication passage 58 (i.e., the second control oil chamber 53) between (i) the pressure-supply flow path connected to the oil introduction port 29*a* and (ii) the pressure-release flow path connected to the drain ports 66, becomes the given hydraulic pressure level P2 shown in FIG. 6.

By the way, the opening width of the opening end of the first communication passage 35 is set or dimensioned such that the first communication passage 35 always communicates with the first communication ports 61 over the entire range of axial displacement of ports 61. Additionally, the opening width of the drain passage 59 is set or dimensioned such that the drain passage 59 always communicates with the drain ports 66 over the entire range of axial displacement of ports 66.

[Seventh Embodiment]

Figure 16A:
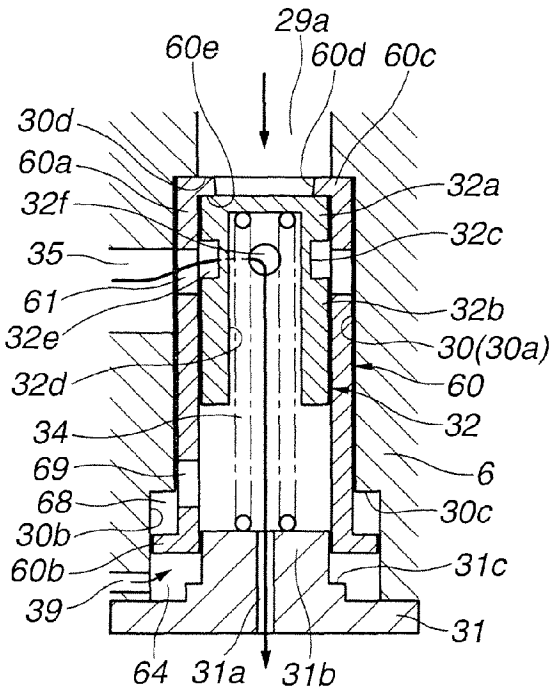
FIG. 16A is an explanatory view, in longitudinal cross section, illustrating the operation of a pilot valve of the variable displacement oil pump system of the seventh embodiment during the early stage of engine start-up.
Figure 16B:
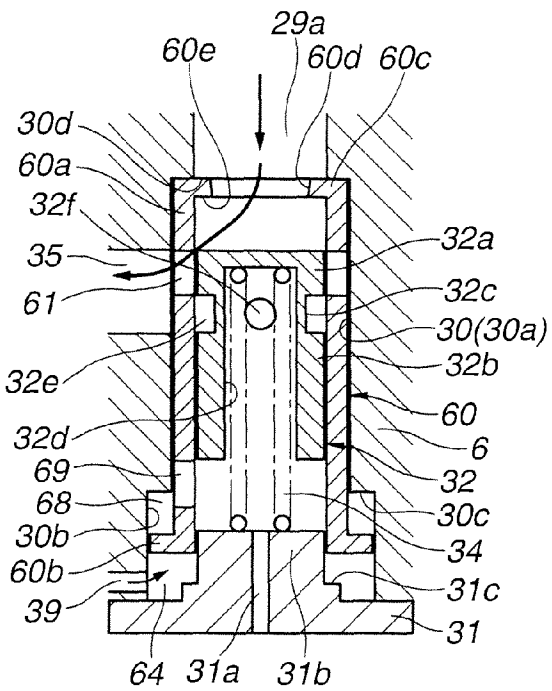
FIG. 16B is an explanatory view illustrating the operation of the pilot valve during a steady-state engine operating mode.
Figure 16C:
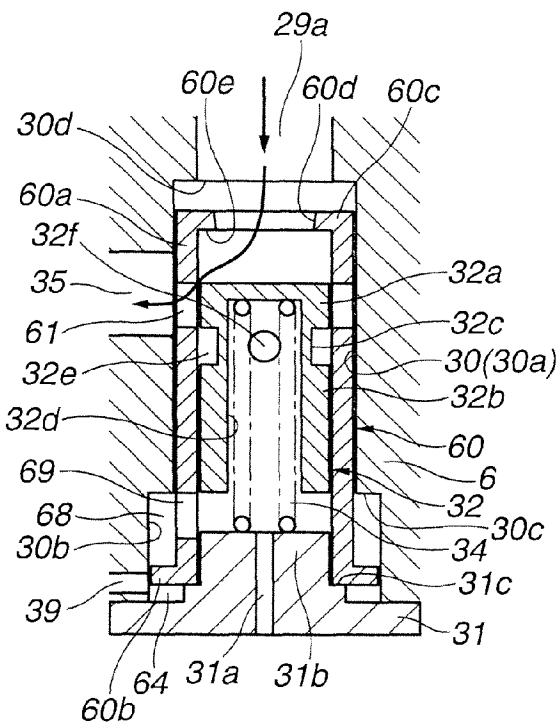
FIG. 16C is an explanatory view illustrating the operation of the pilot valve during high-load operation.

Referring now to FIGS. 16A-16C, there is shown another modified sleeve-equipped pilot valve structure incorporated in the variable displacement oil pump system of the seventh embodiment. The basic pilot valve structure of the seventh embodiment is similar to the fourth embodiment. The seventh embodiment somewhat differs from the fourth embodiment in that the structure (the cross section) of the sleeve 60, disposed between the stepped cylindrical close-fitting bore 30 and the spool 32, is changed. More concretely, in the seventh embodiment, sleeve 60 has an upper wall portion 60*c* formed integral with the uppermost end of small-diameter portion 60*a*. Upper wall portion 60*c* of sleeve 60 has a large-diameter communication bore 60*d* (an axial through hole) formed substantially at the center of the upper wall portion 60*c*. Large-diameter communication bore 60*c* is configured to always communicate with the oil introduction port 29*a*. The underside of upper wall portion 60*c* serves as a second bearing surface 60*e* that restricts a maximum upward movement of spool 32. The structure of spool 32 of pilot valve 7 of the seventh embodiment is identical to that of the first embodiment.

Small-diameter portion 60*a* of sleeve 60 has a plurality of communication ports 61 (circumferentially equidistant-spaced radial through holes) at a given axial position substantially corresponding to the first communication passage 35.

Lid member 31 has a stepped upwardly-protruding portion 31*b* integrally formed at the center of the upside of lid member 31. The inner peripheral surface of the lower end of sleeve 60 is slidably guided by the cylindrical outer peripheral surface of protruding portion 31*b*. Also, lid member 31 has a center drain port 31*a* (an axial through hole) bored in the axial direction of spool 32. Under preload (i.e., under a specified set spring load), valve spring 34 is disposed between the upper closed end face of cylindrical bore 32*d* of spool 32 and the top face of protruding portion 31*b* of lid member 31, for biasing or forcing the first land 32*a* of spool 32 into abutted-engagement with the second bearing surface 60*e* of sleeve 60 by the spring force of valve spring 34. Also, sleeve 60 is biased or forced into abutted-engagement with the shouldered bearing surface 30*d* of stepped cylindrical close-fitting bore 30 by the force that upwardly pushes the first land 32*a* in the direction for closing of the oil introduction port 29*a*.

A substantially annular pressure-receiving chamber 64 is defined between the underside of flanged large-diameter portion 60*b* of sleeve 60 and the stepped portion of the large-diameter disk-shaped lid portion and the stepped portion of lid member 31. One opening end of the second communication passage 39 is configured to open into the substantially annular pressure-receiving chamber 64.

A back-pressure chamber 68 is defined between the stepped portion between the shouldered portion 30*c* of small-diameter bore 30*a* and large-diameter bore 30*b* and the stepped portion of the small-diameter portion 60*a* and the flanged large-diameter portion 60*b* of sleeve 60. Back-pressure chamber 68 is configured to communicate with the drain port 31*a* of lid member 31 through a back-pressure drain hole 69 formed in the lower portion of small-diameter portion 60*a* of sleeve 60.

In the initial state of pilot valve 7, as shown in FIG. 16A, control oil chamber 16 is communicated with the drain port 31*a* through the first communication passage 35, the communication ports 61, the annular groove 32*e*, the radial through hole 32*f* of small-diameter shaft 32*c* and the cylindrical bore 32*d* defined in the sleeve 60. Communication ports 61 are configured to always communicate with the first communication passage 35, regardless of the sense of sleeve 60 in the direction of rotation, in other words, even in the presence of a rotational displacement of sleeve 60 about the axis of spool 32.

The pump-body structure of the variable displacement oil pump of the seventh embodiment (see FIGS. 16A-16C) is identical to that of the first embodiment (see FIGS. 1-5). Also, the connecting path configuration between the pump body and the electromagnetic solenoid operated directional control valve 8 in the pump system of the seventh embodiment is identical to that of the first embodiment, thus providing the two-stage pump discharge pressure characteristic shown in FIG. 6. However, the electromagnetic solenoid operated directional control valve 8 incorporated in the pump system of the seventh embodiment shown in FIGS. 16A-16C, is changed to a different directional-control-valve specification that supplies hydraulic pressure from the branch passage 29 through the directional control valve via the second communication passage 39 to the annular pressure-receiving chamber 64 when energized (ON), and also blocks the pressure-supply flow path from the branch passage 29 via the second communication passage 39 to the annular pressure-receiving chamber 64 and simultaneously switches the flow path configuration for the second communication passage 39 to a pressure-release flow path from the second communication passage 39 through the directional control valve to the drain port 47 when de-energized (OFF).

FIG. 16B shows the working state of pilot valve 7 of the pump system of the seventh embodiment during a steady-state engine operating mode, at which the pump discharge pressure rises up to the given hydraulic pressure level P1. As clearly shown in FIG. 16B, spool 32 is downwardly displaced toward the lid member 31 against the spring force of valve spring 34 with hydraulic pressure, applied through the oil introduction port 29*a* and the large-diameter communication bore 60*d* of sleeve 60 to the top face of spool 32. Therefore, the first land 32*a* of spool 32 downwardly moves away from the second bearing surface 60*e* of sleeve 60, and hence, there is no valve-spring force acting on the upper wall portion 60*c* (or the second bearing surface 60*e*) of sleeve 60. At this time, the electromagnetic coil of the directional control valve 8, whose specification is changed, becomes energized responsively to an ON signal from the control unit. Thus, during the steady-state engine operating mode of FIG. 16B, hydraulic pressure is supplied through the branch passage 29 into the annular pressure-receiving chamber 64. By the way, the pressure-receiving area of flanged large-diameter portion 60*b* of sleeve 60 that receives hydraulic pressure introduced into through the directional control valve 8 into the pressure-receiving chamber 64 is configured or dimensioned to be greater than the pressure-receiving area (substantially corresponding to the lateral cross section of small-diameter portion 60*a*) of the annular pressure-receiving section of upper wall portion 60*c* of sleeve 60. Thus, when the same hydraulic pressure in the main oil gallery 25 (the branch passage 29) has been supplied to both the upside of sleeve 60 and the underside of sleeve 60, sleeve 60 is upwardly displaced and thus kept at its hydraulically-actuated original position shown in FIG. 16B under pressure by virtue of the pressure-receiving area difference between the upside of sleeve 60 and the underside of sleeve 60. Hence, the upper wall portion 60*c* of sleeve 60 is kept in abutted-engagement with the shouldered bearing surface 30*d* of stepped cylindrical close-fitting bore 30. By the way, the width (i.e., the axial length) of the first land 32*a* is dimensioned to be approximately equal to the opening width of each of communication ports 61. Therefore, when the first land 32*a* downwardly moves to the axial position of the communication ports 61, fluid-communication between the communication ports 61 and the drain port 31*a* through the annular groove 32*e* and the radial through hole 32*f* becomes blocked and fluid-communication between the communication ports 61 and the oil introduction port 29*a* becomes established. That is, the flow path configuration for the first communication passage 35 (i.e., the control oil chamber 16) is switched from (i) the pressure-release flow path connected to the drain port 31*a* to (ii) the pressure-supply flow path connected to the oil introduction port 29*a*. Hence, hydraulic pressure is introduced through the oil introduction port 29*a* and the first communication passage 35 to the control oil chamber 16 and as a result the pump discharge flow rate can be adjusted by a counterclockwise displacement of cam ring 5 against the spring force of coil spring 28. In this manner, immediately when the pump discharge pressure reaches the given hydraulic pressure P1, fluid-communication between the oil introduction port 29*a* and the first communication passage 35 becomes established, and thereafter the hydraulic pressure in the control oil chamber 16 can be appropriately controlled or regulated by appropriate switching between (i) the pressure-release flow path connected to the drain port 31*a* and (ii) the pressure-supply flow path connected to the oil introduction port 29*a* by virtue of slight upward and downward axial displacements of the first land 32*a*, such that the pump discharge pressure can be held at the given hydraulic pressure P1.

Also, when the hydraulic pressure (the pump discharge pressure) has to be risen to the given hydraulic pressure level P2, the electromagnetic coil of directional control valve 8 becomes de-energized responsively to an OFF signal from the control unit, thereby permitting hydraulic pressure to be directed from the pressure-receiving chamber 64 to the oil pan. Hence, sleeve 60 begins to move downward from the hydraulically-actuated original position of FIG. 16B with hydraulic pressure, applied through the oil introduction port 29*a* to the annular pressure-receiving section of upper wall portion 60*c* of sleeve 60, due to working fluid drained from the pressure-receiving chamber 64, in other words, a pressure drop in the pressure-receiving chamber 64 (see FIG. 16C), and thus the annular lower sidewall surface of flanged large-diameter portion 60*b* of sleeve 60 is brought into abutted-engagement with a stepped stopper face 31*c* of the stepped portion between the protruding portion 31*b* and the large-diameter disk-shaped lid portion of lid member 31. At this time, a maximum downward displacement of sleeve 60 is restricted by abutment of the annular lower sidewall surface of flanged large-diameter portion 60*b* with the stopper face 31*c*. As a result, as appreciated from the cross section of FIG. 16C, the volume of pressure-receiving chamber 64 becomes a minimum volumetric capacity.

As can be seen from the cross section of FIG. 16C, in accordance with the downward movement of sleeve 60, as a matter of course, the communication ports 61 move downward. Thus, the first land 32*a* of spool 32, together with the communication ports 61, moves downward, while compressing the valve spring 34 by the circular top of the first land 32*a*. Hence, the spring load of valve spring 34 becomes a higher spring load. At this time, a switching pressure when switching the flow path configuration for the first communication passage 35 (i.e., the control oil chamber 16) between (i) the pressure-release flow path connected to the drain port 31*a* and (ii) the pressure-supply flow path connected to the oil introduction port 29*a*, becomes the given hydraulic pressure level P2 shown in FIG. 6. By the way, the opening width of the opening end of the first communication passage 35 is set or dimensioned such that the first communication passage 35 always communicates with the communication ports 61 over the entire range of axial displacement of ports 61.

The other operation and effects of the pump system of the seventh embodiment are the same as the fourth embodiment. However, in the seventh embodiment, in contrast to the above, when there is no hydraulic pressure supply to the pressure-receiving chamber 64 with the electromagnetic coil of directional control valve 8 de-energized (OFF), the pump discharge pressure becomes set or held at the given hydraulic pressure level P2 (the high pressure level), thus ensuring a fail-safe effect in the presence of undesirable clogging of the flow paths of the hydraulic circuit of the pump system.

[Eighth Embodiment]

Figure 17A:
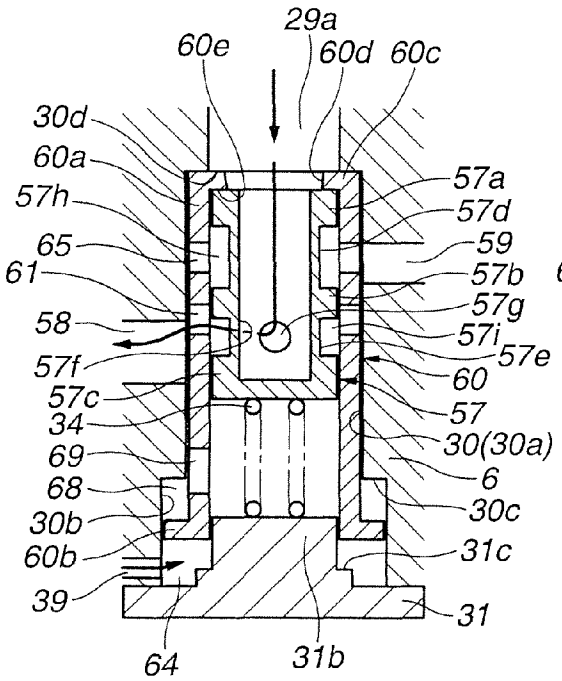
FIG. 17A is an explanatory view, in longitudinal cross section, illustrating the operation of a pilot valve of the variable displacement oil pump system of the eighth embodiment during the early stage of engine start-up.
Figure 17B:
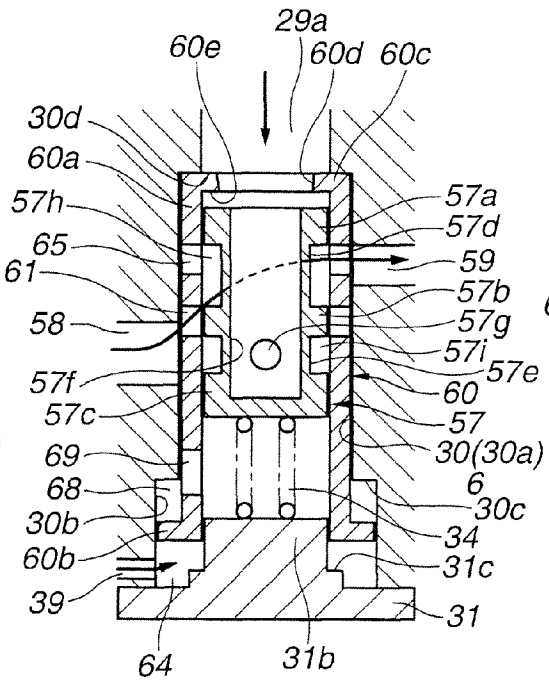
FIG. 17B is an explanatory view illustrating the operation of the pilot valve during a steady-state engine operating mode.
Figure 17C:
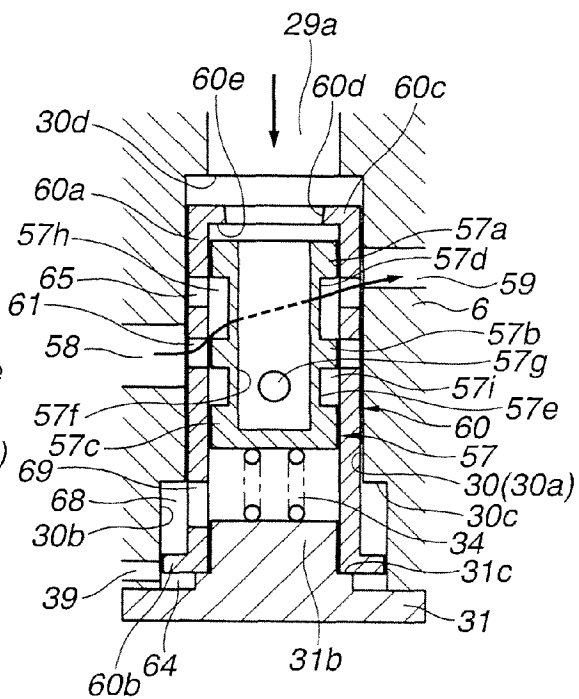
FIG. 17C is an explanatory view illustrating the operation of the pilot valve during high-load operation.

Referring now to FIGS. 17A-17C, there is shown a further modified sleeve-equipped pilot valve structure incorporated in the variable displacement oil pump system of the eighth embodiment. The basic pilot valve structure of the eighth embodiment is similar to the fifth embodiment.

The eighth embodiment somewhat differs from the fifth embodiment in that, in a similar manner to the seventh embodiment, the structure (the cross section) of the sleeve 60 of pilot valve 7 of the eighth embodiment, disposed between the stepped cylindrical close-fitting bore 30 and the spool 57, is changed.

More concretely, in the eighth embodiment, sleeve 60 has an upper wall portion 60*c* formed integral with the uppermost end of small-diameter portion 60*a*. Upper wall portion 60*c* of sleeve 60 has a large-diameter communication bore 60*d* (an axial through hole) formed substantially at the center of the upper wall portion 60*c*. Large-diameter communication bore 60*c* is configured to always communicate with the oil introduction port 29*a*. The underside of upper wall portion 60*c* serves as a second bearing surface 60*e* that restricts a maximum upward movement of spool 57. The structure of spool 57 of pilot valve 7 of the eighth embodiment is identical to that of the fifth embodiment.

Small-diameter portion 60*a* of sleeve 60 has a plurality of communication ports 61 (circumferentially equidistant-spaced radial through holes) at a given axial position substantially corresponding to the third communication passage 58. Also, the small-diameter portion 60*a* of sleeve 60 has a plurality of drain ports 65 (circumferentially equidistant-spaced radial through holes) at an upper axial position than the communication ports 61 and substantially corresponding to the drain passage 59.

In the initial state of pilot valve 7, as shown in FIG. 17A, spool 57 is forced into abutted-engagement with the second bearing surface 60*e* of sleeve 60 by the spring force of valve spring 34. At the same time, sleeve 60 is forced into abutted-engagement with the shouldered bearing surface 30*d* by the spring force of valve spring 34.

In the initial state of pilot valve 7, as shown in FIG. 17A, the communication ports 61 are communicated with the oil introduction port 29*a* through the radial through hole 57*g*, and thus the third communication passage 58 (i.e., the second control oil chamber 53) is communicated with the oil introduction port 29*a*. Thus, hydraulic pressure in the main oil gallery 25 is delivered into the second control oil chamber 53. The pump-body structure of the variable displacement oil pump of the eighth embodiment (see FIGS. 17A-17C) is identical to that of the fifth embodiment (see FIGS. 14A-14C). Also, the connecting path configuration between the pump body and the electromagnetic solenoid operated directional control valve 8 in the pump system of the eighth embodiment is identical to that of the fifth embodiment, thus providing the two-stage pump discharge pressure characteristic shown in FIG. 6. However, the electromagnetic solenoid operated directional control valve 8 incorporated in the pump system of the eighth embodiment shown in FIGS. 17A-17C, is changed to a different directional-control-valve specification that supplies hydraulic pressure from the branch passage 29 through the directional control valve via the second communication passage 39 to the annular pressure-receiving chamber 64 when energized (ON), and also blocks the pressure-supply flow path from the branch passage 29 via the second communication passage 39 to the annular pressure-receiving chamber 64 and simultaneously switches the flow path configuration for the second communication passage 39 to a pressure-release flow path from the second communication passage 39 through the directional control valve to the drain port 47 when de-energized (OFF).

FIG. 17B shows the working state of pilot valve 7 of the pump system of the eighth embodiment during a steady-state engine operating mode, at which the pump discharge pressure rises up to the given hydraulic pressure level P1. As clearly shown in FIG. 17B, spool 57 shifts to a slightly downward-displaced axial position (see the axial position of spool 57 shown in FIG. 17B). The width (i.e., the axial length) of the first land 57*a* and the inside diameter (i.e., the opening width) of each of the communication ports 61 are dimensioned to be approximately equal to each other. At the unique axial position of spool 57 shown in FIG. 17B, a unique flow path configuration for the communication ports 61 (i.e., the third communication passage 58) is switched from (i) a pressure-supply flow path connected to the oil introduction port 29*a* to (ii) a pressure-release flow path connected to the drain passage 59. Hence, a fall in hydraulic pressure in the second control oil chamber 53 occurs and as a result the pump discharge flow rate can be adjusted by a counterclockwise displacement of cam ring 5 against the spring force of coil spring 28. In this manner, immediately when the pump discharge pressure reaches the given hydraulic pressure P1, fluid-communication between the drain passage 59 and the third communication passage 58 becomes established, and thereafter the hydraulic pressure in the second control oil chamber 53 can be appropriately controlled or regulated by appropriate switching between (i) the pressure-supply flow path connected to the oil introduction port 29*a* and (ii) the pressure-release flow path connected to the drain passage 59 by virtue of slight upward and downward axial displacements of the second land 57*b*, such that the pump discharge pressure can be held at the given hydraulic pressure P1.

Also, when the hydraulic pressure (the pump discharge pressure) has to be risen to the given hydraulic pressure level P2, the electromagnetic coil of directional control valve 8 becomes de-energized responsively to an OFF signal from the control unit, thereby permitting hydraulic pressure to be directed from the pressure-receiving chamber 64 to the oil pan. Hence, sleeve 60 begins to move downward from the hydraulically-actuated original position of FIG. 17B with hydraulic pressure, applied through the oil introduction port 29*a* to the annular pressure-receiving section of upper wall portion 60*c* of sleeve 60, due to working fluid drained from the pressure-receiving chamber 64, in other words, a pressure drop in the pressure-receiving chamber 64 (see FIG. 17C), and thus the annular lower sidewall surface of flanged large diameter portion 60*b* of sleeve 60 is brought into abutted-engagement with the stepped stopper face 31*c* of the stepped portion between the protruding portion 31*b* and the large-diameter disk-shaped lid portion of lid member 31. At this time, a maximum downward displacement of sleeve 60 is restricted by abutment of the annular lower sidewall surface of flanged large-diameter portion 60*b* with the stopper face 31*c*. As a result, as appreciated from the cross section of FIG. 17C, the volume of pressure-receiving chamber 64 becomes a minimum volumetric capacity.

As can be seen from the cross section of FIG. 17C, in accordance with the downward movement of sleeve 60, as a matter of course, the communication ports 61 move downward. Thus, the first land 57*a* of spool 57, together with the communication ports 61, moves downward, while compressing the valve spring 34 by the underside of the third land 57*c*. Hence, the spring load of valve spring 34 becomes a higher spring load. At this time, a switching pressure when switching the flow path configuration for the third communication passage 58 (i.e., the second control oil chamber 53) between (i) the pressure-release flow path connected to the drain passage 59 and (ii) the pressure-supply flow path connected to the oil introduction port 29*a*, becomes the given hydraulic pressure level P2 shown in FIG. 6. By the way, the opening width of the opening end of the third communication passage 58 is set or dimensioned such that the third communication passage 58 always communicates with the communication ports 61 over the entire range of axial displacement of ports 61. Additionally, the opening width of the drain passage 59 is set or dimensioned such that the drain passage 59 always communicates with the drain ports 65 over the entire range of axial displacement of ports 65.

[Ninth Embodiment]

Figure 18A:
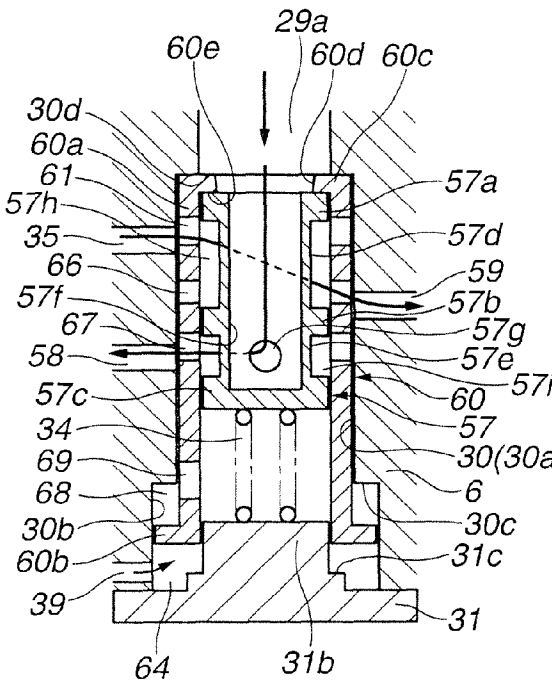
FIG. 18A is an explanatory view, in longitudinal cross section, illustrating the operation of a pilot valve of the variable displacement oil pump system of the ninth embodiment during the early stage of engine start-up.
Figure 18B:
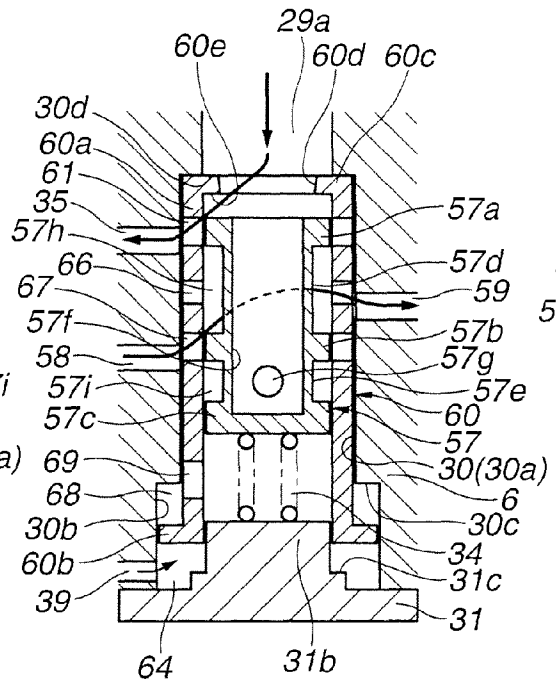
FIG. 18B is an explanatory view illustrating the operation of the pilot valve during a steady-state engine operating mode.
Figure 18C:
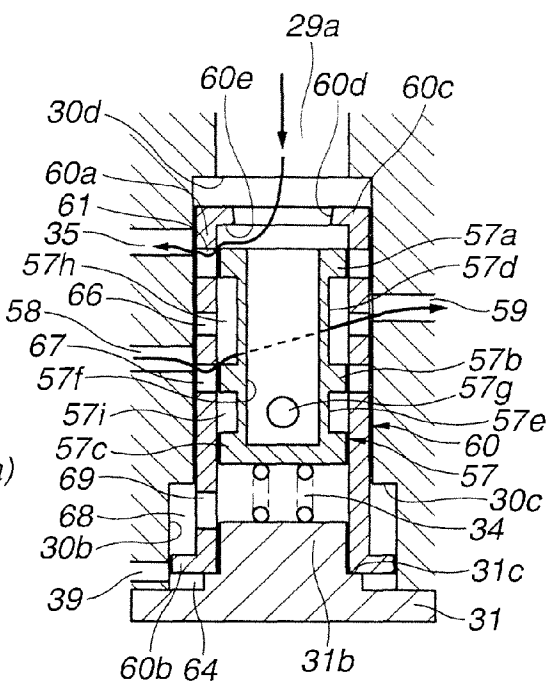
FIG. 18C is an explanatory view illustrating the operation of the pilot valve during high-load operation.

Referring now to FIGS. 18A-18C, there is shown a still further modified sleeve-equipped pilot valve structure incorporated in the variable displacement oil pump system of the ninth embodiment. The ninth embodiment is a modification that the sleeve-equipped pilot valve structure, somewhat similar to the seventh and eighth embodiments, is applied to the pump system of the sixth embodiment. That is, in the ninth embodiment, the outer periphery of small-diameter portion 60*a* is machined to axially slide in the small-diameter bore 30*a* with a very small radial clearance. In a similar manner, the outer periphery of flanged large-diameter portion 60*b* is machined to axially slide in the large-diameter bore 30*b* with a very small radial clearance. Additionally, three lands 57*a*-57*c* of spool 57 are machined to axially slide in the close-fitting cylindrical bore of small-diameter portion 60*a* with a very small radial clearance. Upper wall portion 60*c* of sleeve 60 has a large-diameter communication bore 60*d* (an axial through hole) formed substantially at the center of the upper wall portion 60*c*. The underside of upper wall portion 60*c* serves as a second bearing surface 60*e* that restricts a maximum upward movement of spool 57.

The small-diameter portion 60*a* of sleeve 60 has first communication ports 61 (radial through holes) configured to communicate with the first communication passage 35, drain ports 66 (radial through holes) configured to communicate with the drain passage 59, and second communication ports 67 (radial through holes) configured to communicate with the third communication passage 58.

In the initial state of pilot valve 7, as shown in FIG. 18A, spool 57 is forced into abutted-engagement with the second bearing surface 60*e* of sleeve 60 by the spring force of valve spring 34. At the same time, sleeve 60 is forced into abutted-engagement with the shouldered bearing surface 30*d* by the spring force of valve spring 34.

In the initial state of pilot valve 7, as shown in FIG. 18A, the first communication passage 35 is communicated with the drain ports 66 through the first communication ports 61 and the first annular groove 57*h*, whereas the third communication passage 58 is communicated with the oil introduction port 29*a* through the second communication ports 67 and the radial through hole 57*g*. Thus, hydraulic pressure in the main oil gallery 25 is delivered into the second control oil chamber 53. The pump-body structure of the variable displacement oil pump of the ninth embodiment (see FIGS. 18A-18C) is identical to that of the third embodiment (FIGS. 10-12) and the sixth embodiment (see FIGS. 15A-15C). Also, the connecting path configuration between the pump body and the electromagnetic solenoid operated directional control valve 8 in the pump system of the ninth embodiment is identical to that of the third embodiment and the sixth embodiment, thus providing the two-stage pump discharge pressure characteristic shown in FIG. 6. However, the electromagnetic solenoid operated directional control valve 8 incorporated in the pump system of the ninth embodiment shown in FIGS. 18A-18C, is changed to a different directional-control-valve specification that supplies hydraulic pressure from the branch passage 29 through the directional control valve via the second communication passage 39 to the annular pressure-receiving chamber 64 when energized (ON), and also blocks the pressure-supply flow path from the branch passage 29 via the second communication passage 39 to the annular pressure-receiving chamber 64 and simultaneously switches the flow path configuration for the second communication passage 39 to a pressure-release flow path from the second communication passage 39 through the directional control valve to the drain port 47 when de-energized (OFF).

FIG. 18B shows the working state of pilot valve 7 of the pump system of the ninth embodiment during a steady-state engine operating mode, at which the pump discharge pressure rises up to the given hydraulic pressure level P1. As clearly shown in FIG. 18B, spool 57 shifts to a slightly downward-displaced axial position (see the axial position of spool 57 shown in FIG. 18B). The width (i.e., the axial length) of the first land 57*a* and the inside diameter (i.e., the opening width) of each of the first communication ports 61 are dimensioned to be approximately equal to each other. Additionally, the width (i.e., the axial length) of the second land 57*b* and the inside diameter (i.e., the opening width) of each of the second communication ports 67 are dimensioned to be approximately equal to each other. Therefore, when the first and second lands 57*a*-57*b* downwardly move to respective axial positions of the first and second communication ports 61 and 67, at the unique axial position of spool 57 shown in FIG. 18B, a unique flow path configuration for the first communication ports 61 (i.e., the first communication passage 35) is switched from (i) a pressure-release flow path connected to the drain ports 66 to (ii) a pressure-supply flow path connected to the oil introduction port 29*a*, and simultaneously a unique flow path configuration for the second communication ports 67 (i.e., the third communication passage 58) is switched from (i) a pressure-supply flow path connected to the oil introduction port 29*a* to (ii) a pressure-release flow path connected to the drain ports 66. Hence, a rise in hydraulic pressure in the first control oil chamber 16 and a fall in hydraulic pressure in the second control oil chamber 53 occur simultaneously and as a result the pump discharge flow rate can be adjusted by a counterclockwise displacement of cam ring 5 against the spring force of coil spring 28. In this manner, immediately when the pump discharge pressure reaches the given hydraulic pressure P1, fluid-communication between the oil introduction port 29*a* and the first communication passage 35 and fluid-communication between the drain passage 59 and the third communication passage 58 become established, and thereafter the hydraulic pressure in the first control oil chamber 16 can be appropriately controlled or regulated by appropriate switching between (i) the pressure-release flow path connected to the drain passage 59 and (ii) the pressure-supply flow path connected to the oil introduction port 29*a* by virtue of slight upward and downward axial displacements of the first land 57*a*, and simultaneously the hydraulic pressure in the second control oil chamber 53 can be appropriately controlled or regulated by appropriate switching between (i) the pressure-supply flow path connected to the oil introduction port 29*a* and (ii) the pressure-release flow path connected to the drain passage 59 by virtue of slight upward and downward axial displacements of the second land 57*b*, such that the pump discharge pressure can be held at the given hydraulic pressure P1.

Also, when the hydraulic pressure (the pump discharge pressure) has to be risen to the given hydraulic pressure level P2, the electromagnetic coil of directional control valve 8 becomes de-energized responsively to an OFF signal from the control unit, thereby permitting hydraulic pressure to be directed from the pressure-receiving chamber 64 to the oil pan. Hence, sleeve 60 begins to move downward from the hydraulically-actuated original position of FIG. 18B with hydraulic pressure, applied through the oil introduction port 29*a* to the annular pressure-receiving section of upper wall portion 60*c* of sleeve 60, due to working fluid drained from the pressure-receiving chamber 64, in other words, a pressure drop in the pressure-receiving chamber 64 (see FIG. 18C), and thus the annular lower sidewall surface of flanged large-diameter portion 60*b* of sleeve 60 is brought into abutted-engagement with the stepped stopper face 31*c* of the stepped portion between the protruding portion 31*b* and the large-diameter disk-shaped lid portion of lid member 31. At this time, a maximum downward displacement of sleeve 60 is restricted by abutment of the annular lower sidewall surface of flanged large-diameter portion 60*b* with the stopper face 31*c*. As a result, as appreciated from the cross section of FIG. 18C, the volume of pressure-receiving chamber 64 becomes a minimum volumetric capacity.

As can be seen from the cross section of FIG. 18C, in accordance with the downward movement of sleeve 60, as a matter of course, first and second communication ports 61 and 67 move downward. Thus, the first land 57*a*, together with the first communication ports 61 and the second land 57*b*, together with the second communication ports 67, move downward, while compressing the valve spring 34 by the underside of the third land 57*c*. Hence, the spring load of valve spring 34 becomes a higher spring load. At this time, a switching pressure when switching the flow path configuration for the first communication passage 35 (i.e., the first control oil chamber 16) between (i) the pressure-release flow path connected to the drain ports 66 and (ii) the pressure-supply flow path connected to the oil introduction port 29*a* and simultaneously switching the flow path configuration for the third communication passage 58 (i.e., the second control oil chamber 53) between (i) the pressure-supply flow path connected to the oil introduction port 29*a* and (ii) the pressure-release flow path connected to the drain ports 66, becomes the given hydraulic pressure level P2 shown in FIG. 6.

By the way, the opening width of the opening end of the first communication passage 35 is set or dimensioned such that the first communication passage 35 always communicates with the first communication ports 61 over the entire range of axial displacement of ports 61. Additionally, the opening width of the drain passage 59 is set or dimensioned such that the drain passage 59 always communicates with the drain ports 66 over the entire range of axial displacement of ports 66.

As will be appreciated from the above, according to the inventive concept, the electromagnetic solenoid-operated directional control valve 8 is configured to cooperate with either the slider 33 or the sleeve 60, for automatically changing the spring-load setting (the preload setting) of spool-valve spring 34 and for variably controlling timing at which switching between the oil-discharge flow path from the control chamber (16; 16, 53) and the oil-introduction flow path to the control chamber occurs, with respect to the discharge pressure applied at the oil introduction port 29*a* of the pilot valve 7 (see the variable displacement oil pump employing the large-diameter spring-support slider-equipped pilot valve structure in the first to third embodiments and the variable displacement oil pump employing the ported-sleeve-equipped pilot valve structure in the fourth to ninth embodiments).

Also, as appreciated from the above, in the case of the variable displacement oil pump employing the large-diameter spring-support slider-equipped pilot valve structure in the first to third embodiments, the axial position of the movable spring-support slider 33 can be appropriately changed or switched between a given first axial position (a spring-loaded original position) and a given second axial position (a maximum displaced position) by using the electromagnetic solenoid-operated directional control valve 8, depending on a pressure level of the discharge pressure. During a low discharge pressure operating mode of the pump at the pressure level P1, with the directional control valve 8 energized (ON), the slider 33 is kept at its spring-loaded original position, thereby ensuring a comparatively low load resistance to sliding movement of the spool, sliding against the spring bias of valve spring 34 by the discharge pressure applied at the oil introduction port 29*a*. This means the ease of sliding of the spool against the spring bias of valve spring 34 with the discharge pressure applied at the oil introduction port 29*a*, but such a low load resistance matches the pressure level P1, in other words, a low-pressure setting of valve spring 34. Conversely during a high discharge pressure operating mode of the pump at the pressure level P2, with the directional control valve 8 de-energized (OFF), the slider 33 is kept at its maximum axially-displaced position, thereby ensuring a comparatively high load resistance to sliding movement of the spool, sliding against the spring bias of valve spring 34 by the discharge pressure applied at the oil introduction port 29*a*. This means the difficulty of sliding of the spool with the discharge pressure applied at the oil introduction port 29*a*, but such a high load resistance matches the pressure level P2, in other words, a high-pressure setting of valve spring 34. In the shown embodiments, timing of switching between the low-pressure and high-pressure settings is variably controlled electrically by ON/OFF control for the electromagnetic solenoid-operated directional control valve 8. In other words, the electromagnetic solenoid-operated directional control valve 8 is configured to control a load resistance to the sliding movement of the spool with a change in the spring bias of valve spring 34, occurring by displacing the slider 33, which is provided for supporting the lower end of valve spring 34, depending on a pressure level of the discharge pressure.

Furthermore, in the shown embodiments, the communication passage (e.g., the first communication passage 35) of the spool is configured to be temporarily closed when switching a flow path configuration for the communication passage between an oil-introduction flow path from the discharge portion (e.g., the discharge port 12) via the communication passage to the control chamber (e.g., the first control oil chamber 16) and an oil-discharge flow path from the control chamber via the communication passage to a low-pressure portion (e.g., the drain passage 37), thus ensuring high-precision switching between the oil-introduction flow path and the oil-discharge flow path.

Moreover, in the fifth (see FIGS. 14A-14C), sixth (see FIGS. 15A-15C), eighth (see FIGS. 17A-17C), and ninth (see FIGS. 18A-18C) embodiments, the discharge pressure is applied at one part of an internal space defined in the sliding sleeve 60, facing the pressure-receiving section of the spool, whereas atmospheric pressure is applied at the other part of the internal space, facing apart from the pressure-receiving section of the spool. This ensures smooth sliding motion of the spool during operation of the pump.

Figure 19A:
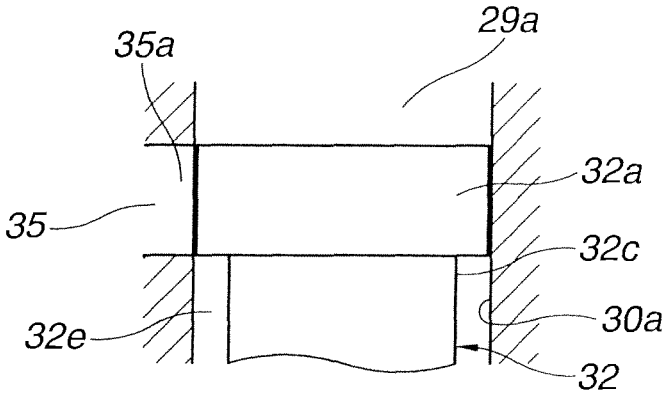
FIG. 19A is an explanatory view, partly in cross section, illustrating a flow-passage structure in which the width of one opening end of a flow passage, whose passage area can be changed depending on the axial position of a cylindrical land of the pilot-valve spool, is approximately equal to the axial length of the cylindrical land.
Figure 19B:
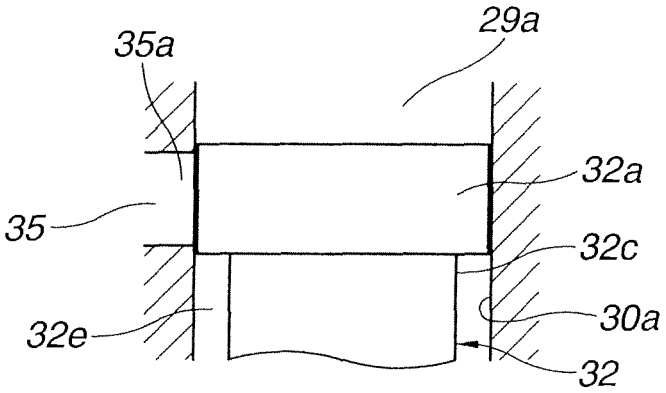
FIG. 19B is an explanatory view, partly in cross section, illustrating another flow-passage structure in which the width of the opening end of the flow passage is less than the axial length of the cylindrical land.
Figure 19C:
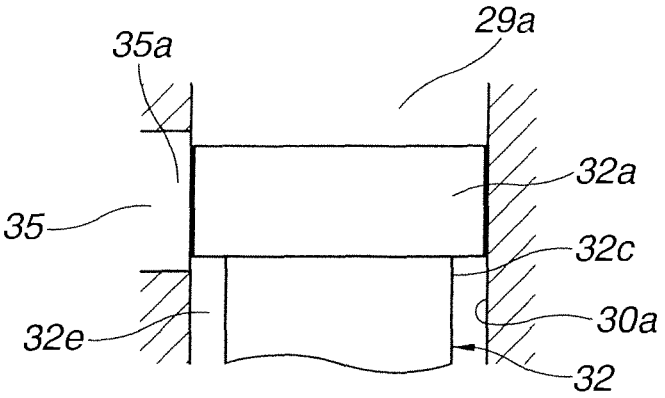
FIG. 19C is an explanatory view, partly in cross section, illustrating a further flow-passage structure in which the width of the opening end of the flow passage is greater than the axial length of the cylindrical land.

Referring now to FIGS. 19A-19C, there are shown various flow-passage structures differing from each other in width dimensions concerning the opening width of the opening end of the first communication passage 35 with respect to the width (the axial length) of the first land 32*a* (the cylindrical land), for example, in the first embodiment. FIG. 19A shows the first flow-passage structure in which the opening width of the opening end 35*a* of the first communication passage 35 and the width (the axial length) of the first land 32*a* are dimensioned or configured to be approximately equal to each other. FIG. 19B shows the second flow-passage structure in which the opening width of the opening end 35*a* of the first communication passage 35 is dimensioned to be slightly less than the width (the axial length) of the first land 32*a*. FIG. 19C shows the third flow-passage structure in which the opening width of the opening end 35*a* of the first communication passage 35 is dimensioned to be slightly greater than the width (the axial length) of the first land 32*a*. In this manner, by relatively changing the opening width of the opening end 35*a* of the first communication passage 35 with respect to the width (the axial length) of the first land 32*a*, it is possible to arbitrarily control or adjust a hydraulic-pressure supply (i.e., an amount of working oil) to the control oil chamber 16, for the same stroke (i.e., the same axial displacement) of spool 32.

Figure 20A:
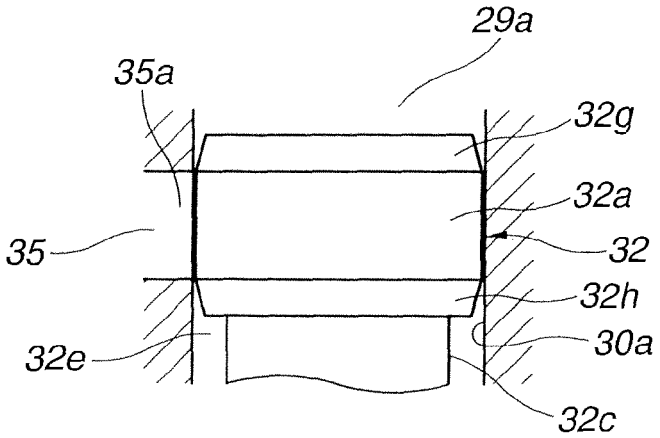
FIG. 20A is an explanatory view, partly in cross section, illustrating a flow-passage structure in which the width of one opening end of a flow passage, whose passage area can be changed depending on the axial position of a somewhat exaggerated, barrel-shaped land of the pilot-valve spool, is approximately equal to the axial length of the barrel-shaped land.
Figure 20B:
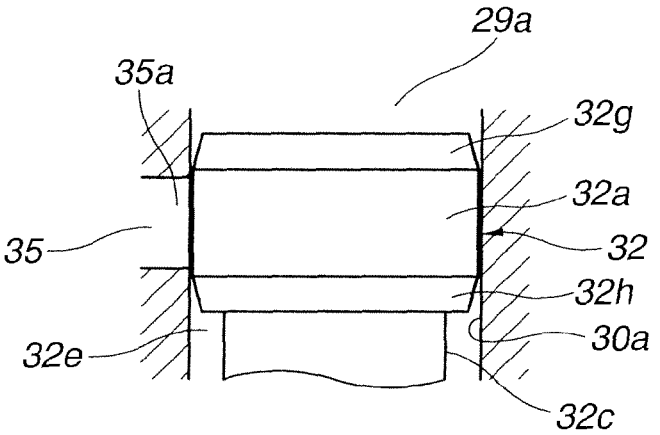
FIG. 20B is an explanatory view, partly in cross section, illustrating another flow-passage structure in which the width of the opening end of the flow passage is less than the axial length of the barrel-shaped land.
Figure 20C:
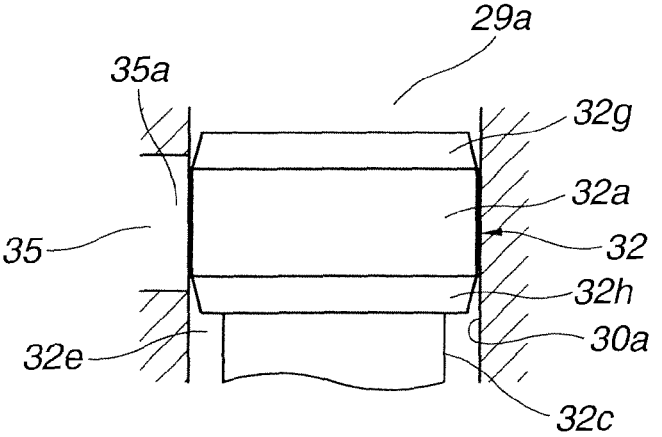
FIG. 20C is an explanatory view, partly in cross section, illustrating a further flow-passage structure in which the width of the opening end of the flow passage is greater than the axial length of the barrel-shaped land.

Referring now to FIGS. 20A-20C, there are shown various flow-passage structures differing from each other in width dimensions concerning the opening width of the opening end 35*a* of the first communication passage 35 with respect to the width (the axial length) of the first land 32*a* (the barrel-shaped land). As can be appreciated, the shape of the first land 32*a* of FIGS. 20A-20C differs from that of FIGS. 19A-19C. More concretely, the first land 32*a* of FIGS. 19A-19C is a cylindrical land. On the other hand, the first land 32*a* of FIGS. 20A-20C is a barrel-shaped land. As seen in FIGS. 20A-20C, both axial ends of the first land 32*a* are chamfered (see two chamfered portions 32*g*-32*h* in FIGS. 20A-20C). In FIGS. 20A-20C, these chamfered portions 32*g*-32*h* are exaggerated. By the use of the barrel-shaped land (i.e., due to the barrel-like cross section), even when the width (the axial length) of the first land 32*a* is dimensioned to be slightly greater than the opening width of the opening end 35*a* of the first communication passage 35, a slight clearance exists between the outer peripheral curved surface of the first land 32*a* and the inner peripheral wall surface of small-diameter bore 30*a*, and hence three flow-path directions (namely, the flow passage through the oil introduction port 29*a*, the flow passage through the annular groove 32*e*, and the flow passage through the opening end 35*a* of the first communication passage 35) cannot be completely shut off. By selecting either the cylindrical land or the barrel-shaped land, it is possible to appropriately change the relationship between a change in the flow passage area of the small aperture, defined by the first land 32*a* to communicate the oil introduction port 29*a* with the first communication passage 35, and a spool stroke (a spool axial displacement). Thus, it is preferable to use or select a suitable one from different land shapes (i.e., a cylindrical land and a barrel-shaped land), depending on a specification of the pump body and/or a working pressure of the pump.

As can be appreciated from the above, by appropriately selecting either a cylindrical land or a barrel-shaped land and/or by relatively changing the opening width of the opening end of the communication passage with respect to the width (the axial length) of the associated land, it is possible to appropriately change a rate of change in the flow passage area of the small aperture, defined by the land, with respect to spool stroke (spool axial displacement). The concept of the modified flow-passage structure with respect to the valve-spool land and the concept of the modified valve-spool land cross-section, explained in reference to FIGS. 19A-19C and FIGS. 20A-20C and exemplified in the first embodiment, can be applied to all of the shown embodiments.

The entire contents of Japanese Patent Application No. 2012-196712 (filed Sep. 7, 2012) are incorporated herein by reference.

While the foregoing is a description of the preferred embodiments carried out the invention, it will be understood that the invention is not limited to the particular embodiments shown and described herein, but that various changes and modifications may be made without departing from the scope or spirit of this invention as defined by the following claims.

What is claimed is:

1. A variable displacement oil pump comprising:

a pump structural unit adapted to be driven by an internal combustion engine for varying a volume of each of a plurality of working chambers and for discharging oil, drawn into an inlet portion, from a discharge portion;

a variable-volume mechanism configured to vary a variation of the volume of each of the working chambers, wherein the chambers open into the discharge portion, by a displacement of a moveable member included in the pump structural unit;

a first biasing member for forcing the movable member in a biased direction that the variation of the volume of each of the working chambers increases;

a control chamber configured to change a displaced position of the moveable member by introducing the oil, discharged from the discharge portion, into the control chamber;

a directional control valve including a spool having a pressure-receiving section for receiving a discharge pressure from the discharge portion and slidably installed in a close-fitting bore into which a communication passage opens and which communicates with the control chamber, a second biasing member for forcing the spool in one sliding direction opposite to another sliding direction of the spool corresponding to a direction of action of the discharge pressure acting on the pressure-receiving section of the spool, a movable support slidably located at a position being axially opposite to the spool, sandwiching the second biasing member between the spool and the movable support, the movable support being configured to be forced in a same axial direction as the another sliding direction of the spool by the second biasing member, and a pressure-receiving chamber defined between the movable support and a bottom of the close-fitting bore, the directional control valve being configured to selectively switch between an oil-discharge from the control chamber and an oil-introduction from the discharge portion to the control chamber by a sliding movement of the spool resulting from a relative pressure force between a biasing force created by the discharge pressure and a biasing force of the second biasing member; and a control mechanism disposed between the discharge portion and the directional control valve and configured to control the sliding movement of the spool by electrically controlling switching between a supply mode at which the discharge pressure is supplied from the discharge portion to the pressure-receiving chamber via the control mechanism and a drain mode at which fluid communication between the discharge portion and the pressure-receiving chamber is blocked and an oil-discharge from the pressure-receiving chamber via the control mechanism is permitted, thereby displacing the movable support.

2. The variable displacement oil pump as claimed in claim 1, wherein:

the close-fitting bore is formed as a stepped cylindrical close-fitting bore, and comprised of a small-diameter bore in which the spool slides and a large-diameter bore in which the moveable support slides; and a maximum displaced position of the moveable support is restricted by abutment with a shouldered portion formed between the small-diameter bore and the large-diameter bore.

3. The variable displacement oil pump as claimed in claim 1, wherein:

a part of the close-fitting bore, in which the second biasing member that forces the spool is installed, is configured as a low-pressure portion kept in a low-pressure state.

4. The variable displacement oil pump as claimed in claim 1, wherein:

the moveable member is displaced in a direction opposite to the biased direction against the biasing force of the first biasing member by a hydraulic pressure introduced from the discharge portion via the communication passage into the control chamber;

an oil-introduction flow path from the discharge portion via the communication passage to the control chamber is established by the sliding movement of the spool in the other sliding direction against the biasing force of the second biasing member with the discharge pressure; and an oil-discharge flow path from the control chamber via the communication passage to a low-pressure portion is established under a maximum biased state of the spool forced by the biasing force of the second biasing member.

5. The variable displacement oil pump as claimed in claim 1, wherein:

the control chamber is divided into two sections, one being an applied-pressure chamber configured to create a force, which acts to displace the moveable member against the biasing force of the first biasing member, by introducing the oil, discharged from the discharge portion, into the applied-pressure chamber, and the other being a second control chamber configured to create a force, which acts to displace the moveable member in the biased direction by giving an assistance to the biasing force of the first biasing member, by introducing the oil, discharged from the discharge portion, into the second control chamber;

an oil-discharge flow path from the second control chamber via the communication passage to a low-pressure portion is established by the sliding movement of the spool in the other sliding direction against the biasing force of the second biasing member with the discharge pressure acting on the pressure-receiving section of the spool; and an oil-introduction flow path from the discharge portion via the communication passage to the second control chamber is established under a maximum biased state of the spool forced by the biasing force of the second biasing member.

6. The variable displacement oil pump as claimed in claim 1, wherein:

the control chamber is constructed by a first oil chamber configured to create a force, which acts to displace the moveable member against the biasing force of the first biasing member, by introducing the oil, discharged from the discharge portion, into the first oil chamber, and a second oil chamber configured to create a force, which acts to displace the moveable member in the biased direction by giving an assistance to the biasing force of the first biasing member, by introducing the oil, discharged from the discharge portion, into the second oil chamber;

the communication passage is constructed by a first communication passage communicating with the first oil chamber and a second communication passage communicating with the second oil chamber;

an oil-introduction flow path from the discharge portion via the first communication passage to the first oil chamber and an oil-discharge flow path from the second oil chamber via the second communication passage to a low-pressure portion are both established by the sliding movement of the spool in the other sliding direction against the biasing force of the second biasing member with the discharge pressure acting on the pressure-receiving section of the spool; and an oil-discharge flow path from the first oil chamber via the first communication passage to the low-pressure portion and an oil-introduction flow path from the discharge portion via the second communication passage to the second oil chamber are both established under a maximum biased state of the spool forced by the biasing force of the second biasing member.

7. The variable displacement oil pump as claimed in claim 1, wherein:

the communication passage of the spool is temporarily closed when switching a flow path configuration for the communication passage between an oil-introduction flow path from the discharge portion via the communication passage to the control chamber and an oil-discharge flow path from the control chamber via the communication passage to a low-pressure portion.

8. The variable displacement oil pump as claimed in claim 1, wherein:

the communication passage is configured to always communicate with either one of the discharge portion and a low-pressure portion.

9. The variable displacement oil pump as claimed in claim 1, wherein:

the spool has a large-diameter land chamfered at both ends and a small-diameter shaft defining an annular groove; and switching between the oil-discharge from the control chamber through the communication passage to a low-pressure portion and the oil-introduction from the discharge portion through the communication passage to the control chamber is achieved by the land.

10. A variable displacement oil pump comprising:

a pump structural unit adapted to be driven by an internal combustion engine for varying a volume of each of a plurality of working chambers and for discharging oil, drawn into an inlet portion, from a discharge portion;

a variable-volume mechanism configured to vary a variation of the volume of each of the working chambers, wherein the chambers open into the discharge portion, by a displacement of a moveable member included in the pump structural unit;

a first biasing member for forcing the movable member in a biased direction that the variation of the volume of each of the working chambers increases;

a control chamber configured to change a displaced position of the moveable member by introducing the oil, discharged from the discharge portion, into the control chamber;

a directional control valve including a spool having a pressure-receiving section for receiving a discharge pressure from the discharge portion, a sliding sleeve slidably installed in a stepped close-fitting bore into which a communication passage opens and which communicates with the control chamber and is configured to slidably accommodate therein the spool and also configured to have a sliding-contact surface in sliding-contact with an outer periphery of the spool and a communication port formed in the sliding-contact surface of the sliding sleeve for fluid communication between the communication port and the communication passage, a pressure-receiving chamber defined between the sliding sleeve and a shouldered portion of the stepped close-fitting bore, and a second biasing member for forcing the spool in one sliding direction, the directional control valve being configured to selectively switch between an oil-discharge from the control chamber and an oil-introduction from the discharge portion to the control chamber by switching an oil-discharge from the communication port and an oil-introduction from the discharge portion to the communication port by moving the spool the discharge pressure discharged from the discharge portion and acting on the pressure-receiving section of the spool; and a control mechanism disposed between the discharge portion and the directional control valve and configured to enable the sliding sleeve to be displaced by electrically controlling switching between a supply mode at which the discharge pressure is supplied from the discharge portion to the pressure-receiving chamber via the control mechanism and a drain mode at which fluid communication between the discharge portion and the pressure-receiving chamber is blocked and an oil discharge from the pressure-receiving chamber via the control mechanism is permitted.

11. The variable displacement oil pump as claimed in claim 10, wherein:

the sliding sleeve has a pressure-receiving surface that enables the sliding sleeve to be displaced in either one of the sliding directions of the spool by receiving the discharge pressure introduced from the discharge portion into the pressure-receiving chamber.

12. The variable displacement oil pump as claimed in claim 11, wherein:

the sliding sleeve has a radially-extending flanged portion formed integral with an outer periphery of the sliding sleeve; and one sidewall surface of the flanged portion is formed as the pressure-receiving surface of the sliding sleeve.

13. The variable displacement oil pump as claimed in claim 12, wherein:

the discharge pressure is applied at one part of an internal space defined in the sliding sleeve, facing the pressure-receiving section of the spool, whereas atmospheric pressure is applied at the other part of the internal space, facing apart from the pressure-receiving section of the spool.

14. The variable displacement oil pump as claimed in claim 10 wherein:

the control chamber is configured to create a force, which acts to displace the moveable member against the biasing force of the first biasing member, by introducing the oil, discharged from the discharge portion, into the first oil chamber;

an oil-introduction flow path from the discharge portion via the communication passage to the control chamber is established by the sliding movement of the spool in the other sliding direction against the biasing force of the second biasing member with the discharge pressure acting on the pressure-receiving section of the spool; and an oil-discharge flow path from the control chamber via the communication passage to a low-pressure portion is established under a maximum biased state of the spool forced by the biasing force of the second biasing member.

15. The variable displacement oil pump as claimed in claim 10, wherein:

the control chamber is divided into two sections, one being an applied-pressure chamber configured to create a force, which acts to displace the moveable member against the biasing force of the first biasing member, by introducing the oil, discharged from the discharge portion, into the applied-pressure chamber, and the other being a second control chamber configured to create a force, which acts to displace the moveable member in the biased direction by giving an assistance to the biasing force of the first biasing member, by introducing the oil, discharged from the discharge portion, into the second control chamber;

an oil-discharge flow path from the second control chamber via the communication passage to a low-pressure portion is established by the sliding movement of the spool in the other sliding direction against the biasing force of the second biasing member with the discharge pressure acting on the pressure-receiving section of the spool; and an oil-introduction flow path from the discharge portion via the communication passage to the second control chamber is established under a maximum biased state of the spool forced by the biasing force of the second biasing member.

16. The variable displacement oil pump as claimed in claim 10, wherein:

the control chamber is constructed by a first oil chamber configured to create a force, which acts to displace the moveable member against the biasing force of the first biasing member, by introducing the oil, discharged from the discharge portion, into the first oil chamber, and a second oil chamber configured to create a force, which acts to displace the moveable member in the biased direction by giving an assistance to the biasing force of the first biasing member, by introducing the oil, discharged from the discharge portion, into the second oil chamber;

the communication passage is constructed by a first communication passage communicating with the first oil chamber and a second communication passage communicating with the second oil chamber;

an oil-introduction flow path from the discharge portion via the first communication passage to the first oil chamber and an oil-discharge flow path from the second oil chamber via the second communication passage to a low-pressure portion are both established by the sliding movement of the spool in the other sliding direction against the biasing force of the second biasing member with the discharge pressure acting on the pressure-receiving section of the spool; and an oil-discharge flow path from the first oil chamber via the first communication passage to the low-pressure portion and an oil-introduction flow path from the discharge portion via the second communication passage to the second oil chamber are both established under a maximum biased state of the spool forced by the biasing force of the second biasing member.

* * * * *